US010736432B2

(12) United States Patent
Nunn et al.

(10) Patent No.: US 10,736,432 B2
(45) Date of Patent: Aug. 11, 2020

(54) AUTOMATIC SENSING AND ADJUSTMENT OF A BED SYSTEM

(71) Applicant: Sleep Number Corporation, Minneapolis, MN (US)

(72) Inventors: Rob Nunn, Eden Prairie, MN (US); Robert Erko, Apple Valley, MN (US); Wade Daniel Palashewski, Andover, MN (US); Samuel Hellfeld, Minneapolis, MN (US); Yi-ching Chen, Maple Grove, MN (US)

(73) Assignee: Sleep Number Corporation, Minneapolis, MN (US)

( * ) Notice: Subject to any disclaimer, the term of this patent is extended or adjusted under 35 U.S.C. 154(b) by 0 days.

(21) Appl. No.: 16/141,100

(22) Filed: Sep. 25, 2018

(65) Prior Publication Data

US 2019/0021513 A1 Jan. 24, 2019

Related U.S. Application Data

(63) Continuation of application No. 14/802,714, filed on Jul. 17, 2015, now abandoned.

(60) Provisional application No. 62/026,109, filed on Jul. 18, 2014.

(51) Int. Cl.
*A47C 27/08* (2006.01)
*A47C 27/10* (2006.01)

(52) U.S. Cl.
CPC ..... *A47C 27/082* (2013.01); *A47C 27/083* (2013.01); *A47C 27/10* (2013.01)

(58) Field of Classification Search
CPC ..... A47C 31/123; A47C 27/08–083; A47C 27/10; G05B 2219/2608; G05B 11/011
USPC ..... 700/280–282; 5/614–616, 655.3, 706, 5/710, 713
See application file for complete search history.

(56) References Cited

U.S. PATENT DOCUMENTS

| | | | |
|---|---|---|---|
| 4,766,628 | A | 8/1988 | Greer et al. |
| 4,788,729 | A | 12/1988 | Greer et al. |
| 4,829,616 | A | 5/1989 | Walker |
| 4,890,344 | A | 1/1990 | Walker |
| 4,897,890 | A | 2/1990 | Walker |
| 4,908,895 | A | 3/1990 | Walker |
| 4,991,244 | A | 2/1991 | Walker |
| 5,144,706 | A | 9/1992 | Walker et al. |

(Continued)

FOREIGN PATENT DOCUMENTS

JP 2014-083141 5/2014

OTHER PUBLICATIONS

International Search Report and Written Opinion in International Application No. PCT/US2015/040984, dated Oct. 27, 2015, 16 pages.

(Continued)

*Primary Examiner* — Todd Aguilera
(74) *Attorney, Agent, or Firm* — Fish & Richardson P.C.

(57) ABSTRACT

An air mattress adjustment method includes adjusting the air mattress to a received user pressure setting, learning a level of pressure in the air mattress at a first plurality of times with respect to the user pressure setting, monitoring the level of pressure in the air mattress at a second plurality of times, determining that the pressure of the air mattress at one of the second plurality of times is out of range, and based on the determining, adjusting the pressure of the air mattress.

9 Claims, 21 Drawing Sheets

(56) References Cited

U.S. PATENT DOCUMENTS

| | | | | |
|---|---|---|---|---|
| 5,170,522 | A | 12/1992 | Walker | |
| 5,509,154 | A | 4/1996 | Shafer et al. | |
| 5,564,140 | A | 10/1996 | Shoenhair et al. | |
| 5,642,546 | A | 6/1997 | Shoenhair | |
| 5,652,484 | A | 7/1997 | Shafer et al. | |
| 5,765,246 | A | 6/1998 | Shoenhair | |
| 5,903,941 | A | 5/1999 | Shafer et al. | |
| 5,904,172 | A | 5/1999 | Gifft et al. | |
| 6,037,723 | A | 3/2000 | Shafer et al. | |
| 6,108,844 | A | 8/2000 | Kraft et al. | |
| 6,161,231 | A | 12/2000 | Kraft et al. | |
| 6,202,239 | B1 | 3/2001 | Ward et al. | |
| 6,397,419 | B1 | 6/2002 | Mechache | |
| 6,483,264 | B1 | 11/2002 | Shafer et al. | |
| 6,686,711 | B2 | 2/2004 | Rose et al. | |
| 6,708,357 | B2 | 3/2004 | Gaboury et al. | |
| 6,763,541 | B2 | 7/2004 | Mahoney et al. | |
| 6,804,848 | B1 | 10/2004 | Rose | |
| 6,807,698 | B2 | 10/2004 | Torbet et al. | |
| 6,832,397 | B2 | 12/2004 | Gaboury | |
| 6,883,191 | B2 | 5/2005 | Gaboury et al. | |
| 7,041,049 | B1 * | 5/2006 | Raniere | A61M 21/02 128/905 |
| 7,389,554 | B1 | 6/2008 | Rose | |
| 7,467,058 | B2 | 12/2008 | Boyd | |
| 7,849,545 | B2 | 12/2010 | Flocard et al. | |
| 7,865,988 | B2 | 1/2011 | Koughan et al. | |
| 7,869,903 | B2 | 1/2011 | Turner et al. | |
| 7,967,739 | B2 | 6/2011 | Auphan | |
| 8,090,478 | B2 | 1/2012 | Skinner et al. | |
| 8,282,452 | B2 | 10/2012 | Grigsby et al. | |
| 8,336,369 | B2 | 12/2012 | Mahoney | |
| 8,341,786 | B2 | 1/2013 | Oexman et al. | |
| 8,444,558 | B2 | 5/2013 | Young et al. | |
| 8,620,615 | B2 | 12/2013 | Oexman et al. | |
| 8,628,462 | B2 * | 1/2014 | Berka | A61M 21/02 600/26 |
| 8,672,853 | B2 | 3/2014 | Young | |
| 8,745,788 | B2 | 6/2014 | Bhai | |
| 8,769,747 | B2 | 7/2014 | Mahoney et al. | |
| 8,813,285 | B2 | 8/2014 | Oexman et al. | |
| 8,826,479 | B2 | 9/2014 | Oexman et al. | |
| 8,893,329 | B2 | 11/2014 | Petrovski et al. | |
| 8,893,336 | B2 | 11/2014 | Hsu | |
| 8,931,329 | B2 | 1/2015 | Mahoney et al. | |
| 8,966,689 | B2 | 3/2015 | McGuire et al. | |
| 8,973,183 | B1 | 3/2015 | Palashewski et al. | |
| 8,984,687 | B2 | 3/2015 | Stusynski et al. | |
| 9,737,154 | B2 | 8/2017 | Mahoney et al. | |
| 9,848,712 | B2 * | 12/2017 | Main | A47C 31/12 |
| 10,143,312 | B2 | 12/2018 | Brosnan et al. | |
| 10,448,749 | B2 | 10/2019 | Palashewski et al. | |
| 2003/0221261 | A1 | 12/2003 | Torbet et al. | |
| 2008/0052837 | A1 | 3/2008 | Blumberg | |
| 2008/0077020 | A1 | 3/2008 | Young et al. | |
| 2009/0177327 | A1 | 7/2009 | Turner et al. | |
| 2010/0087701 | A1 * | 4/2010 | Berka | A61M 21/02 600/27 |
| 2010/0170043 | A1 | 7/2010 | Young et al. | |
| 2011/0144455 | A1 | 6/2011 | Young et al. | |
| 2011/0263950 | A1 | 10/2011 | Larson et al. | |
| 2011/0308019 | A1 | 12/2011 | Terawaki et al. | |
| 2011/0314612 | A1 | 12/2011 | Hsu | |
| 2013/0283530 | A1 * | 10/2013 | Main | A47C 31/12 5/600 |
| 2014/0041127 | A1 | 2/2014 | Codos | |
| 2014/0182061 | A1 | 7/2014 | Zaiss | |
| 2014/0250597 | A1 | 9/2014 | Chen et al. | |
| 2014/0257571 | A1 | 9/2014 | Chen et al. | |
| 2014/0259417 | A1 | 9/2014 | Nunn et al. | |
| 2014/0259418 | A1 | 9/2014 | Nunn et al. | |
| 2014/0259431 | A1 | 9/2014 | Fleury | |
| 2014/0259433 | A1 | 9/2014 | Nunn et al. | |
| 2014/0259434 | A1 | 9/2014 | Nunn et al. | |
| 2014/0277611 | A1 | 9/2014 | Nunn et al. | |
| 2014/0277778 | A1 | 9/2014 | Nunn et al. | |
| 2014/0277822 | A1 | 9/2014 | Nunn et al. | |
| 2015/0007393 | A1 | 1/2015 | Palashewski | |
| 2015/0025327 | A1 | 1/2015 | Young et al. | |
| 2015/0026896 | A1 | 1/2015 | Fleury et al. | |
| 2015/0157137 | A1 | 6/2015 | Nunn et al. | |
| 2015/0157519 | A1 | 6/2015 | Stusynski et al. | |
| 2015/0182033 | A1 | 7/2015 | Brosnan et al. | |
| 2015/0182397 | A1 | 7/2015 | Palashewski et al. | |
| 2015/0182399 | A1 | 7/2015 | Palashewski et al. | |
| 2015/0182418 | A1 | 7/2015 | Zaiss | |
| 2016/0015183 | A1 | 1/2016 | Stjerna | |

OTHER PUBLICATIONS

International Preliminary Report on Patentability in Application No. PCT/US2015/040985, dated Jan. 24, 2017, 14 pages.

* cited by examiner

404

800

410a

410b

410c

1500

1600

AUTOMATIC SENSING AND ADJUSTMENT OF A BED SYSTEM

CROSS-REFERENCES

The subject matter described in this application is related to subject matter disclosed in U.S. application Ser. No. 14/209,335, filed Mar. 12, 2014, entitled "INFLATABLE AIR MATTRESS AUTOFILL AND OFF BED PRESSURE ADJUSTMENT," U.S. application Ser. No. 14/209,405, filed on Mar. 13, 2014, entitled "INFLATABLE AIR MATTRESS SLEEP ENVIRONMENT ADJUSTMENT AND SUGGESTIONS," U.S. application Ser. No. 14/209,414, filed on Mar. 13, 2014, entitled "INFLATABLE AIR MATTRESS SYSTEM WITH DETECTION TECHNIQUES," U.S. application Ser. No. 14/211,367, filed on Mar. 14, 2014, entitled "INFLATABLE AIR MATTRESS SYSTEM ARCHITECTURE,"; further, this application is a continuation application of U.S. patent application Ser. No. 14/802,714, filed Jul. 17, 2015, which claims the benefit of U.S. Provisional Application Ser. No. 62/026,109 filed Jul. 18, 2014, the entire content of all of which are herein incorporated by reference in their entirety.

TECHNICAL FIELD

This patent document pertains generally to bed systems and more particularly, but not by way of limitation, to automatic presence, pressure and temperature sensing and adjustment.

BACKGROUND

In various examples, an air mattress control system can allow a user to adjust the firmness, temperature, or position of an air mattress bed. The mattress can have more than one zone thereby allowing a left and right side of the mattress to be adjusted to different firmness levels or temperatures. Additionally, the bed can be adjustable to different positions. For example, the head section of the bed can be raised up while the foot section of the bed stays in place.

SUMMARY

In one aspect, a method includes accessing, for each of a plurality of stored values for a sleep factor, an associated pressure value. The method further includes determining a sensed value for the sleep factor. The method further includes identifying a pressure value by matching the sensed value to an associated stored value. The method further includes adjusting the pressure of an air mattress based on the identified pressure value.

Implementations can include any, all, or none of the following features. The sleep factor is the time of day and the stored values include times. The sleep factor is sleep position and the stored values include on back, on side, and on stomach. The sleep factor is sleep state, and the stored values include Rapid Eye Movement (REM) state and deep sleep state. The method including receiving the stored values and the associated pressure values; performing test for at least some of the stored values and at least some of the associated pressure values; and modifying at least one of the associated pressure values based on the performed tests. The method of claim 5, wherein: performing test for at least some of the stored values and at least some of the associated pressure values includes determining a sensed value for the sleep factor; and adjusting the pressure of the air mattress to one or more test pressures; and modifying at least one of the associated pressure values based on the performed tests includes modifying at least one of the associated pressure values to match one of the test pressures. The method including accessing, for each of a plurality of stored values for a sleep factor, an associated pressure value includes accessing, for each of a plurality of stored values for a plurality of sleep factors, an associated pressure value; determining a sensed value for the sleep factor includes determining a sensed value for each sleep factor; and identifying a pressure value by matching the sensed value to an associated stored value includes identifying a pressure value by matching the plurality of sensed values to a single pressure value.

In one aspect, a system includes a bed having an air mattress having an adjustable pressure. The system further includes a data processing system configured to: access, for each of a plurality of stored values for a sleep factor, an associated pressure value. The system further includes determine a sensed value for the sleep factor. The system further includes identify a pressure value by matching the sensed value to an associated stored value. The system further includes adjusting the pressure of the air mattress based on the identified pressure value.

In one aspect, a system includes means for supporting an air mattress having an adjustable pressure. The system further includes a data processing system configured to: access, for each of a plurality of stored values for a sleep factor, an associated pressure value. The system further includes determine a sensed value for the sleep factor. The system further includes identify a pressure value by matching the sensed value to an associated stored value. The system further includes adjusting the pressure of the air mattress based on the identified pressure value. a system includes means for supporting an air mattress having an adjustable pressure. The system further includes a data processing system configured to: access, for each of a plurality of stored values for a sleep factor, an associated pressure value. The system further includes determine a sensed value for the sleep factor. The system further includes identify a pressure value by matching the sensed value to an associated stored value. The system further includes adjusting the pressure of the air mattress based on the identified pressure value.

BRIEF DESCRIPTION OF DRAWINGS

Some embodiments are illustrated by way of example and not limitation in the figures of the accompanying drawings in which.

DETAILED DESCRIPTION

Figure 1:
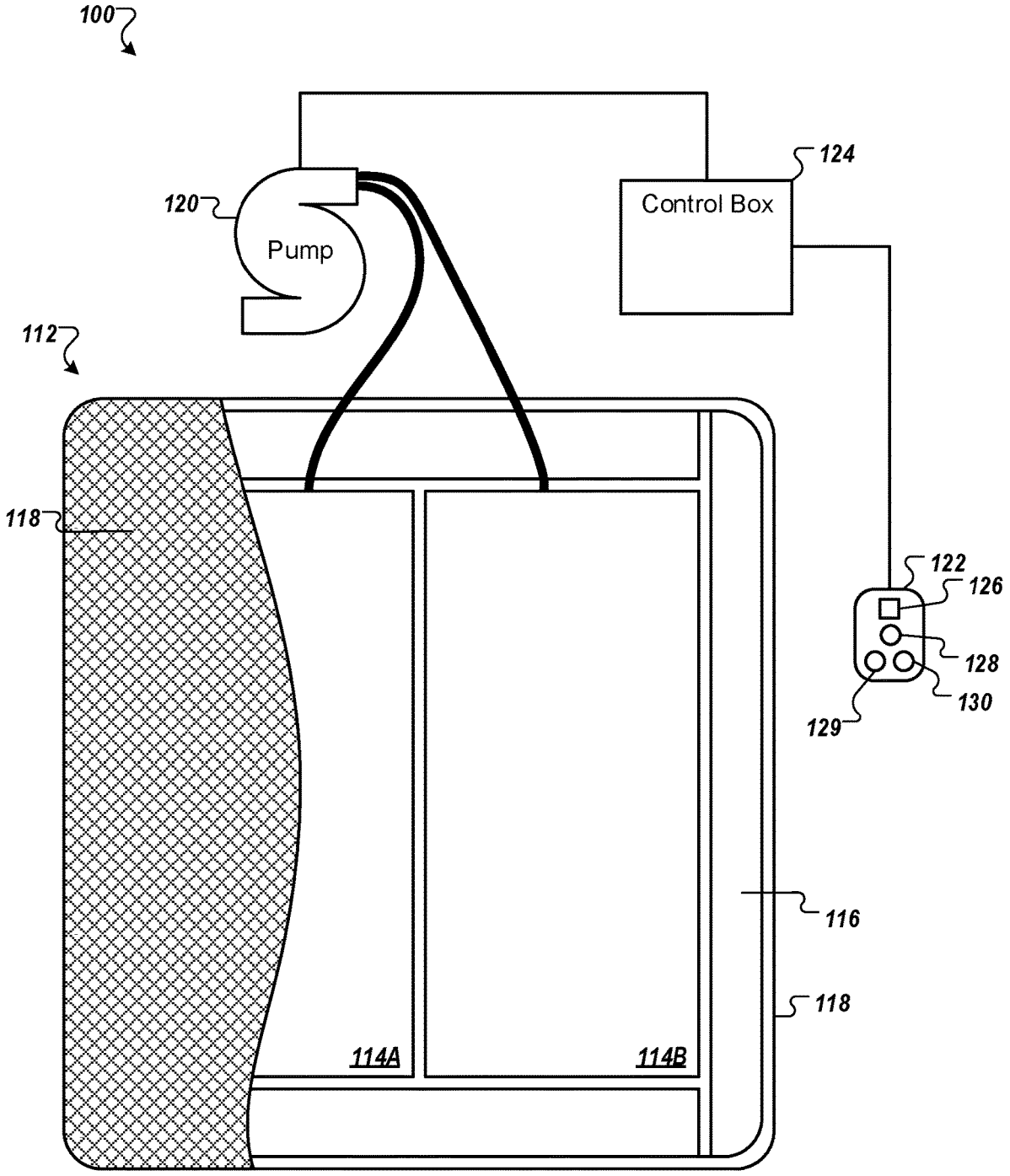
FIG. 1 is a diagrammatic representation of an air bed system, according to an example.

FIG. 1 shows an example air bed system 100 that includes a bed 112. The bed 112 includes at least one air chamber 114 surrounded by a resilient border 116 and encapsulated by bed ticking 118. The resilient border 116 can comprise any suitable material, such as foam.

As illustrated in FIG. 1, the bed 112 can be a two chamber design having first and second fluid chambers, such as a first air chamber 114A and a second air chamber 114B. In alternative embodiments, the bed 112 can include chambers for use with fluids other than air that are suitable for the application. In some embodiments, such as single beds or kids' beds, the bed 112 can include a single air chamber 114A or 114B or multiple air chambers 114A and 114B. First and second air chambers 114A and 114B can be in fluid communication with a pump 120. The pump 120 can be in electrical communication with a remote control 122 via control box 124. The control box 124 can include a wired or wireless communications interface for communicating with one or more devices, including the remote control 122. The control box 124 can be configured to operate the pump 120 to cause increases and decreases in the fluid pressure of the first and second air chambers 114A and 114B based upon commands input by a user using the remote control 122. In some implementations, the control box 124 is integrated into a housing of the pump 120.

The remote control 122 can include a display 126, an output selecting mechanism 128, a pressure increase button 129, and a pressure decrease button 130. The output selecting mechanism 128 can allow the user to switch air flow generated by the pump 120 between the first and second air chambers 114A and 114B, thus enabling control of multiple air chambers with a single remote control 122 and a single pump 120. For example, the output selecting mechanism 128 can by a physical control (e.g., switch or button) or an input control displayed on display 126. Alternatively, separate remote control units can be provided for each air chamber and can each include the ability to control multiple air chambers. Pressure increase and decrease buttons 129 and 130 can allow a user to increase or decrease the pressure, respectively, in the air chamber selected with the output selecting mechanism 128. Adjusting the pressure within the selected air chamber can cause a corresponding adjustment to the firmness of the respective air chamber. In some embodiments, the remote control 122 can be omitted or modified as appropriate for an application. For example, in some embodiments the bed 112 can be controlled by a computer, tablet, smart phone, or other device in wired or wireless communication with the bed 112.

Figure 2:
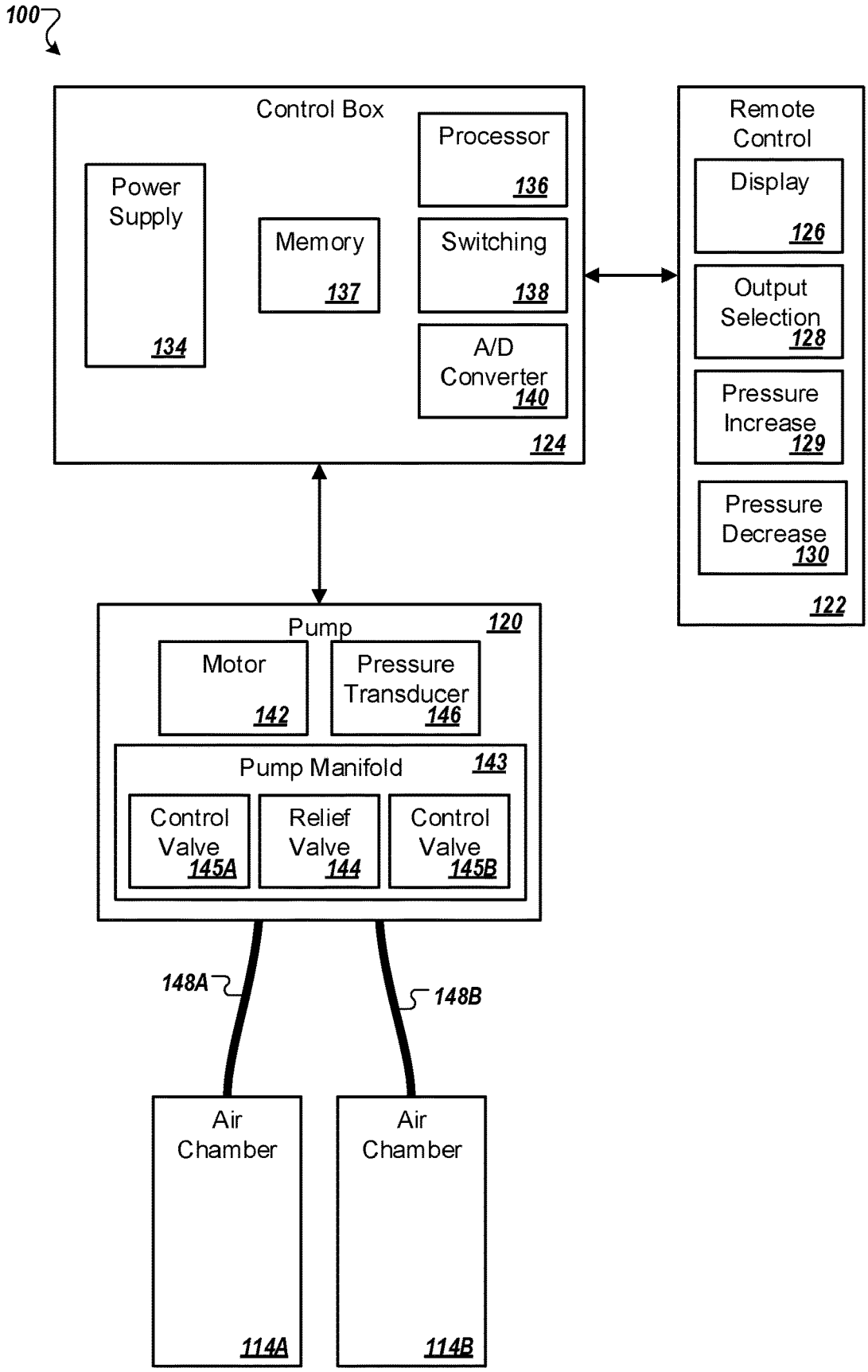
FIG. 2 is a block diagram of various components of the air bed system of FIG. 1, according to an example.

FIG. 2 is a block diagram of an example of various components of an air bed system. For example, these components can be used in the example air bed system 100. As shown in FIG. 2, the control box 124 can include a power supply 134, a processor 136, a memory 137, a switching mechanism 138, and an analog to digital (A/D) converter 140. The switching mechanism 138 can be, for example, a relay or a solid state switch. In some implementations, the switching mechanism 138 can be located in the pump 120 rather than the control box 124.

The pump 120 and the remote control 122 are in two-way communication with the control box 124. The pump 120 includes a motor 142, a pump manifold 143, a relief valve 144, a first control valve 145A, a second control valve 145B, and a pressure transducer 146. The pump 120 is fluidly connected with the first air chamber 114A and the second air chamber 114B via a first tube 148A and a second tube 148B, respectively. The first and second control valves 145A and 145B can be controlled by switching mechanism 138, and are operable to regulate the flow of fluid between the pump 120 and first and second air chambers 114A and 114B, respectively.

In some implementations, the pump 120 and the control box 124 can be provided and packaged as a single unit. In some alternative implementations, the pump 120 and the control box 124 can be provided as physically separate units. In some implementations, the control box 124, the pump 120, or both are integrated within or otherwise contained within a bed frame or bed support structure that supports the bed 112. In some implementations, the control box 124, the pump 120, or both are located outside of a bed frame or bed support structure (as shown in the example in FIG. 1).

The example air bed system 100 depicted in FIG. 2 includes the two air chambers 114A and 114B and the single pump 120. However, other implementations can include an air bed system having two or more air chambers and one or more pumps incorporated into the air bed system to control the air chambers. For example, a separate pump can be associated with each air chamber of the air bed system or a pump can be associated with multiple chambers of the air bed system. Separate pumps can allow each air chamber to be inflated or deflated independently and simultaneously. Furthermore, additional pressure transducers can also be incorporated into the air bed system such that, for example, a separate pressure transducer can be associated with each air chamber.

In use, the processor 136 can, for example, send a decrease pressure command to one of air chambers 114A or 114B, and the switching mechanism 138 can be used to convert the low voltage command signals sent by the processor 136 to higher operating voltages sufficient to operate the relief valve 144 of the pump 120 and open the control valve 145A or 145B. Opening the relief valve 144 can allow air to escape from the air chamber 114A or 114B through the respective air tube 148A or 148B. During deflation, the pressure transducer 146 can send pressure readings to the processor 136 via the A/D converter 140. The A/D converter 140 can receive analog information from pressure transducer 146 and can convert the analog information to digital information useable by the processor 136. The processor 136 can send the digital signal to the remote control 122 to update the display 126 in order to convey the pressure information to the user.

As another example, the processor 136 can send an increase pressure command. The pump motor 142 can be energized in response to the increase pressure command and send air to the designated one of the air chambers 114A or 114B through the air tube 148A or 148B via electronically operating the corresponding valve 145A or 145B. While air is being delivered to the designated air chamber 114A or 114B in order to increase the firmness of the chamber, the pressure transducer 146 can sense pressure within the pump manifold 143. Again, the pressure transducer 146 can send pressure readings to the processor 136 via the A/D converter 140. The processor 136 can use the information received from the A/D converter 140 to determine the difference between the actual pressure in air chamber 114A or 114B and the desired pressure. The processor 136 can send the digital signal to the remote control 122 to update display 126 in order to convey the pressure information to the user.

Generally speaking, during an inflation or deflation process, the pressure sensed within the pump manifold 143 can provide an approximation of the pressure within the respective air chamber that is in fluid communication with the pump manifold 143. An example method of obtaining a pump manifold pressure reading that is substantially equivalent to the actual pressure within an air chamber includes turning off pump 120, allowing the pressure within the air chamber 114A or 114B and the pump manifold 143 to equalize, and then sensing the pressure within the pump manifold 143 with the pressure transducer 146. Thus, providing a sufficient amount of time to allow the pressures within the pump manifold 143 and chamber 114A or 114B to equalize can result in pressure readings that are accurate approximations of the actual pressure within air chamber 114A or 114B. In some implementations, the pressure of the air chambers 114A and/or 114B can be continuously monitored using multiple pressure sensors (not shown).

In some implementations, information collected by the pressure transducer 146 can be analyzed to determine various states of a person lying on the bed 112. For example, the processor 136 can use information collected by the pressure transducer 146 to determine a heart rate or a respiration rate for a person lying in the bed 112. For example, a user can be lying on a side of the bed 112 that includes the chamber 114A. The pressure transducer 146 can monitor fluctuations in pressure of the chamber 114A and this information can be used to determine the user's heart rate and/or respiration rate. As another example, additional processing can be performed using the collected data to determine a sleep state of the person (e.g., awake, light sleep, deep sleep). For example, the processor 136 can determine when a person falls asleep and, while asleep, the various sleep states of the person.

Additional information associated with a user of the air bed system 100 that can be determined using information collected by the pressure transducer 146 includes motion of the user, presence of the user on a surface of the bed 112, weight of the user, heart arrhythmia of the user, and apnea. Taking user presence detection for example, the pressure transducer 146 can be used to detect the user's presence on the bed 112, e.g., via a gross pressure change determination and/or via one or more of a respiration rate signal, heart rate signal, and/or other biometric signals. For example, a simple pressure detection process can identify an increase in pressure as an indication that the user is present on the bed 112. As another example, the processor 136 can determine that the user is present on the bed 112 if the detected pressure increases above a specified threshold (so as to indicate that a person or other object above a certain weight is positioned on the bed 112). As yet another example, the processor 136 can identify an increase in pressure in combination with detected slight, rhythmic fluctuations in pressure as corresponding to the user being present on the bed 112. The presence of rhythmic fluctuations can be identified as being caused by respiration or heart rhythm (or both) of the user. The detection of respiration or a heartbeat can distinguish between the user being present on the bed and another object (e.g., a suit case) being placed upon the bed.

In some implementations, fluctuations in pressure can be measured at the pump 120. For example, one or more pressure sensors can be located within one or more internal cavities of the pump 120 to detect fluctuations in pressure within the pump 120. The fluctuations in pressure detected at the pump 120 can indicate fluctuations in pressure in one or both of the chambers 114A and 114B. One or more sensors located at the pump 120 can be in fluid communication with the one or both of the chambers 114A and 114B, and the sensors can be operative to determine pressure within the chambers 114A and 114B. The control box 124 can be configured to determine at least one vital sign (e.g., heart rate, respiratory rate) based on the pressure within the chamber 114A or the chamber 114B.

In some implementations, the control box 124 can analyze a pressure signal detected by one or more pressure sensors to determine a heart rate, respiration rate, and/or other vital signs of a user lying or sitting on the chamber 114A or the chamber 114B. More specifically, when a user lies on the bed 112 positioned over the chamber 114A, each of the user's heart beats, breaths, and other movements can create a force on the bed 112 that is transmitted to the chamber 114A. As a result of the force input to the chamber 114A from the user's movement, a wave can propagate through the chamber 114A and into the pump 120. A pressure sensor located at the pump 120 can detect the wave, and thus the pressure signal output by the sensor can indicate a heart rate, respiratory rate, or other information regarding the user.

With regard to sleep state, air bed system 100 can determine a user's sleep state by using various biometric signals such as heart rate, respiration, and/or movement of the user. While the user is sleeping, the processor 136 can receive one or more of the user's biometric signals (e.g., heart rate, respiration, and motion) and determine the user's present sleep state based on the received biometric signals. In some implementations, signals indicating fluctuations in pressure in one or both of the chambers 114A and 114B can be amplified and/or filtered to allow for more precise detection of heart rate and respiratory rate.

The control box 124 can perform a pattern recognition algorithm or other calculation based on the amplified and filtered pressure signal to determine the user's heart rate and respiratory rate. For example, the algorithm or calculation can be based on assumptions that a heart rate portion of the signal has a frequency in the range of 0.5-4.0 Hz and that a respiration rate portion of the signal a has a frequency in the range of less than 1 Hz. The control box 124 can also be configured to determine other characteristics of a user based on the received pressure signal, such as blood pressure, tossing and turning movements, rolling movements, limb movements, weight, the presence or lack of presence of a user, and/or the identity of the user. Techniques for monitoring a user's sleep using heart rate information, respiration rate information, and other user information are disclosed in U.S. Patent Application Publication No. 20100170043 to Steven J. Young et al., titled "APPARATUS FOR MONI- TORING VITAL SIGNS," the entire contents of which is incorporated herein by reference.

For example, the pressure transducer 146 can be used to monitor the air pressure in the chambers 114A and 114B of the bed 112. If the user on the bed 112 is not moving, the air pressure changes in the air chamber 114A or 114B can be relatively minimal, and can be attributable to respiration and/or heartbeat. When the user on the bed 112 is moving, however, the air pressure in the mattress can fluctuate by a much larger amount. Thus, the pressure signals generated by the pressure transducer 146 and received by the processor 136 can be filtered and indicated as corresponding to motion, heartbeat, or respiration.

In some implementations, rather than performing the data analysis in the control box 124 with the processor 136, a digital signal processor (DSP) can be provided to analyze the data collected by the pressure transducer 146. Alternatively, the data collected by the pressure transducer 146 could be sent to a cloud-based computing system for remote analysis.

In some implementations, the example air bed system 100 further includes a temperature controller configured to increase, decrease, or maintain the temperature of a bed, for example for the comfort of the user. For example, a pad can be placed on top of or be part of the bed 112, or can be placed on top of or be part of one or both of the chambers 114A and 114B. Air can be pushed through the pad and vented to cool off a user of the bed. Conversely, the pad can include a heating element that can be used to keep the user warm. In some implementations, the temperature controller can receive temperature readings from the pad. In some implementations, separate pads are used for the different sides of the bed 112 (e.g., corresponding to the locations of the chambers 114A and 114B) to provide for differing temperature control for the different sides of the bed.

In some implementations, the user of the air bed system 100 can use an input device, such as the remote control 122, to input a desired temperature for the surface of the bed 112 (or for a portion of the surface of the bed 112). The desired temperature can be encapsulated in a command data structure that includes the desired temperature as well as identifies the temperature controller as the desired component to be controlled. The command data structure can then be transmitted via Bluetooth or another suitable communication protocol to the processor 136. In various examples, the command data structure is encrypted before being transmitted. The temperature controller can then configure its elements to increase or decrease the temperature of the pad depending on the temperature input into remote control 122 by the user.

In some implementations, data can be transmitted from a component back to the processor 136 or to one or more display devices, such as the display 126. For example, the current temperature as determined by a sensor element of temperature controller, the pressure of the bed, the current position of the foundation or other information can be transmitted to control box 124. The control box 124 can then transmit the received information to remote control 122 where it can be displayed to the user (e.g., on the display 126).

Figure 3:
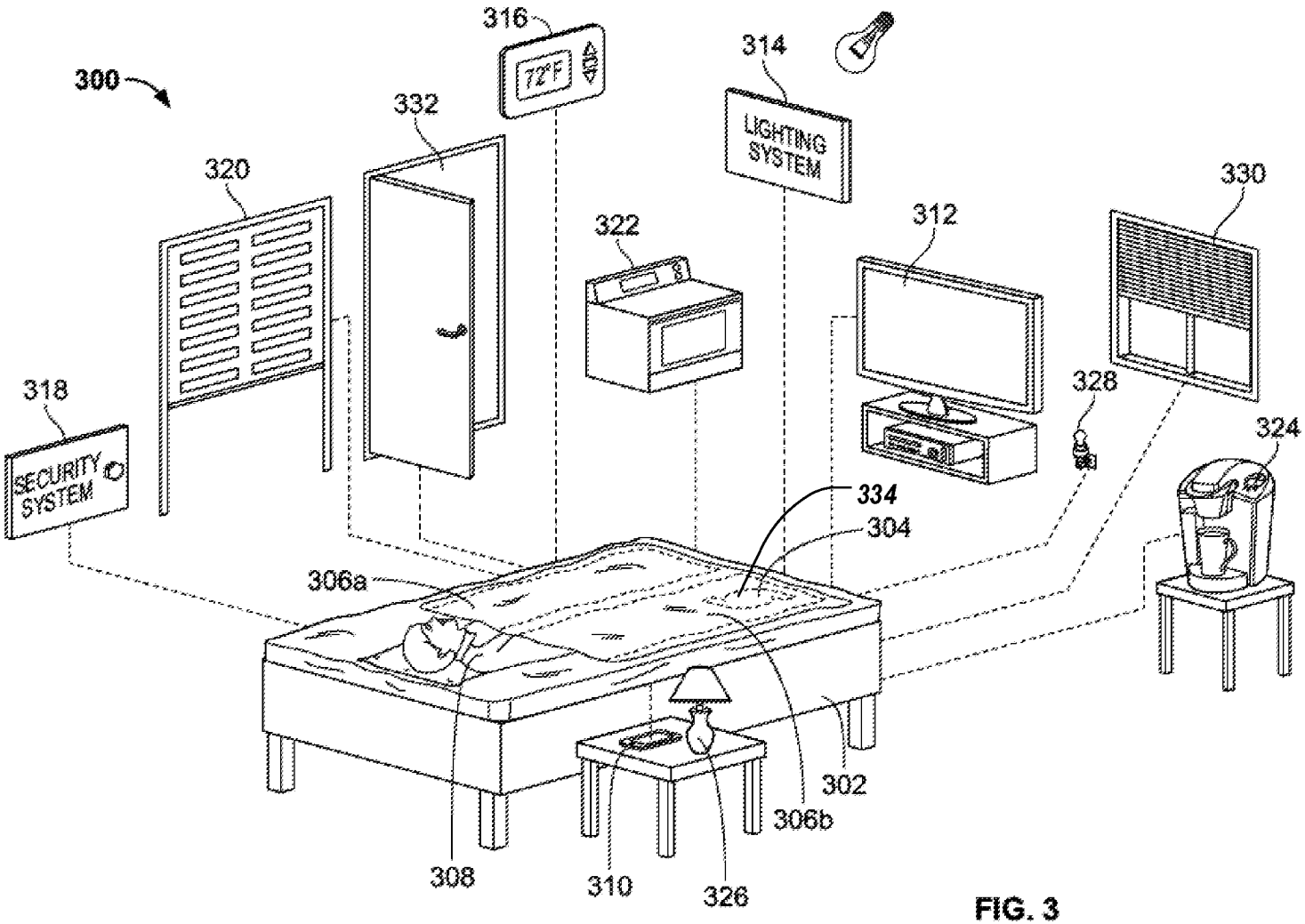
FIG. 3 shows an example environment including a bed in communication with devices located in and around a home.

In some implementations, the example air bed system 100 further includes an adjustable foundation and an articulation controller configured to adjust the position of a bed (e.g., the bed 112) by adjusting the adjustable foundation that supports the bed. For example, the articulation controller can adjust the bed 112 from a flat position to a position in which a head portion of a mattress of the bed is inclined upward (e.g., to facilitate a user sitting up in bed and/or watching television). In some implementations, the bed 112 includes multiple separately articulable sections. For example, portions of the bed corresponding to the locations of the chambers 114A and 114B can be articulated independently from each other, to allow one person positioned on the bed 112 surface to rest in a first position (e.g., a flat position) while a second person rests in a second position (e.g., an reclining position with the head raised at an angle from the waist). In some implementations, separate positions can be set for two different beds (e.g., two twin beds placed next to each other). The foundation of the bed 112 can include more than one zone that can be independently adjusted. The articulation controller can also be configured to provide different levels of massage to one or more users on the bed 112. FIG. 3 shows an example environment 300 including a bed 302 in communication with devices located in and around a home. In the example shown, the bed 302 includes pump 304 for controlling air pressure within two air chambers 306*a* and 306*b* (as described above with respect to the air chambers 114A-114B). The pump 304 additionally includes circuitry for controlling inflation and deflation functionality performed by the pump 304. The circuitry is further programmed to detect fluctuations in air pressure of the air chambers 306*a-b* and used the detected fluctuations in air pressure to identify bed presence of a user 308, sleep state of the user 308, movement of the user 308, and biometric signals of the user 308 such as heart rate and respiration rate. In the example shown, the pump 304 is located within a support structure of the bed 302 and the control circuitry 334 for controlling the pump 304 is integrated with the pump 304. In some implementations, the control circuitry 334 is physically separate from the pump 304 and is in wireless or wired communication with the pump 304. In some implementations, the pump 304 and/or control circuitry 334 are located outside of the bed 302. In some implementations, various control functions can be performed by systems located in different physical locations. For example, circuitry for controlling actions of the pump 304 can be located within a pump casing of the pump 304 while control circuitry 334 for performing other functions associated with the bed 302 can be located in another portion of the bed 302, or external to the bed 302. As another example, control circuitry 334 located within the pump 304 can communicate with control circuitry 334 at a remote location through a LAN or WAN (e.g., the internet). As yet another example, the control circuitry 334 can be included in the control box 124 of FIGS. 1 and 2.

In some implementations, one or more devices other than, or in addition to, the pump 304 and control circuitry 334 can be utilized to identify user bed presence, sleep state, movement, and biometric signals. For example, the bed 302 can include a second pump in addition to the pump 304, with each of the two pumps connected to a respective one of the air chambers 306*a-b*. For example, the pump 304 can be in fluid communication with the air chamber 306*b* to control inflation and deflation of the air chamber 306*b* as well as detect user signals for a user located over the air chamber 306*b* such as bed presence, sleep state, movement, and biometric signals while the second pump is in fluid communication with the air chamber 306*a* to control inflation and deflation of the air chamber 306*a* as well as detect user signals for a user located over the air chamber 306*a*.

As another example, the bed 302 can include one or more pressure sensitive pads or surface portions that are operable to detect movement, including user presence, user motion, respiration, and heart rate. For example, a first pressure sensitive pad can be incorporated into a surface of the bed 302 over a left portion of the bed 302, where a first user would normally be located during sleep, and a second pressure sensitive pad can be incorporated into the surface of the bed 302 over a right portion of the bed 302, where a second user would normally be located during sleep. The movement detected by the one or more pressure sensitive pads or surface portions can be used by control circuitry 334 to identify user sleep state, bed presence, or biometric signals.

In some implementations, information detected by the bed (e.g., motion information) is processed by control circuitry 334 (e.g., control circuitry 334 integrated with the pump 304) and provided to one or more user devices such as a user device 310 for presentation to the user 308 or to other users. In the example depicted in FIG. 3, the user device 310 is a tablet device; however, in some implementations, the user device 310 can be a personal computer, a smart phone, a smart television (e.g., a television 312), or other user device capable of wired or wireless communication with the control circuitry 334. The user device 310 can be in communication with control circuitry 334 of the bed 302 through a network or through direct point-to-point communication. For example, the control circuitry 334 can be connected to a LAN (e.g., through a Wi-Fi router) and communicate with the user device 310 through the LAN. As another example, the control circuitry 334 and the user device 310 can both connect to the Internet and communicate through the Internet. For example, the control circuitry 334 can connect to the Internet through a WiFi router and the user device 310 can connect to the Internet through communication with a cellular communication system. As another example, the control circuitry 334 can communicate directly with the user device 310 through a wireless communication protocol such as Bluetooth. As yet another example, the control circuitry 334 can communicate with the user device 310 through a wireless communication protocol such as ZigBee, Z-Wave, infrared, or another wireless communication protocol suitable for the application. As another example, the control circuitry 334 can communicate with the user device 310 through a wired connection such as, for example, a USB connector, serial/RS232 or another wired connection suitable for the application.

The user device 310 can display a variety of information and statistics related to sleep, or user 308's interaction with the bed 302. For example, a user interface displayed by the user device 310 can present information including amount of sleep for the user 308 over a period of time (e.g., a single evening, a week, a month, etc.) amount of deep sleep, ratio of deep sleep to restless sleep, time lapse between the user 308 getting into bed and the user 308 falling asleep, total amount of time spent in the bed 302 for a given period of time, heart rate for the user 308 over a period of time, respiration rate for the user 308 over a period of time, or other information related to user interaction with the bed 302 by the user 308 or one or more other users of the bed 302. In some implementations, information for multiple users can be presented on the user device 310, for example information for a first user positioned over the air chamber 306*a* can be presented along with information for a second user positioned over the air chamber 306*b*. In some implementations, the information presented on the user device 310 can vary according to the age of the user 308. For example, the information presented on the user device 310 can evolve with the age of the user 308 such that different information is presented on the user device 310 as the user 308 ages as a child or an adult.

The user device 310 can also be used as an interface for the control circuitry 334 of the bed 302 to allow the user 308 to enter information. The information entered by the user 308 can be used by the control circuitry 334 to provide better information to the user or to various control signals for controlling functions of the bed 302 or other devices. For example, the user can enter information such as weight, height, and age and the control circuitry 334 can use this information to provide the user 308 with a comparison of the user's tracked sleep information to sleep information of other people having similar weights, heights, and/or ages as the user 308. As another example, the user 308 can use the user device 310 as an interface for controlling air pressure of the air chambers 306*a* and 306*b*, for controlling various recline or incline positions of the bed 302, for controlling temperature of one or more surface temperature control devices of the bed 302, or for allowing the control circuitry 334 to generate control signals for other devices (as described in greater detail below).

In some implementations, control circuitry 334 of the bed 302 (e.g., control circuitry 334 integrated into the pump 304) can communicate with other devices or systems in addition to or instead of the user device 310. For example, the control circuitry 334 can communicate with the television 312, a lighting system 314, a thermostat 316, a security system 318, or other house hold devices such as an oven 322, a coffee maker 324, a lamp 326, and a nightlight 328. Other examples of devices and/or systems that the control circuitry 334 can communicate with include a system for controlling window blinds 330, one or more devices for detecting or controlling the states of one or more doors 332 (such as detecting if a door is open, detecting if a door is locked, or automatically locking a door), and a system for controlling a garage door 320 (e.g., control circuitry 334 integrated with a garage door opener for identifying an open or closed state of the garage door 320 and for causing the garage door opener to open or close the garage door 320). Communications between the control circuitry 334 of the bed 302 and other devices can occur through a network (e.g., a LAN or the Internet) or as point-to-point communication (e.g., using Bluetooth, radio communication, or a wired connection). In some implementations, control circuitry 334 of different beds 302 can communicate with different sets of devices. For example, a kid bed may not communicate with and/or control the same devices as an adult bed. In some embodiments, the bed 302 can evolve with the age of the user such that the control circuitry 334 of the bed 302 communicates with different devices as a function of age of the user.

The control circuitry 334 can receive information and inputs from other devices/systems and use the received information and inputs to control actions of the bed 302 or other devices. For example, the control circuitry 334 can receive information from the thermostat 316 indicating a current environmental temperature for a house or room in which the bed 302 is located. The control circuitry 334 can use the received information (along with other information) to determine if a temperature of all or a portion of the surface of the bed 302 should be raised or lowered. The control circuitry 334 can then cause a heating or cooling mechanism of the bed 302 to raise or lower the temperature of the surface of the bed 302. For example, the user 308 can indicate a desired sleeping temperature of 74 degrees while a second user of the bed 302 indicates a desired sleeping temperature of 72 degrees. The thermostat 316 can indicate to the control circuitry 334 that the current temperature of the bedroom is 72 degrees. The control circuitry 334 can identify that the user 308 has indicated a desired sleeping temperature of 74 degrees, and send control signals to a heating pad located on the user 308's side of the bed to raise the temperature of the portion of the surface of the bed 302 where the user 308 is located to raise the temperature of the user 308's sleeping surface to the desired temperature.

The control circuitry 334 can also generate control signals controlling other devices and propagate the control signals to the other devices. In some implementations, the control signals are generated based on information collected by the control circuitry 334, including information related to user interaction with the bed 302 by the user 308 and/or one or more other users. In some implementations, information collected from one or more other devices other than the bed 302 are used when generating the control signals. For example, information relating to environmental occurrences (e.g., environmental temperature, environmental noise level, and environmental light level), time of day, time of year, day of the week, or other information can be used when generating control signals for various devices in communication with the control circuitry 334 of the bed 302. For example, information on the time of day can be combined with information relating to movement and bed presence of the user 308 to generate control signals for the lighting system 314. In some implementations, rather than or in addition to providing control signals for one or more other devices, the control circuitry 334 can provide collected information (e.g., information related to user movement, bed presence, sleep state, or biometric signals for the user 308) to one or more other devices to allow the one or more other devices to utilize the collected information when generating control signals. For example, control circuitry 334 of the bed 302 can provide information relating to user interactions with the bed 302 by the user 308 to a central controller (not shown) that can use the provided information to generate control signals for various devices, including the bed 302.

Still referring to FIG. 3, the control circuitry 334 of the bed 302 can generate control signals for controlling actions of other devices, and transmit the control signals to the other devices in response to information collected by the control circuitry 334, including bed presence of the user 308, sleep state of the user 308, and other factors. For example, control circuitry 334 integrated with the pump 304 can detect a feature of a mattress of the bed 302, such as an increase in pressure in the air chamber 306*b*, and use this detected increase in air pressure to determine that the user 308 is present on the bed 302. In some implementations, the control circuitry 334 can identify a heart rate or respiratory rate for the user 308 to identify that the increase in pressure is due to a person sitting, laying, or otherwise resting on the bed 302 rather than an inanimate object (such as a suitcase) having been placed on the bed 302. In some implementations, the information indicating user bed presence is combined with other information to identify a current or future likely state for the user 308. For example, a detected user bed presence at 11:00 am can indicate that the user is sitting on the bed (e.g., to tie her shoes, or to read a book) and does not intend to go to sleep, while a detected user bed presence at 10:00 pm can indicate that the user 308 is in bed for the evening and is intending to fall asleep soon. As another example, if the control circuitry 334 detects that the user 308 has left the bed 302 at 6:30 am (e.g., indicating that the user 308 has woken up for the day), and then later detects user bed presence of the user 308 at 7:30 am, the control circuitry 334 can use this information that the newly detected user bed presence is likely temporary (e.g., while the user 308 ties her shoes before heading to work) rather than an indication that the user 308 is intending to stay on the bed 302 for an extended period.

In some implementations, the control circuitry 334 is able to use collected information (including information related to user interaction with the bed 302 by the user 308, as well as environmental information, time information, and input received from the user) to identify use patterns for the user 308. For example, the control circuitry 334 can use information indicating bed presence and sleep states for the user 308 collected over a period of time to identify a sleep pattern for the user. For example, the control circuitry 334 can identify that the user 308 generally goes to bed between 9:30 pm and 10:00 pm, generally falls asleep between 10:00 pm and 11:00 pm, and generally wakes up between 6:30 am and 6:45 am based on information indicating user presence and biometrics for the user 308 collected over a week. The control circuitry 334 can use identified patterns for a user to better process and identify user interactions with the bed 302 by the user 308.

For example, given the above example user bed presence, sleep, and wake patterns for the user 308, if the user 308 is detected as being on the bed at 3:00 pm, the control circuitry 334 can determine that the user's presence on the bed is only temporary, and use this determination to generate different control signals than would be generated if the control circuitry 334 determined that the user 308 was in bed for the evening. As another example, if the control circuitry 334 detects that the user 308 has gotten out of bed at 3:00 am, the control circuitry 334 can use identified patterns for the user 308 to determine that the user has only gotten up temporarily (for example, to use the rest room, or get a glass of water) and is not up for the day. By contrast, if the control circuitry 334 identifies that the user 308 has gotten out of the bed 302 at 6:40 am, the control circuitry 334 can determine that the user is up for the day and generate a different set of control signals than those that would be generated if it were determined that the user 308 were only getting out of bed temporarily (as would be the case when the user 308 gets out of the bed 302 at 3:00 am). For other users 308, getting out of the bed 302 at 3:00 am can be the normal wake-up time, which the control circuitry 334 can learn and respond to accordingly.

As described above, the control circuitry 334 for the bed 302 can generate control signals for control functions of various other devices. The control signals can be generated, at least in part, based on detected interactions by the user 308 with the bed 302, as well as other information including time, date, temperature, etc. For example, the control circuitry 334 can communicate with the television 312, receive information from the television 312, and generate control signals for controlling functions of the television 312. For example, the control circuitry 334 can receive an indication from the television 312 that the television 312 is currently on. If the television 312 is located in a different room from the bed 302, the control circuitry 334 can generate a control signal to turn the television 312 off upon making a determination that the user 308 has gone to bed for the evening. For example, if bed presence of the user 308 on the bed 302 is detected during a particular time range (e.g., between 8:00 pm and 7:00 am) and persists for longer than a threshold period of time (e.g., 10 minutes) the control circuitry 334 can use this information to determine that the user 308 is in bed for the evening. If the television 312 is on (as indicated by communications received by the control circuitry 334 of the bed 302 from the television 312) the control circuitry 334 can generate a control signal to turn the television 312 off.

The control signals can then be transmitted to the television (e.g., through a directed communication link between the television 312 and the control circuitry 334 or through a network). As another example, rather than turning off the television 312 in response to detection of user bed presence, the control circuitry 334 can generate a control signal that causes the volume of the television 312 to be lowered by a pre-specified amount.

As another example, upon detecting that the user 308 has left the bed 302 during a specified time range (e.g., between 6:00 am and 8:00 am) the control circuitry 334 can generate control signals to cause the television 312 to turn on and tune to a pre-specified channel (e.g., the user 308 has indicated a preference for watching the morning news upon getting out of bed in the morning). The control circuitry 334 can generate the control signal and transmit the signal to the television 312 to cause the television 312 to turn on and tune to the desired station (which could be stored at the control circuitry 334, the television 312, or another location). As another example, upon detecting that the user 308 has gotten up for the day, the control circuitry 334 can generate and transmit control signals to cause the television 312 to turn on and begin playing a previously recorded program from a digital video recorder (DVR) in communication with the television 312.

As another example, if the television 312 is in the same room as the bed 302, the control circuitry 334 does not cause the television 312 to turn off in response to detection of user bed presence. Rather, the control circuitry 334 can generate and transmit control signals to cause the television 312 to turn off in response to determining that the user 308 is asleep. For example, the control circuitry 334 can monitor biometric signals of the user 308 (e.g., motion, heart rate, respiration rate) to determine that the user 308 has fallen asleep. Upon detecting that the user 308 is sleeping, the control circuitry 334 generates and transmits a control signal to turn the television 312 off. As another example, the control circuitry 334 can generate the control signal to turn off the television 312 after a threshold period of time after the user 308 has fallen asleep (e.g., 10 minutes after the user has fallen asleep). As another example, the control circuitry 334 generates control signals to lower the volume of the television 312 after determining that the user 308 is asleep. As yet another example, the control circuitry 334 generates and transmits a control signal to cause the television to gradually lower in volume over a period of time and then turn off in response to determining that the user 308 is asleep.

In some implementations, the control circuitry 334 can similarly interact with other media devices, such as computers, tablets, smart phones, stereo systems, etc. For example, upon detecting that the user 308 is asleep, the control circuitry 334 can generate and transmit a control signal to the user device 310 to cause the user device 310 to turn off, or turn down the volume on a video or audio file being played by the user device 310.

The control circuitry 334 can additionally communicate with the lighting system 314, receive information from the lighting system 314, and generate control signals for controlling functions of the lighting system 314. For example, upon detecting user bed presence on the bed 302 during a certain time frame (e.g., between 8:00 pm and 7:00 am) that lasts for longer than a threshold period of time (e.g., 10 minutes) the control circuitry 334 of the bed 302 can determine that the user 308 is in bed for the evening. In response to this determination, the control circuitry 334 can generate control signals to cause lights in one or more rooms other than the room in which the bed 302 is located to switch off. The control signals can then be transmitted to the lighting system 314 and executed by the lighting system 314 to cause the lights in the indicated rooms to shut off. For example, the control circuitry 334 can generate and transmit control signals to turn off lights in all common rooms, but not in other bedrooms. As another example, the control signals generated by the control circuitry 334 can indicate that lights in all rooms other than the room in which the bed 302 is located are to be turned off, while one or more lights located outside of the house containing the bed 302 are to be turned on, in response to determining that the user 308 is in bed for the evening. Additionally, the control circuitry 334 can generate and transmit control signals to cause the nightlight 328 to turn on in response to determining user 308 bed presence or whether the user 308 is asleep. As another example, the control circuitry 334 can generate first control signals for turning off a first set of lights (e.g., lights in common rooms) in response to detecting user bed presence, and second control signals for turning off a second set of lights (e.g., lights in the room in which the bed 302 is located) in response to detecting that the user 308 is asleep.

In some implementations, in response to determining that the user 308 is in bed for the evening, the control circuitry 334 of the bed 302 can generate control signals to cause the lighting system 314 to implement a sunset lighting scheme in the room in which the bed 302 is located. A sunset lighting scheme can include, for example, dimming the lights (either gradually over time, or all at once) in combination with changing the color of the light in the bedroom environment, such as adding an amber hue to the lighting in the bedroom. The sunset lighting scheme can help to put the user 308 to sleep when the control circuitry 334 has determined that the user 308 is in bed for the evening.

The control circuitry 334 can also be configured to implement a sunrise lighting scheme when the user 308 wakes up in the morning. The control circuitry 334 can determine that the user 308 is awake for the day, for example, by detecting that the user 308 has gotten off of the bed 302 (i.e., is no longer present on the bed 302) during a specified time frame (e.g., between 6:00 am and 8:00 am). As another example, the control circuitry 334 can monitor movement, heart rate, respiratory rate, or other biometric signals of the user 308 to determine that the user 308 is awake even though the user 308 has not gotten out of bed. If the control circuitry 334 detects that the user is awake during a specified time frame, the control circuitry 334 can determine that the user 308 is awake for the day. The specified time frame can be, for example, based on previously recorded user bed presence information collected over a period of time (e.g., two weeks) that indicates that the user 308 usually wakes up for the day between 6:30 am and 7:30 am. In response to the control circuitry 334 determining that the user 308 is awake, the control circuitry 334 can generate control signals to cause the lighting system 314 to implement the sunrise lighting scheme in the bedroom in which the bed 302 is located. The sunrise lighting scheme can include, for example, turning on lights (e.g., the lamp 326, or other lights in the bedroom). The sunrise lighting scheme can further include gradually increasing the level of light in the room where the bed 302 is located (or in one or more other rooms). The sunrise lighting scheme can also include only turning on lights of specified colors. For example, the sunrise lighting scheme can include lighting the bedroom with blue light to gently assist the user 308 in waking up and becoming active.

In some implementations, the control circuitry 334 can generate different control signals for controlling actions of one or more components, such as the lighting system 314, depending on a time of day that user interactions with the bed 302 are detected. For example, the control circuitry 334 can use historical user interaction information for interactions between the user 308 and the bed 302 to determine that the user 308 usually falls asleep between 10:00 pm and 11:00 pm and usually wakes up between 6:30 am and 7:30 am on weekdays. The control circuitry 334 can use this information to generate a first set of control signals for controlling the lighting system 314 if the user 308 is detected as getting out of bed at 3:00 am and to generate a second set of control signals for controlling the lighting system 314 if the user 308 is detected as getting out of bed after 6:30 am. For example, if the user 308 gets out of bed prior to 6:30 am, the control circuitry 334 can turn on lights that guide the user 308's route to a restroom. As another example, if the user 308 gets out of bed prior to 6:30 am, the control circuitry 334 can turn on lights that guide the user 308's route to the kitchen (which can include, for example, turning on the nightlight 328, turning on under bed lighting, or turning on the lamp 326).

As another example, if the user 308 gets out of bed after 6:30 am, the control circuitry 334 can generate control signals to cause the lighting system 314 to initiate a sunrise lighting scheme, or to turn on one or more lights in the bedroom and/or other rooms. In some implementations, if the user 308 is detected as getting out of bed prior to a specified morning rise time for the user 308, the control circuitry 334 causes the lighting system 314 to turn on lights that are dimmer than lights that are turned on by the lighting system 314 if the user 308 is detected as getting out of bed after the specified morning rise time. Causing the lighting system 314 to only turn on dim lights when the user 308 gets out of bed during the night (i.e., prior to normal rise time for the user 308) can prevent other occupants of the house from being woken by the lights while still allowing the user 308 to see in order to reach the restroom, kitchen, or another destination within the house.

The historical user interaction information for interactions between the user 308 and the bed 302 can be used to identify user sleep and awake time frames. For example, user bed presence times and sleep times can be determined for a set period of time (e.g., two weeks, a month, etc.). The control circuitry 334 can then identify a typical time range or time frame in which the user 308 goes to bed, a typical time frame for when the user 308 falls asleep, and a typical time frame for when the user 308 wakes up (and in some cases, different time frames for when the user 308 wakes up and when the user 308 actually gets out of bed). In some implementations, buffer time can be added to these time frames. For example, if the user is identified as typically going to bed between 10:00 pm and 10:30 pm, a buffer of a half hour in each direction can be added to the time frame such that any detection of the user getting onto the bed between 9:30 pm and 11:00 pm is interpreted as the user 308 going to bed for the evening. As another example, detection of bed presence of the user 308 starting from a half hour before the earliest typical time that the user 308 goes to bed extending until the typical wake up time (e.g., 6:30 am) for the user can be interpreted as the user going to bed for the evening. For example, if the user typically goes to bed between 10:00 pm and 10:30 pm, if the user's bed presence is sensed at 12:30 am one night, that can be interpreted as the user getting into bed for the evening even though this is outside of the user's typical time frame for going to bed because it has occurred prior to the user's normal wake up time. In some implementations, different time frames are identified for different times of the year (e.g., earlier bed time during winter vs. summer) or at different times of the week (e.g., user wakes up earlier on weekdays than on weekends).

The control circuitry 334 can distinguish between the user 308 going to bed for an extended period (such as for the night) as opposed to being present on the bed 302 for a shorter period (such as for a nap) by sensing duration of presence of the user 308. In some examples, the control circuitry 334 can distinguish between the user 308 going to bed for an extended period (such as for the night) as opposed to going to bed for a shorter period (such as for a nap) by sensing duration of sleep of the user 308. For example, the control circuitry 334 can set a time threshold whereby if the user 308 is sensed on the bed 302 for longer than the threshold, the user 308 is considered to have gone to bed for the night. In some examples, the threshold can be about 2 hours, whereby if the user 308 is sensed on the bed 302 for greater than 2 hours, the control circuitry 334 registers that as an extended sleep event. In other examples, the threshold can be greater than or less than two hours.

The control circuitry 334 can detect repeated extended sleep events to determine a typical bed time range of the user 308 automatically, without requiring the user 308 to enter a bed time range. This can allow the control circuitry 334 to accurately estimate when the user 308 is likely to go to bed for an extended sleep event, regardless of whether the user 308 typically goes to bed using a traditional sleep schedule or a non-traditional sleep schedule. The control circuitry 334 can then use knowledge of the bed time range of the user 308 to control one or more components (including components of the bed 302 and/or non-bed peripherals) differently based on sensing bed presence during the bed time range or outside of the bed time range.

In some examples, the control circuitry 334 can automatically determine the bed time range of the user 308 without requiring user inputs. In some examples, the control circuitry 334 can determine the bed time range of the user 308 automatically and in combination with user inputs. In some examples, the control circuitry 334 can set the bed time range directly according to user inputs. In some examples, the control circuitry 334 can associate different bed times with different days of the week. In each of these examples, the control circuitry 334 can control one or more components (such as the lighting system 314, the thermostat 316, the security system 318, the oven 322, the coffee maker 324, the lamp 326, and the nightlight 328), as a function of sensed bed presence and the bed time range.

The control circuitry 334 can additionally communicate with the thermostat 316, receive information from the thermostat 316, and generate control signals for controlling functions of the thermostat 316. For example, the user 308 can indicate user preferences for different temperatures at different times, depending on the sleep state or bed presence of the user 308. For example, the user 308 may prefer an environmental temperature of 72 degrees when out of bed, 70 degrees when in bed but awake, and 68 degrees when sleeping. The control circuitry 334 of the bed 302 can detect bed presence of the user 308 in the evening and determine that the user 308 is in bed for the night. In response to this determination, the control circuitry 334 can generate control signals to cause the thermostat to change the temperature to 70 degrees. The control circuitry 334 can then transmit the control signals to the thermostat 316. Upon detecting that the user 308 is in bed during the bed time range or asleep, the control circuitry 334 can generate and transmit control signals to cause the thermostat 316 to change the temperature to 68. The next morning, upon determining that the user is awake for the day (e.g., the user 308 gets out of bed after 6:30 am) the control circuitry 334 can generate and transmit control circuitry 334 to cause the thermostat to change the temperature to 72 degrees.

In some implementations, the control circuitry 334 can similarly generate control signals to cause one or more heating or cooling elements on the surface of the bed 302 to change temperature at various times, either in response to user interaction with the bed 302 or at various pre-programmed times. For example, the control circuitry 334 can activate a heating element to raise the temperature of one side of the surface of the bed 302 to 73 degrees when it is detected that the user 308 has fallen asleep. As another example, upon determining that the user 308 is up for the day, the control circuitry 334 can turn off a heating or cooling element. As yet another example, the user 308 can pre-program various times at which the temperature at the surface of the bed should be raised or lowered. For example, the user can program the bed 302 to raise the surface temperature to 76 degrees at 10:00 pm, and lower the surface temperature to 68 degrees at 11:30 pm.

In some implementations, in response to detecting user bed presence of the user 308 and/or that the user 308 is asleep, the control circuitry 334 can cause the thermostat 316 to change the temperature in different rooms to different values. For example, in response to determining that the user 308 is in bed for the evening, the control circuitry 334 can generate and transmit control signals to cause the thermostat 316 to set the temperature in one or more bedrooms of the house to 72 degrees and set the temperature in other rooms to 67 degrees.

The control circuitry 334 can also receive temperature information from the thermostat 316 and use this temperature information to control functions of the bed 302 or other devices. For example, as discussed above, the control circuitry 334 can adjust temperatures of heating elements included in the bed 302 in response to temperature information received from the thermostat 316.

In some implementations, the control circuitry 334 can generate and transmit control signals for controlling other temperature control systems. For example, in response to determining that the user 308 is awake for the day, the control circuitry 334 can generate and transmit control signals for causing floor heating elements to activate. For example, the control circuitry 334 can cause a floor heating system for a master bedroom to turn on in response to determining that the user 308 is awake for the day.

The control circuitry 334 can additionally communicate with the security system 318, receive information from the security system 318, and generate control signals for controlling functions of the security system 318. For example, in response to detecting that the user 308 in is bed for the evening, the control circuitry 334 can generate control signals to cause the security system to engage or disengage security functions. The control circuitry 334 can then transmit the control signals to the security system 318 to cause the security system 318 to engage. As another example, the control circuitry 334 can generate and transmit control signals to cause the security system 318 to disable in response to determining that the user 308 is awake for the day (e.g., user 308 is no longer present on the bed 302 after 6:00 am). In some implementations, the control circuitry 334 can generate and transmit a first set of control signals to cause the security system 318 to engage a first set of security features in response to detecting user bed presence of the user 308, and can generate and transmit a second set of control signals to cause the security system 318 to engage a second set of security features in response to detecting that the user 308 has fallen asleep.

In some implementations, the control circuitry 334 can receive alerts from the security system 318 and indicate the alert to the user 308. For example, the control circuitry 334 can detect that the user 308 is in bed for the evening and in response, generate and transmit control signals to cause the security system 318 to engage or disengage. The security system can then detect a security breach (e.g., someone has opened the door 332 without entering the security code, or someone has opened a window when the security system 318 is engaged). The security system 318 can communicate the security breach to the control circuitry 334 of the bed 302. In response to receiving the communication from the security system 318, the control circuitry 334 can generate control signals to alert the user 308 to the security breach. For example, the control circuitry 334 can cause the bed 302 to vibrate. As another example, the control circuitry 334 can cause portions of the bed 302 to articulate (e.g., cause the head section to raise or lower) in order to wake the user 308 and alert the user to the security breach. As another example, the control circuitry 334 can generate and transmit control signals to cause the lamp 326 to flash on and off at regular intervals to alert the user 308 to the security breach. As another example, the control circuitry 334 can alert the user 308 of one bed 302 regarding a security breach in a bedroom of another bed, such as an open window in a kid's bedroom. As another example, the control circuitry 334 can send an alert to a garage door controller (e.g., to close and lock the door). As another example, the control circuitry 334 can send an alert for the security to be disengaged.

The control circuitry 334 can additionally generate and transmit control signals for controlling the garage door 320 and receive information indicating a state of the garage door 320 (i.e., open or closed). For example, in response to determining that the user 308 is in bed for the evening, the control circuitry 334 can generate and transmit a request to a garage door opener or another device capable of sensing if the garage door 320 is open. The control circuitry 334 can request information on the current state of the garage door 320. If the control circuitry 334 receives a response (e.g., from the garage door opener) indicating that the garage door 320 is open, the control circuitry 334 can either notify the user 308 that the garage door is open, or generate a control signal to cause the garage door opener to close the garage door 320. For example, the control circuitry 334 can send a message to the user device 310 indicating that the garage door is open. As another example, the control circuitry 334 can cause the bed 302 to vibrate. As yet another example, the control circuitry 334 can generate and transmit a control signal to cause the lighting system 314 to cause one or more lights in the bedroom to flash to alert the user 308 to check the user device 310 for an alert (in this example, an alert regarding the garage door 320 being open). Alternatively, or additionally, the control circuitry 334 can generate and transmit control signals to cause the garage door opener to close the garage door 320 in response to identifying that the user 308 is in bed for the evening and that the garage door 320 is open. In some implementations, control signals can vary depend on the age of the user 308.

The control circuitry 334 can similarly send and receive communications for controlling or receiving state information associated with the door 332 or the oven 322. For example, upon detecting that the user 308 is in bed for the evening, the control circuitry 334 can generate and transmit a request to a device or system for detecting a state of the door 332. Information returned in response to the request can indicate various states for the door 332 such as open, closed but unlocked, or closed and locked. If the door 332 is open or closed but unlocked, the control circuitry 334 can alert the user 308 to the state of the door, such as in a manner described above with reference to the garage door 320. Alternatively, or in addition to alerting the user 308, the control circuitry 334 can generate and transmit control signals to cause the door 332 to lock, or to close and lock. If the door 332 is closed and locked, the control circuitry 334 can determine that no further action is needed.

Similarly, upon detecting that the user 308 is in bed for the evening, the control circuitry 334 can generate and transmit a request to the oven 322 to request a state of the oven 322 (e.g., on or off). If the oven 322 is on, the control circuitry 334 can alert the user 308 and/or generate and transmit control signals to cause the oven 322 to turn off. If the oven is already off, the control circuitry 334 can determine that no further action is necessary. In some implementations, different alerts can be generated for different events. For example, the control circuitry 334 can cause the lamp 326 (or one or more other lights, via the lighting system 314) to flash in a first pattern if the security system 318 has detected a breach, flash in a second pattern if garage door 320 is on, flash in a third pattern if the door 332 is open, flash in a fourth pattern if the oven 322 is on, and flash in a fifth pattern if another bed has detected that a user of that bed has gotten up (e.g., that a child of the user 308 has gotten out of bed in the middle of the night as sensed by a sensor in the bed 302 of the child). Other examples of alerts that can be processed by the control circuitry 334 of the bed 302 and communicated to the user include a smoke detector detecting smoke (and communicating this detection of smoke to the control circuitry 334), a carbon monoxide tester detecting carbon monoxide, a heater malfunctioning, or an alert from any other device capable of communicating with the control circuitry 334 and detecting an occurrence that should be brought to the user 308's attention.

The control circuitry 334 can also communicate with a system or device for controlling a state of the window blinds 330. For example, in response to determining that the user 308 is in bed for the evening, the control circuitry 334 can generate and transmit control signals to cause the window blinds 330 to close. As another example, in response to determining that the user 308 is up for the day (e.g., user has gotten out of bed after 6:30 am) the control circuitry 334 can generate and transmit control signals to cause the window blinds 330 to open. By contrast, if the user 308 gets out of bed prior to a normal rise time for the user 308, the control circuitry 334 can determine that the user 308 is not awake for the day and does not generate control signals for causing the window blinds 330 to open. As yet another example, the control circuitry 334 can generate and transmit control signals that cause a first set of blinds to close in response to detecting user bed presence of the user 308 and a second set of blinds to close in response to detecting that the user 308 is asleep.

The control circuitry 334 can generate and transmit control signals for controlling functions of other household devices in response to detecting user interactions with the bed 302. For example, in response to determining that the user 308 is awake for the day, the control circuitry 334 can generate and transmit control signals to the coffee maker 324 to cause the coffee maker 324 to begin brewing coffee. As another example, the control circuitry 334 can generate and transmit control signals to the oven 322 to cause the oven to begin preheating (for users that like fresh baked bread in the morning). As another example, the control circuitry 334 can use information indicating that the user 308 is awake for the day along with information indicating that the time of year is currently winter and/or that the outside temperature is below a threshold value to generate and transmit control signals to cause a car engine block heater to turn on.

As another example, the control circuitry 334 can generate and transmit control signals to cause one or more devices to enter a sleep mode in response to detecting user bed presence of the user 308, or in response to detecting that the user 308 is asleep. For example, the control circuitry 334 can generate control signals to cause a mobile phone of the user 308 to switch into sleep mode. The control circuitry 334 can then transmit the control signals to the mobile phone. Later, upon determining that the user 308 is up for the day, the control circuitry 334 can generate and transmit control signals to cause the mobile phone to switch out of sleep mode.

In some implementations, the control circuitry 334 can communicate with one or more noise control devices. For example, upon determining that the user 308 is in bed for the evening, or that the user 308 is asleep, the control circuitry 334 can generate and transmit control signals to cause one or more noise cancelation devices to activate. The noise cancelation devices can, for example, be included as part of the bed 302 or located in the bedroom with the bed 302. As another example, upon determining that the user 308 is in bed for the evening or that the user 308 is asleep, the control circuitry 334 can generate and transmit control signals to turn the volume on, off, up, or down, for one or more sound generating devices, such as a stereo system radio, computer, tablet, etc.

Additionally, functions of the bed 302 are controlled by the control circuitry 334 in response to user interactions with the bed 302. For example, the bed 302 can include an adjustable foundation and an articulation controller configured to adjust the position of one or more portions of the bed 302 by adjusting the adjustable foundation that supports the bed. For example, the articulation controller can adjust the bed 302 from a flat position to a position in which a head portion of a mattress of the bed 302 is inclined upward (e.g., to facilitate a user sitting up in bed and/or watching television). In some implementations, the bed 302 includes multiple separately articulable sections. For example, portions of the bed corresponding to the locations of the air chambers 306*a* and 306*b* can be articulated independently from each other, to allow one person positioned on the bed 302 surface to rest in a first position (e.g., a flat position) while a second person rests in a second position (e.g., a reclining position with the head raised at an angle from the waist). In some implementations, separate positions can be set for two different beds (e.g., two twin beds placed next to each other). The foundation of the bed 302 can include more than one zone that can be independently adjusted. The articulation controller can also be configured to provide different levels of massage to one or more users on the bed 302 or to cause the bed to vibrate to communicate alerts to the user 308 as described above.

The control circuitry 334 can adjust positions (e.g., incline and decline positions for the user 308 and/or an additional user of the bed 302) in response to user interactions with the bed 302. For example, the control circuitry 334 can cause the articulation controller to adjust the bed 302 to a first recline position for the user 308 in response to sensing user bed presence for the user 308. The control circuitry 334 can cause the articulation controller to adjust the bed 302 to a second recline position (e.g., a less reclined, or flat position) in response to determining that the user 308 is asleep. As another example, the control circuitry 334 can receive a communication from the television 312 indicating that the user 308 has turned off the television 312, and in response the control circuitry 334 can cause the articulation controller to adjust the position of the bed 302 to a preferred user sleeping position (e.g., due to the user turning off the television 312 while the user 308 is in bed indicating that the user 308 wishes to go to sleep).

In some implementations, the control circuitry 334 can control the articulation controller so as to wake up one user of the bed 302 without waking another user of the bed 302. For example, the user 308 and a second user of the bed 302 can each set distinct wakeup times (e.g., 6:30 am and 7:15 am respectively). When the wakeup time for the user 308 is reached, the control circuitry 334 can cause the articulation controller to vibrate or change the position of only a side of the bed on which the user 308 is located to wake the user 308 without disturbing the second user. When the wakeup time for the second user is reached, the control circuitry 334 can cause the articulation controller to vibrate or change the position of only the side of the bed on which the second user is located. Alternatively, when the second wakeup time occurs, the control circuitry 334 can utilize other methods (such as audio alarms, or turning on the lights) to wake the second user since the user 308 is already awake and therefore will not be disturbed when the control circuitry 334 attempts to wake the second user.

Still referring to FIG. 3, the control circuitry 334 for the bed 302 can utilize information for interactions with the bed 302 by multiple users to generate control signals for controlling functions of various other devices. For example, the control circuitry 334 can wait to generate control signals for, for example, engaging the security system 318, or instructing the lighting system 314 to turn off lights in various rooms until both the user 308 and a second user are detected as being present on the bed 302. As another example, the control circuitry 334 can generate a first set of control signals to cause the lighting system 314 to turn off a first set of lights upon detecting bed presence of the user 308 and generate a second set of control signals for turning off a second set of lights in response to detecting bed presence of a second user. As another example, the control circuitry 334 can wait until it has been determined that both the user 308 and a second user are awake for the day before generating control signals to open the window blinds 330. As yet another example, in response to determining that the user 308 has left the bed and is awake for the day, but that a second user is still sleeping, the control circuitry 334 can generate and transmit a first set of control signals to cause the coffee maker 324 to begin brewing coffee, to cause the security system 318 to deactivate, to turn on the lamp 326, to turn off the nightlight 328, to cause the thermostat 316 to raise the temperature in one or more rooms to 72 degrees, and to open blinds (e.g., the window blinds 330) in rooms other than the bedroom in which the bed 302 is located. Later, in response to detecting that the second user is no longer present on the bed (or that the second user is awake) the control circuitry 334 can generate and transmit a second set of control signals to, for example, cause the lighting system 314 to turn on one or more lights in the bedroom, to cause window blinds in the bedroom to open, and to turn on the television 312 to a pre-specified channel.

Described here are examples of systems and components that can be used for data processing tasks that are, for example, associated with a bed. In some cases, multiple examples of a particular component or group of components are presented. Some of these examples are redundant and/or mutually exclusive alternatives. Connections between components are shown as examples to illustrate possible network configurations for allowing communication between components. Different formats of connections can be used as technically needed or desired. The connections generally indicate a logical connection that can be created with any technologically feasible format. For example, a network on a motherboard can be created with a printed circuit board, wireless data connections, and/or other types of network connections. Some logical connections are not shown for clarity. For example, connections with power supplies and/or computer readable memory may not be shown for clarities sake, as many or all elements of a particular component may need to be connected to the power supplies and/or computer readable memory.

Figure 4A:
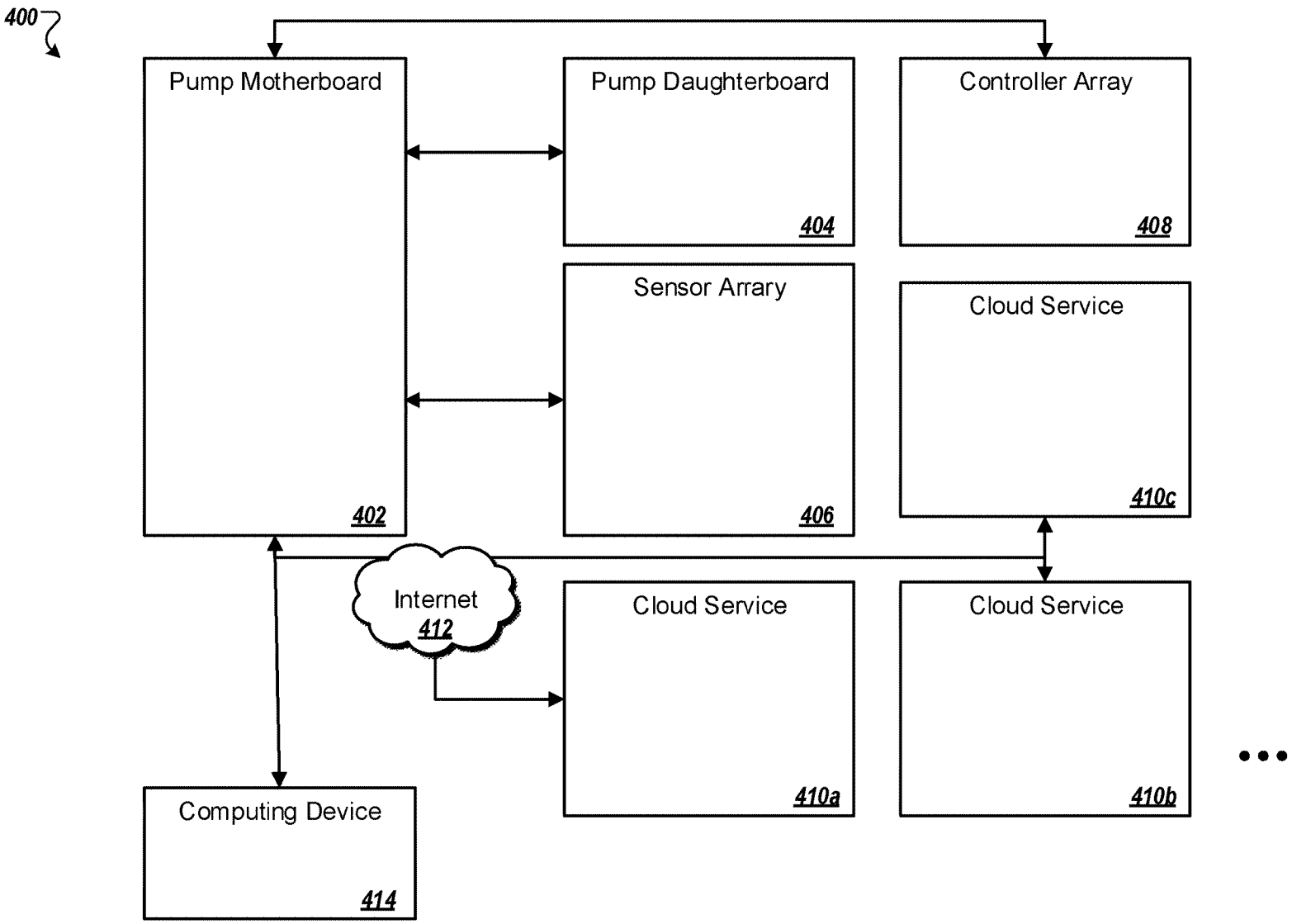
FIGS. 4A and 4B are block diagrams of example data processing systems that can be associated with a bed.

FIG. 4A is a block diagram of an example of a data processing system 400 that can be associated with a bed system, including those described above with respect to FIGS. 1-3. This system 400 includes a pump motherboard 402 and a pump daughterboard 404. The system 400 includes a sensor array 406 that can include one or more sensors configured to sense physical phenomenon of the environment and/or bed, and to report such sensing back to the pump motherboard 402 for, for example, analysis. The system 400 also includes a controller array 408 that can include one or more controllers configured to control logic-controlled devices of the bed and/or environment. The pump motherboard 400 can be in communication with one or more computing devices 414 and one or more cloud services 410 over local networks, the Internet 412, or otherwise as is technically appropriate. Each of these components will be described in more detail, some with multiple example configurations, below.

In this example, a pump motherboard 402 and a pump daughterboard 404 are communicably coupled. They can be conceptually described as a center or hub of the system 400, with the other components conceptually described as spokes of the system 400. In some configurations, this can mean that each of the spoke components communicates primarily or exclusively with the pump motherboard 402. For example, a sensor of the sensor array may not be configured to, or may not be able to, communicate directly with a corresponding controller. Instead, each spoke component can communicate with the motherboard 402. The sensor of the sensor array 406 can report a sensor reading to the motherboard 402, and the motherboard 402 can determine that, in response, a controller of the controller array 408 should adjust some parameters of a logic controlled device or otherwise modify a state of one or more peripheral devices. In one case, if the temperature of the bed is determined to be too hot, the pump motherboard 402 can determine that a temperature controller should cool the bed.

One advantage of a hub-and-spoke network configuration, sometimes also referred to as a star-shaped network, is a reduction in network traffic compared to, for example, a mesh network with dynamic routing. If a particular sensor generates a large, continuous stream of traffic, that traffic may only be transmitted over one spoke of the network to the motherboard 402. The motherboard 402 can, for example, marshal that data and condense it to a smaller data format for retransmission for storage in a cloud service 410. Additionally or alternatively, the motherboard 402 can generate a single, small, command message to be sent down a different spoke of the network in response to the large stream. For example, if the large stream of data is a pressure reading that is transmitted from the sensor array 406 a few times a second, the motherboard 402 can respond with a single command message to the controller array to increase the pressure in an air chamber. In this case, the single command message can be orders of magnitude smaller than the stream of pressure readings.

As another advantage, a hub-and-spoke network configuration can allow for an extensible network that can accommodate components being added, removed, failing, etc. This can allow, for example, more, fewer, or different sensors in the sensor array 406, controllers in the controller array 408, computing devices 414, and/or cloud services 410. For example, if a particular sensor fails or is deprecated by a newer version of the sensor, the system 400 can be configured such that only the motherboard 402 needs to be updated about the replacement sensor. This can allow, for example, product differentiation where the same motherboard 402 can support an entry level product with fewer sensors and controllers, a higher value product with more sensors and controllers, and customer personalization where a customer can add their own selected components to the system 400.

Additionally, a line of air bed products can use the system 400 with different components. In an application in which every air bed in the product line includes both a central logic unit and a pump, the motherboard 402 (and optionally the daughterboard 404) can be designed to fit within a single, universal housing. Then, for each upgrade of the product in the product line, additional sensors, controllers, cloud services, etc., can be added. Design, manufacturing, and testing time can be reduced by designing all products in a product line from this base, compared to a product line in which each product has a bespoke logic control system.

Each of the components discussed above can be realized in a wide variety of technologies and configurations. Below, some examples of each component will be further discussed. In some alternatives, two or more of the components of the system 400 can be realized in a single alternative component; some components can be realized in multiple, separate components; and/or some functionality can be provided by different components.

Figure 4B:
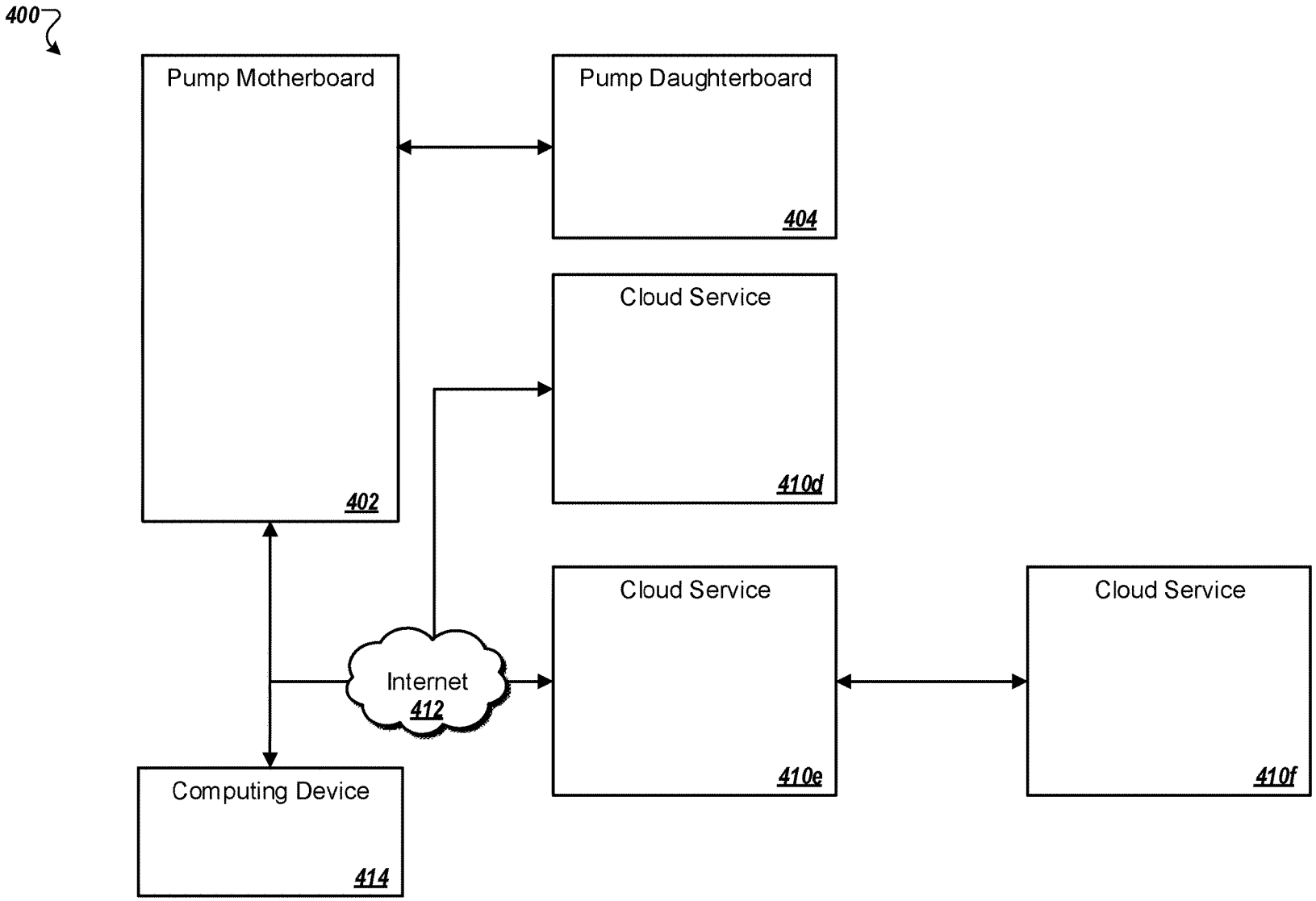

FIG. 4B is a block diagram showing some communication paths of the data processing system 400. As previously described, the motherboard 402 and the pump daughterboard 404 may act as a hub for peripheral devices and cloud services of the system 400. In cases in which the pump daughterboard 404 communicates with cloud services or other components, communications from the pump daughterboard 404 may be routed through the pump motherboard 402. This may allow, for example, the bed to have only a single connection with the internet 412. The computing device 414 may also have a connection to the internet 412, possibly through the same gateway used by the bed and/or possibly through a different gateway (e.g., a cell service provider).

Previously, a number of cloud services 410 were described. As shown in FIG. 4B, some cloud services, such as cloud services 410*d* and 410*e*, may be configured such that the pump motherboard 402 can communicate with the cloud service directly—that is the motherboard 402 may communicate with a cloud service 410 without having to use another cloud service 410 as an intermediary. Additionally or alternatively, some cloud services 410, for example cloud service 410*f*, may only be reachable by the pump motherboard 402 through an intermediary cloud service, for example cloud service 410*e*. While not shown here, some cloud services 410 may be reachable either directly or indirectly by the pump motherboard 402.

Additionally, some or all of the cloud services 410 may be configured to communicate with other cloud services. This communication may include the transfer of data and/or remote function calls according to any technologically appropriate format. For example, one cloud service 410 may request a copy for another cloud service's 410 data, for example, for purposes of backup, coordination, migration, or for performance of calculations or data mining. In another example, many cloud services 410 may contain data that is indexed according to specific users tracked by the user account cloud 410*c* and/or the bed data cloud 410*a*. These cloud services 410 may communicate with the user account cloud 410*c* and/or the bed data cloud 410*a* when accessing data specific to a particular user or bed.

Figure 5:
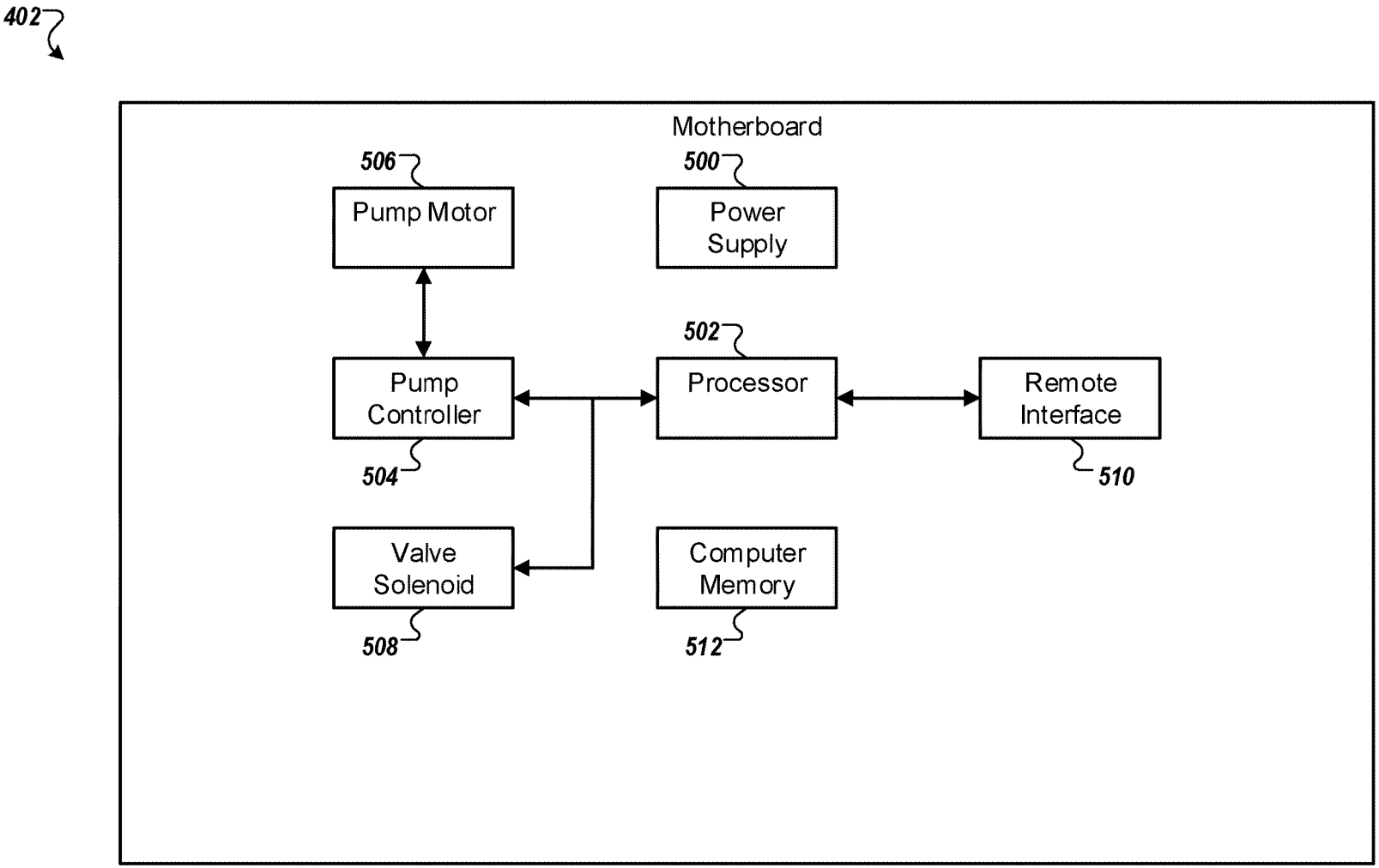
FIGS. 5 and 6 are block diagrams of examples of motherboards that can be used in a data processing system that can be associated with a bed.

FIG. 5 is a block diagram of an example of a motherboard 402 that can be used in a data processing system that can be associated with a bed system, including those described above with respect to FIGS. 1-3. In this example, compared to other examples described below, this motherboard 402 consists of relatively fewer parts and can be limited to provide a relatively limited feature set.

The motherboard includes a power supply 500, a processor 502, and computer memory 512. In general, the power supply includes hardware used to receive electrical power from an outside source and supply it to components of the motherboard 402. The power supply can include, for example, a battery pack and/or wall outlet adapter, an AC to DC converter, a DC to AC converter, a power conditioner, a capacitor bank, and/or one or more interfaces for providing power in the current type, voltage, etc., needed by other components of the motherboard 402.

The processor 502 is generally a device for receiving input, performing logical determinations, and providing output. The processor 502 can be a central processing unit, a microprocessor, general purpose logic circuitry, application-specific integrated circuitry, a combination of these, and/or other hardware for performing the functionality needed.

The memory 512 is generally one or more devices for storing data. The memory 512 can include long term stable data storage (e.g., on a hard disk), short term unstable (e.g., on Random Access Memory) or any other technologically appropriate configuration.

The motherboard 402 includes a pump controller 504 and a pump motor 506. The pump controller 504 can receive commands from the processor 502 and, in response, control the function of the pump motor 506. For example, the pump controller 504 can receive, from the processor 502, a command to increase the pressure of an air chamber by 0.3 pounds per square inch (PSI). The pump controller 504, in response, engages a valve so that the pump motor 506 is configured to pump air into the selected air chamber, and can engage the pump motor 506 for a length of time that corresponds to 0.3 PSI or until a sensor indicates that pressure has been increased by 0.3 PSI. In an alternative configuration, the message can specify that the chamber should be inflated to a target PSI, and the pump controller 504 can engage the pump motor 506 until the target PSI is reached.

A valve solenoid 508 can control which air chamber a pump is connected to. In some cases, the solenoid 508 can be controlled by the processor 502 directly. In some cases, the solenoid 508 can be controlled by the pump controller 504.

A remote interface 510 of the motherboard 402 can allow the motherboard 402 to communicate with other components of a data processing system. For example, the motherboard 402 can be able to communicate with one or more daughterboards, with peripheral sensors, and/or with peripheral controllers through the remote interface 510. The remote interface 510 can provide any technologically appropriate communication interface, including but not limited to multiple communication interfaces such as WiFi, Bluetooth, and copper wired networks.

Figure 6:
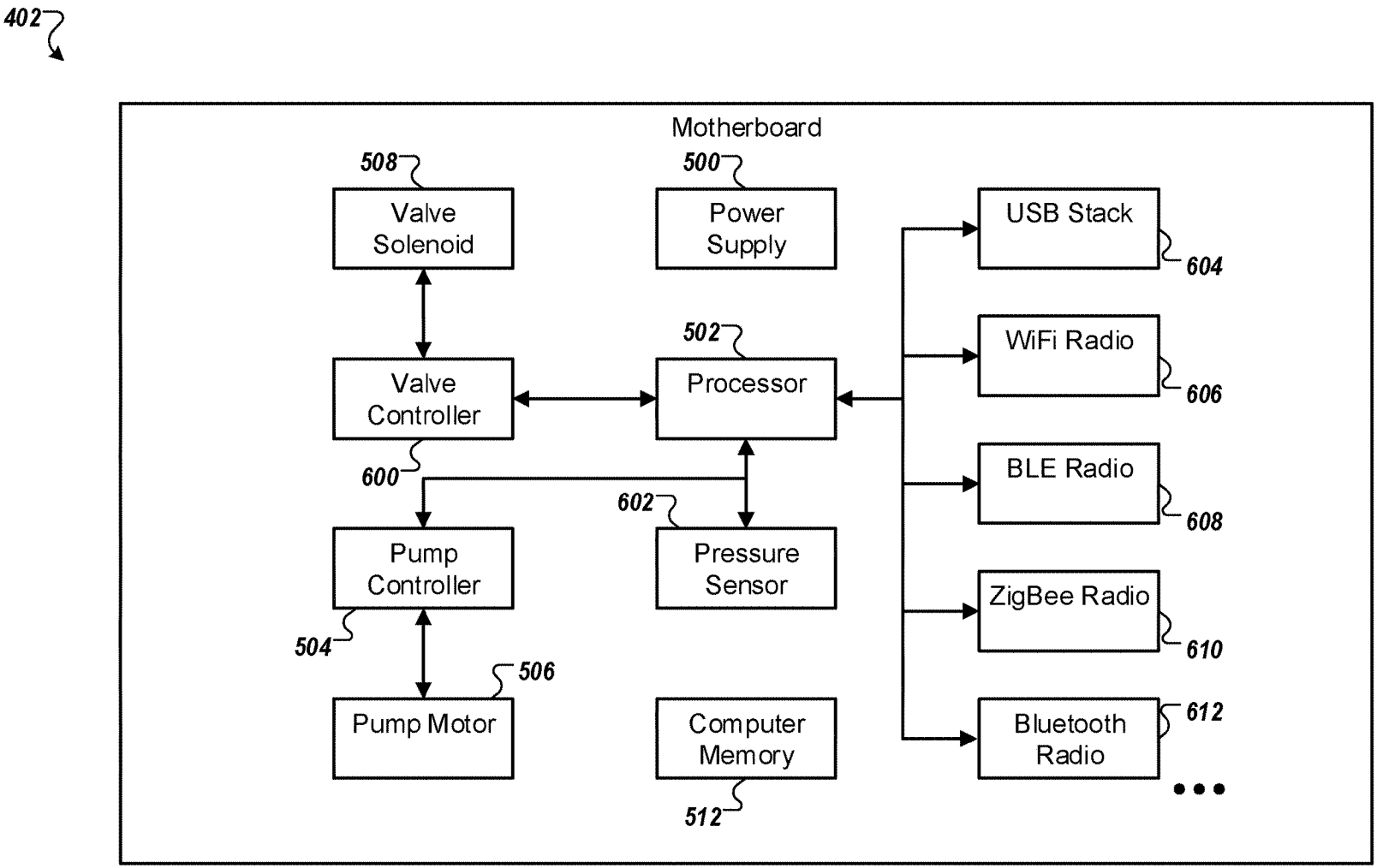

FIG. 6 is a block diagram of an example of a motherboard 402 that can be used in a data processing system that can be associated with a bed system, including those described above with respect to FIGS. 1-3. Compared to the motherboard 402 described with reference to FIG. 5, the motherboard in FIG. 6 can contain more components and provide more functionality in some applications.

In addition to the power supply 500, processor 502, pump controller 504, pump motor 506, and valve solenoid 508, this motherboard 402 is shown with a valve controller 600, a pressure sensor 602, a universal serial bus (USB) stack 604, a WiFi radio 606, a Bluetooth Low Energy (BLE) radio 608, a ZigBee radio 610, a Bluetooth radio 612 and a computer memory 512.

Similar to the way that the pump controller 504 converts commands from the processor 502 into control signals for the pump motor 506, the valve controller 600 can convert commands from the processor 502 into control signals for the valve solenoid 508. In one example, the processor 502 can issue a command to the valve controller 600 to connect the pump to a particular air chamber out of the group of air chambers in an air bed. The valve controller 600 can control the position of the valve solenoid 508 so that the pump is connected to the indicated air chamber.

The pressure sensor 602 can read pressure readings from one or more air chambers of the air bed. The pressure sensor 602 can also preform digital sensor conditioning.

The motherboard 402 can include a suite of network interfaces, including but not limited to those shown here. These network interfaces can allow the motherboard to communicate over a wired or wireless network with any number of devices, including but not limited to peripheral sensors, peripheral controllers, computing devices, and devices and services connected to the Internet 412.

Figure 7:
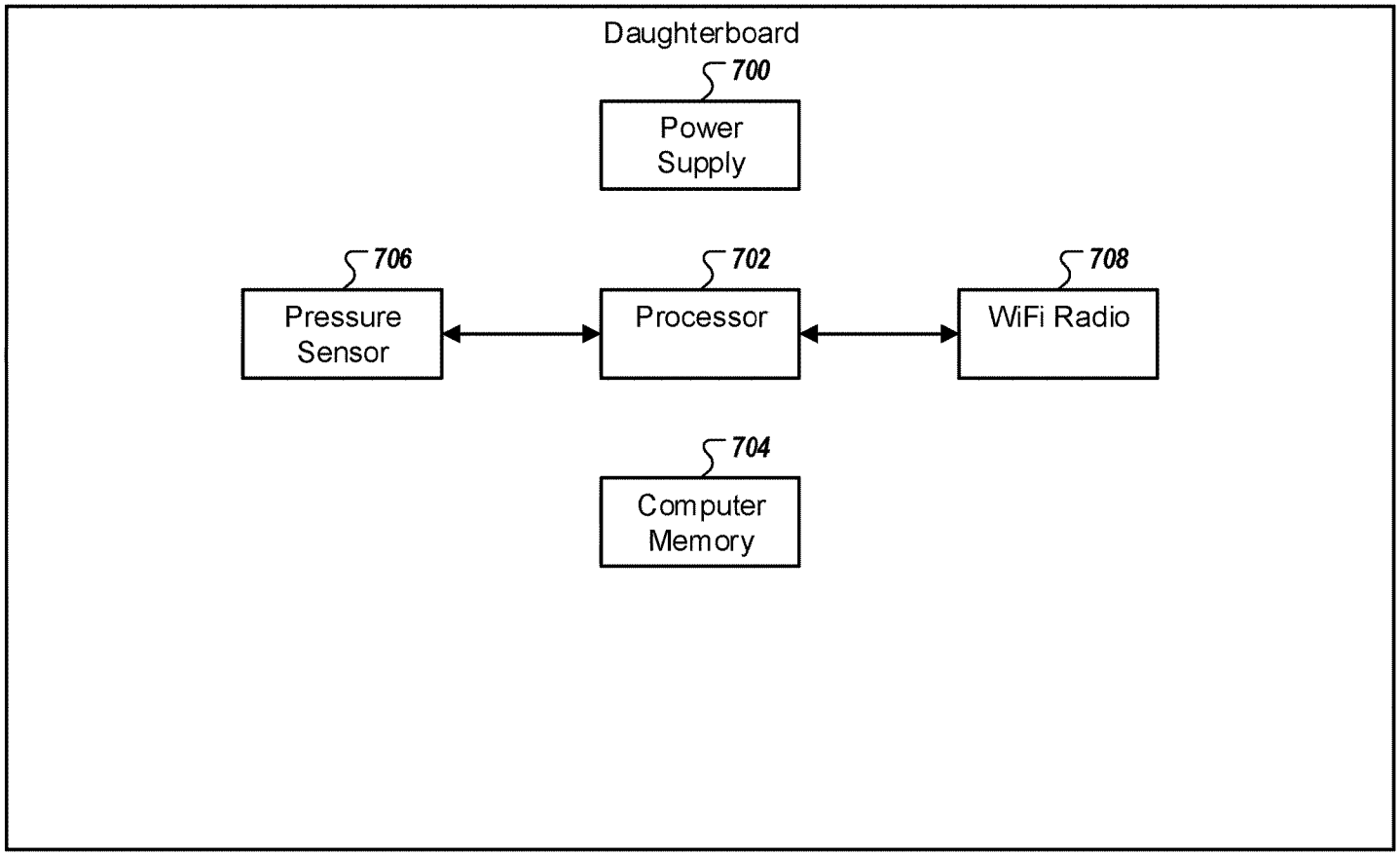
FIG. 7 is a block diagram of an example of a daughterboard that can be used in a data processing system that can be associated with a bed.

FIG. 7 is a block diagram of an example of a daughterboard 404 that can be used in a data processing system that can be associated with a bed system, including those described above with respect to FIGS. 1-3. In some configurations, one or more daughterboards 404 can be connected to the motherboard 402. Some daughterboards 404 can be designed to offload particular and/or compartmentalized tasks from the motherboard 402. This can be advantageous, for example, if the particular tasks are computationally intensive, proprietary, or subject to future revisions. For example, the daughterboard 404 can be used to calculate a particular sleep data metric. This metric can be computationally intensive, and calculating the sleep metric on the daughterboard 404 can free up the resources of the motherboard 402 while the metric is being calculated. Additionally and/or alternatively, the sleep metric can be subject to future revisions. To update the system 400 with the new sleep metric, it is possible that only the daughterboard 404 that calculates that metric need be replaced. In this case, the same motherboard 402 and other components can be used, saving the need to perform unit testing of additional components instead of just the daughterboard 404.

The daughterboard 404 is shown with a power supply 700, a processor 702, computer readable memory 704, a pressure sensor 706, and a WiFi radio 708. The processor can use the pressure sensor 706 to gather information about the pressure of the air chamber or chambers of an air bed. From this data, the processor 702 can perform an algorithm to calculate a sleep metric. In some examples, the sleep metric can be calculated from only the pressure of air chambers. In other examples, the sleep metric can be calculated from one or more other sensors. In an example in which different data is needed, the processor 702 can receive that data from an appropriate sensor or sensors. These sensors can be internal to the daughterboard 404, accessible via the WiFi radio 708, or otherwise in communication with the processor 702. Once the sleep metric is calculated, the processor 702 can report that sleep metric to, for example, the motherboard 402.

Figure 8:
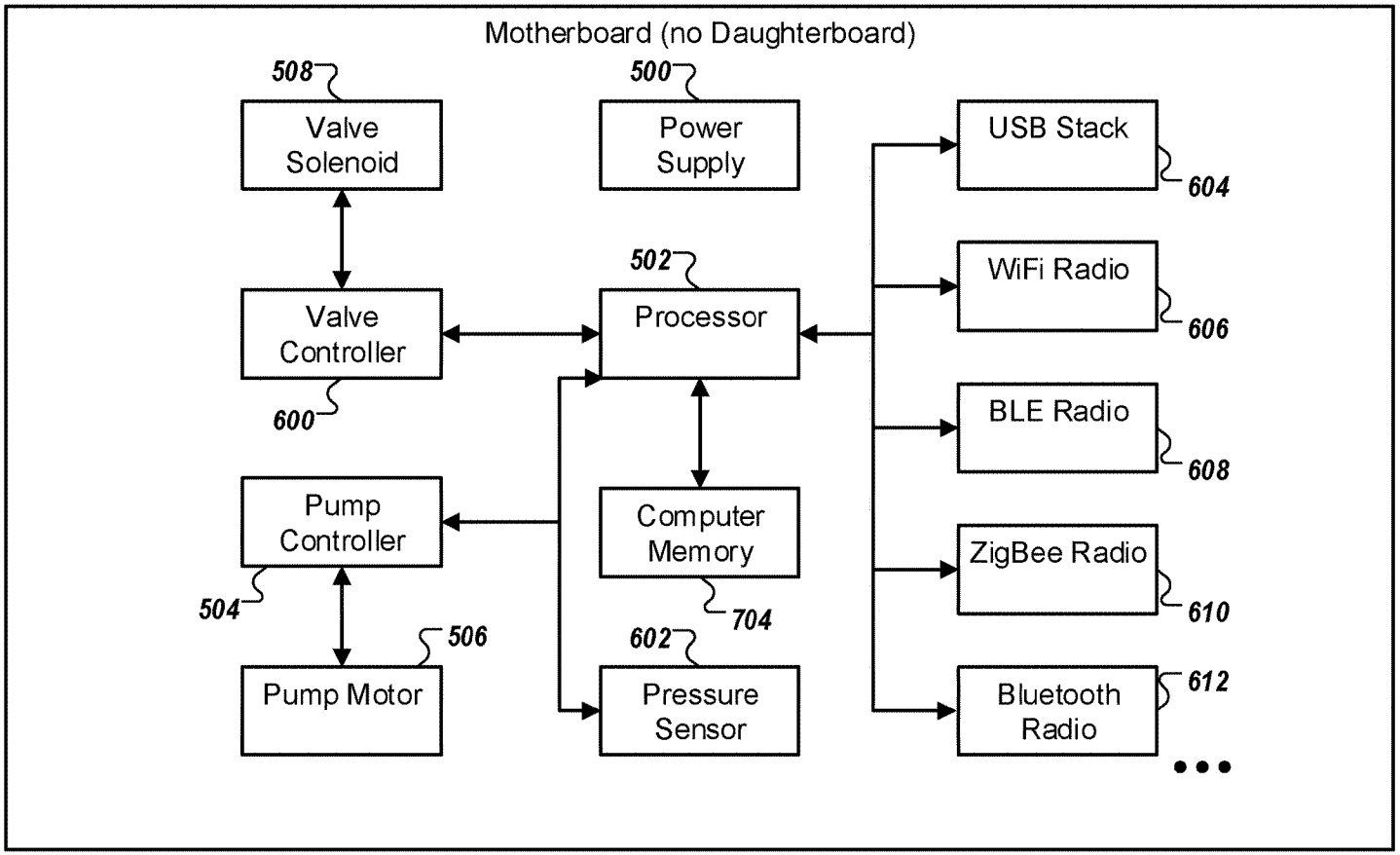
FIG. 8 is a block diagram of an example of a motherboard with no daughterboard that can be used in a data processing system that can be associated with a bed.

FIG. 8 is a block diagram of an example of a motherboard 800 with no daughterboard that can be used in a data processing system that can be associated with a bed system, including those described above with respect to FIGS. 1-3. In this example, the motherboard 800 can perform most, all, or more of the features described with reference to the motherboard 402 in FIG. 6 and the daughterboard 404 in FIG. 7.

Figure 9:
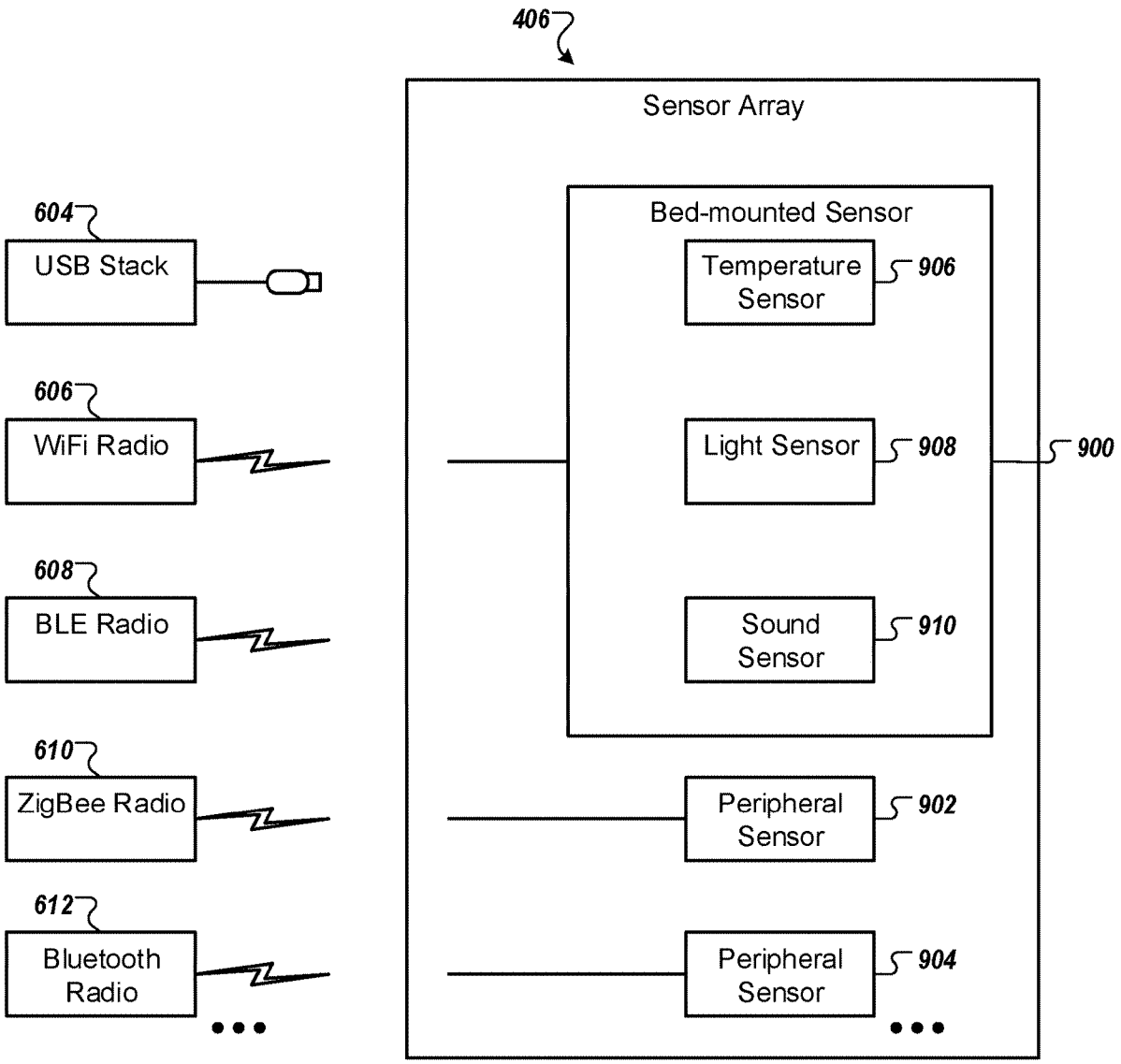
FIG. 9 is a block diagram of an example of a sensory array that can be used in a data processing system that can be associated with a bed.

FIG. 9 is a block diagram of an example of a sensory array 406 that can be used in a data processing system that can be associated with a bed system, including those described above with respect to FIGS. 1-3. In general, the sensor array 406 is a conceptual grouping of some or all the peripheral sensors that communicate with the motherboard 402 but are not native to the motherboard 402.

The peripheral sensors of the sensor array 406 can communicate with the motherboard 402 through one or more of the network interfaces of the motherboard, including but not limited to the USB stack 604, a WiFi radio 606, a Bluetooth Low Energy (BLE) radio 608, a ZigBee radio 610, and a Bluetooth radio 612, as is appropriate for the configuration of the particular sensor. For example, a sensor that outputs a reading over a USB cable can communicate through the USB stack 604.

Some of the peripheral sensors 900 of the sensor array 406 can be bed mounted 900. These sensors can be, for example, embedded into the structure of a bed and sold with the bed, or later affixed to the structure of the bed. Other peripheral sensors 902 and 904 can be in communication with the motherboard 402, but optionally not mounted to the bed. In some cases, some or all of the bed mounted sensors 900 and/or peripheral sensors 902 and 904 can share networking hardware, including a conduit that contains wires from each sensor, a multi-wire cable or plug that, when affixed to the motherboard 402, connect all of the associated sensors with the motherboard 402. In some embodiments, one, some, or all of sensors 902, 904, 906, 908, and 910 can sense one or more features of a mattress, such as pressure, temperature, light, sound, and/or one or more other features of the mattress. In some embodiments, one, some, or all of sensors 902, 904, 906, 908, and 910 can sense one or more features external to the mattress. In some embodiments, pressure sensor 902 can sense pressure of the mattress while some or all of sensors 902, 904, 906, 908, and 910 can sense one or more features of the mattress and/or external to the mattress.

Figure 10:
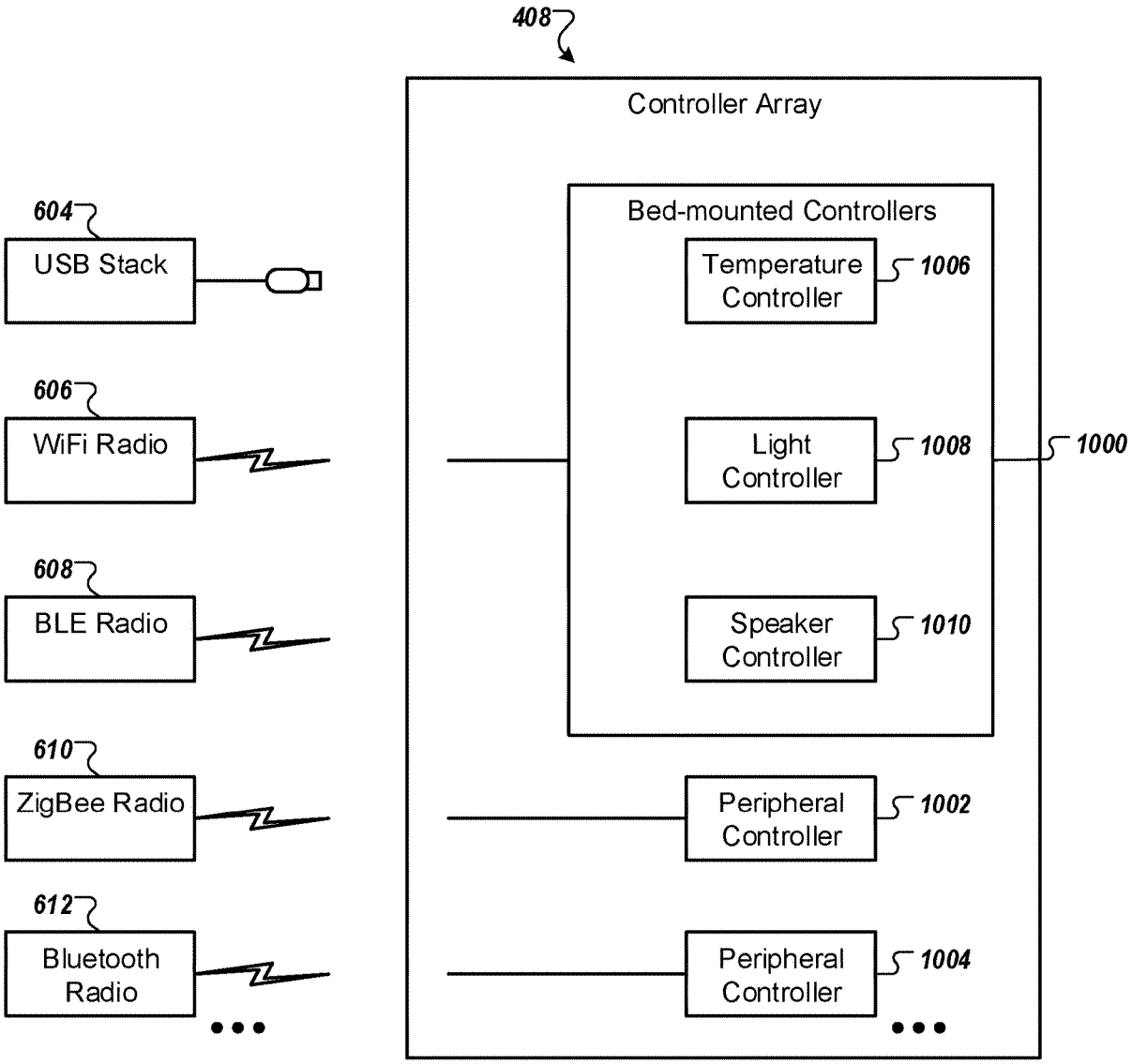
FIG. 10 is a block diagram of an example of a control array that can be used in a data processing system that can be associated with a bed

FIG. 10 is a block diagram of an example of a controller array 408 that can be used in a data processing system that can be associated with a bed system, including those described above with respect to FIGS. 1-3. In general, the controller array 408 is a conceptual grouping of some or all peripheral controllers that communicate with the motherboard 402 but are not native to the motherboard 402.

The peripheral controllers of the controller array 408 can communicate with the motherboard 402 through one or more of the network interfaces of the motherboard, including but not limited to the USB stack 604, a WiFi radio 606, a Bluetooth Low Energy (BLE) radio 608, a ZigBee radio 610, and a Bluetooth radio 612, as is appropriate for the configuration of the particular sensor. For example, a controller that receives a command over a USB cable can communicate through the USB stack 604.

Some of the controllers of the controller array 408 can be bed mounted 1000, e.g., temperature controller 1006, light controller 1008, speaker controller 1010. These controllers can be, for example, embedded into the structure of a bed and sold with the bed, or later affixed to the structure of the bed. Other peripheral controllers 1002 and 1004 can be in communication with the motherboard 402, but optionally not mounted to the bed. In some cases, some or all of the bed mounted controllers 1000 and/or peripheral controllers 1002 and 1004 can share networking hardware, including a conduit that contains wires for each controller, a multi-wire cable or plug that, when affixed to the motherboard 402, connects all of the associated controllers with the motherboard 402.

Figure 11:
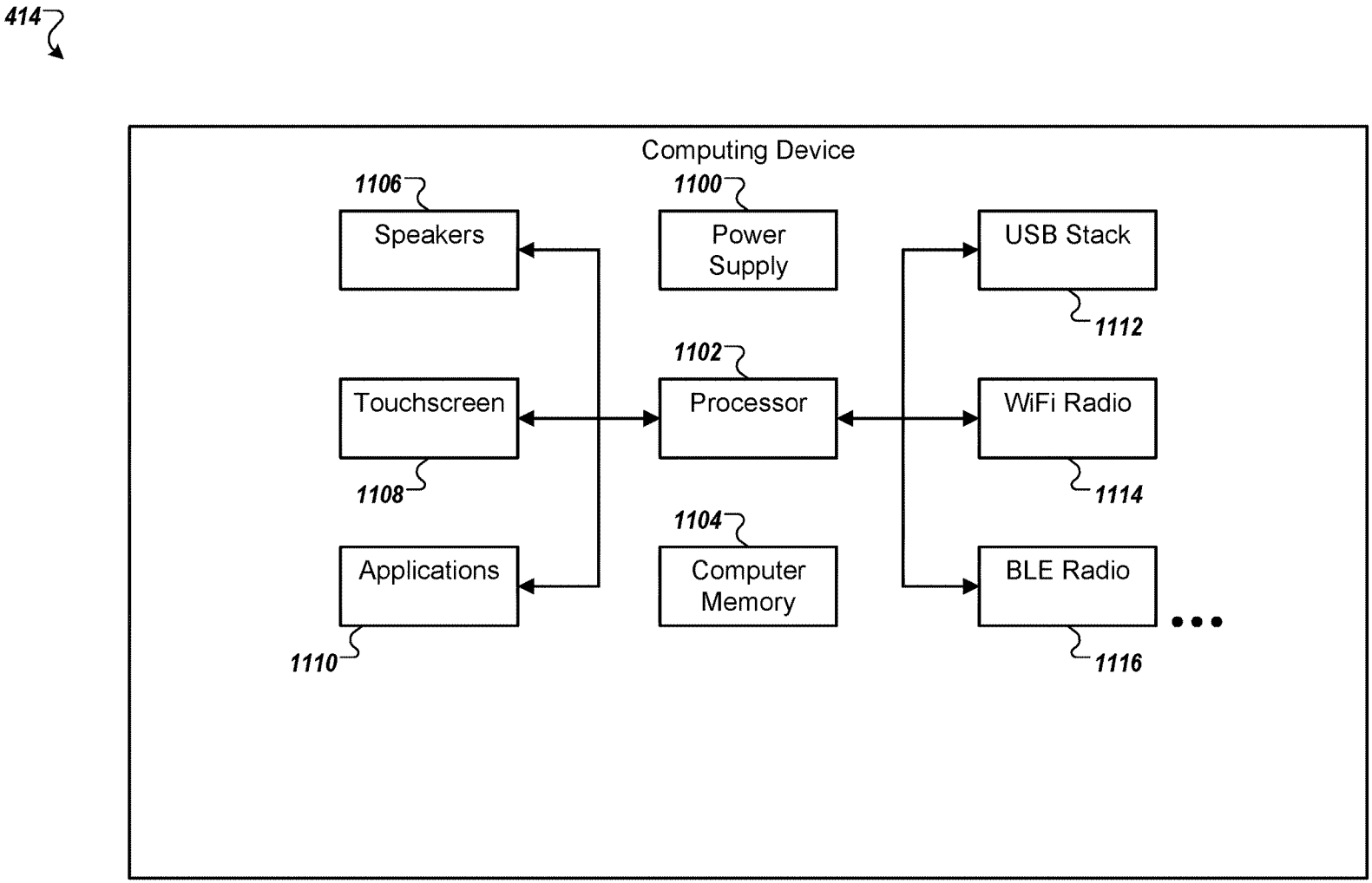
FIG. 11 is a block diagram of an example of a computing device that can be used in a data processing system that can be associated with a bed.

FIG. 11 is a block diagram of an example of a computing device 414 that can be used in a data processing system that can be associated with a bed system, including those described above with respect to FIGS. 1-3. The computing device 414 can include, for example, computing devices used by a user of a bed. Example computing devices 414 include, but are not limited to, mobile computing devices (e.g., mobile phones, tablet computers, laptops) and desktop computers.

The computing device 412 includes a power supply 1100, a processor 1102, computer readable memory 1104, speakers 1106, a touchscreen 1108, applications 1110, a USB stack 1112, a WiFi radio 1114, and a BLE radio 1116. User input and output can be transmitted by, for example, speakers 1106, a touchscreen 1108, or other not shown components such as a pointing device or keyboard. The computing device 412 can run one or more applications 1110. These applications can include, for example, application to allow the user to interact with the system 400. These applications can allow a user to view information about the bed (e.g., sensor readings, sleep metrics), or configure the behavior of the system 400 (e.g., set a desired firmness to the bed, set desired behavior for peripheral devices). In some cases, the computing device 412 can be used in addition to, or to replace, the remote control 122 described previously.

Figure 12:
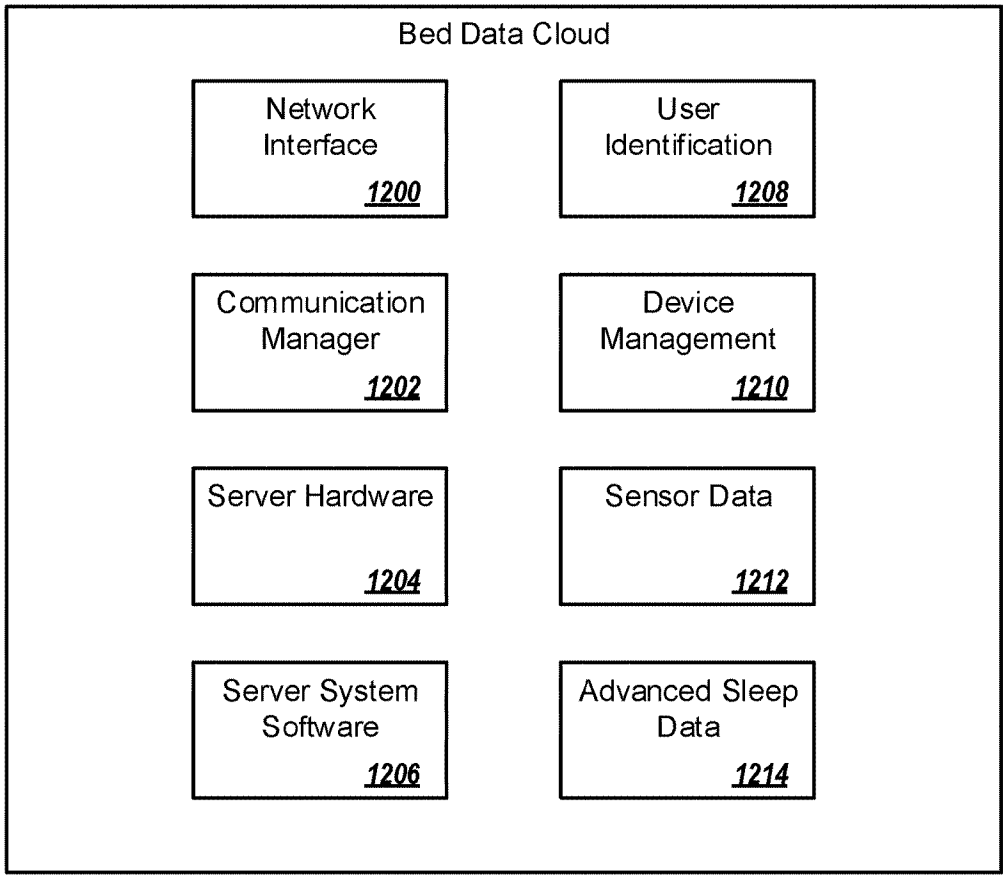
FIGS. 12-16 are block diagrams of example cloud services that can be used in a data processing system that can be associated with a bed.

FIG. 12 is a block diagram of an example bed data cloud service 410*a* that can be used in a data processing system that can be associated with a bed system, including those described above with respect to FIGS. 1-3. In this example, the bed data cloud service 410*a* is configured to collect sensor data and sleep data from a particular bed, and to match the sensor and sleep data with one or more users that use the bed when the sensor and sleep data was generated.

The bed data cloud service 410*a* is shown with a network interface 1200, a communication manager 1202, server hardware 1204, and server system software 1206. In addition, the bed data cloud service 410*a* is shown with a user identification module 1208, a device management 1210 module, a sensor data module 1212, and an advanced sleep data module 1214.

The network interface 1200 generally includes hardware and low level software used to allow one or more hardware devices to communicate over networks. For example the network interface 1200 can include network cards, routers, modems, and other hardware needed to allow the components of the bed data cloud service 410*a* to communicate with each other and other destinations over, for example, the Internet 412. The communication manger 1202 generally comprises hardware and software that operate above the network interface 1200. This includes software to initiate, maintain, and tear down network communications used by the bed data cloud service 410*a*. This includes, for example, TCP/IP, SSL or TLS, Torrent, and other communication sessions over local or wide area networks. The communication manger 1202 can also provide load balancing and other services to other elements of the bed data cloud service 410*a*.

The server hardware 1204 generally includes the physical processing devices used to instantiate and maintain bed data cloud service 410*a*. This hardware includes, but is not limited to processors (e.g., central processing units, ASICs, graphical processers), and computer readable memory (e.g., random access memory, stable hard disks, tape backup). One or more servers can be configured into clusters, multi-computer, or datacenters that can be geographically separate or connected.

The server system software 1206 generally includes software that runs on the server hardware 1204 to provide operating environments to applications and services. The server system software 1206 can include operating systems running on real servers, virtual machines instantiated on real servers to create many virtual servers, server level operations such as data migration, redundancy, and backup.

The user identification 1208 can include, or reference, data related to users of beds with associated data processing systems. For example, the users can include customers, owners, or other users registered with the bed data cloud service 410*a* or another service. Each user can have, for example, a unique identifier, user credentials, contact information, billing information, demographic information, or any other technologically appropriate information.

The device manager 1210 can include, or reference, data related to beds or other products associated with data processing systems. For example, the beds can include products sold or registered with a system associated with the bed data cloud service 410*a*. Each bed can have, for example, a unique identifier, model and/or serial number, sales information, geographic information, delivery information, a listing of associated sensors and control peripherals, etc. Additionally, an index or indexes stored by the bed data cloud service 410*a* can identify users that are associated with beds. For example, this index can record sales of a bed to a user, users that sleep in a bed, etc.

The sensor data 1212 can record raw or condensed sensor data recorded by beds with associated data processing systems. For example, a bed's data processing system can have a temperature sensor, pressure sensor, and light sensor. Readings from these sensors, either in raw form or in a format generated from the raw data (e.g. sleep metrics) of the sensors, can be communicated by the bed's data processing system to the bed data cloud service 410*a* for storage in the sensor data 1212. Additionally, an index or indexes stored by the bed data cloud service 410*a* can identify users and/or beds that are associated with the sensor data 1212.

The bed data cloud service 410*a* can use any of its available data to generate advanced sleep data 1214. In general, the advanced sleep data 1214 includes sleep metrics and other data generated from sensor readings. Some of these calculations can be performed in the bed data cloud service 410*a* instead of locally on the bed's data processing system, for example, because the calculations are computationally complex or require a large amount of memory space or processor power that is not available on the bed's data processing system. This can help allow a bed system to operate with a relatively simple controller and still be part of a system that performs relatively complex tasks and computations.

Figure 13:
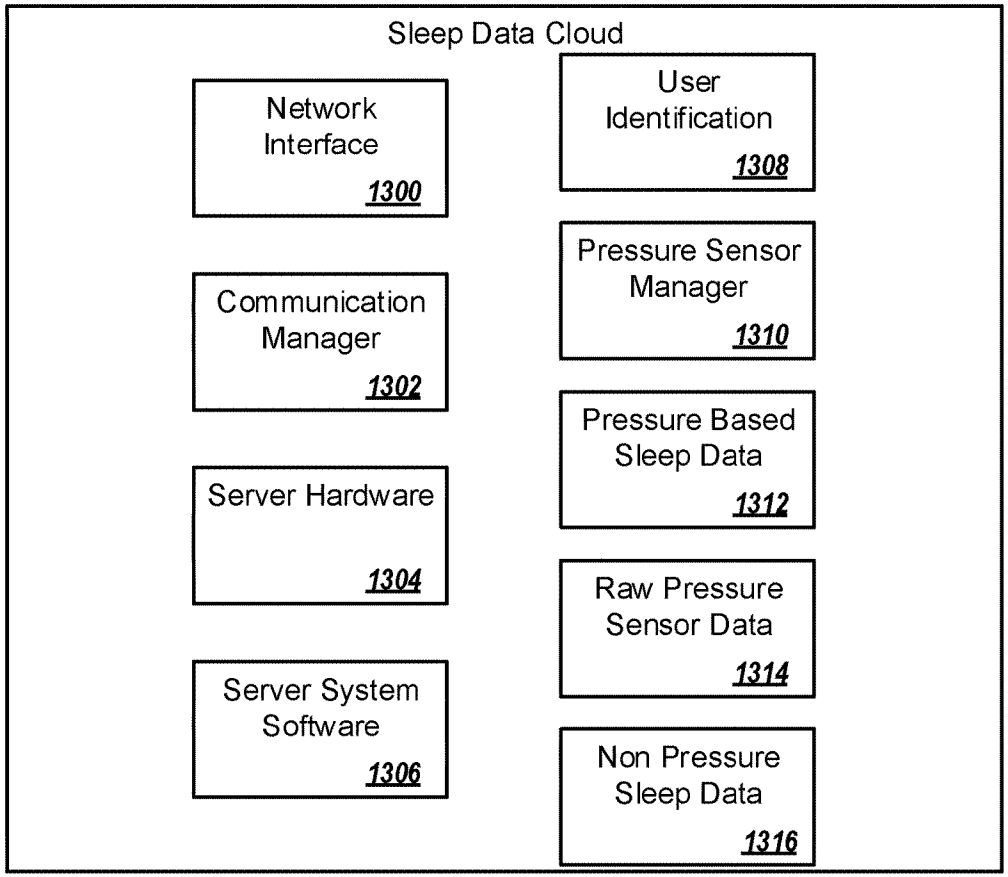

FIG. 13 is a block diagram of an example sleep data cloud service 410*b* that can be used in a data processing system that can be associated with a bed system, including those described above with respect to FIGS. 1-3. In this example, the sleep data cloud service 410*b* is configured to record data related to users' sleep experience.

The sleep data cloud service 410*b* is shown with a network interface 1300, a communication manager 1302, server hardware 1304, and server system software 1306. In addition, the sleep data cloud service 410*b* is shown with a user identification module 1308, a pressure sensor manager 1310, a pressure based sleep data module 1312, a raw pressure sensor data module 1314, and a non-pressure sleep data module 1316.

The pressure sensor manager 1310 can include, or reference, data related to the configuration and operation of pressure sensors in beds. For example, this data can include an identifier of the types of sensors in a particular bed, their settings and calibration data, etc.

The pressure based sleep data 1312 can use raw pressure sensor data 1314 to calculate sleep metrics specifically tied to pressure sensor data. For example, user presence, movements, weight change, heart rate, and breathing rate can all be determined from raw pressure sensor data 1314. Additionally, an index or indexes stored by the sleep data cloud service 410*b* can identify users that are associated with pressure sensors, raw pressure sensor data, and/or pressure based sleep data.

The non-pressure sleep data 1316 can use other sources of data to calculate sleep metrics. For example, user entered preferences, light sensor readings, and sound sensor readings can all be used to track sleep data. Additionally, an index or indexes stored by the sleep data cloud service 410*b* can identify users that are associated with other sensors and/or non-pressure sleep data 1316.

Figure 14:
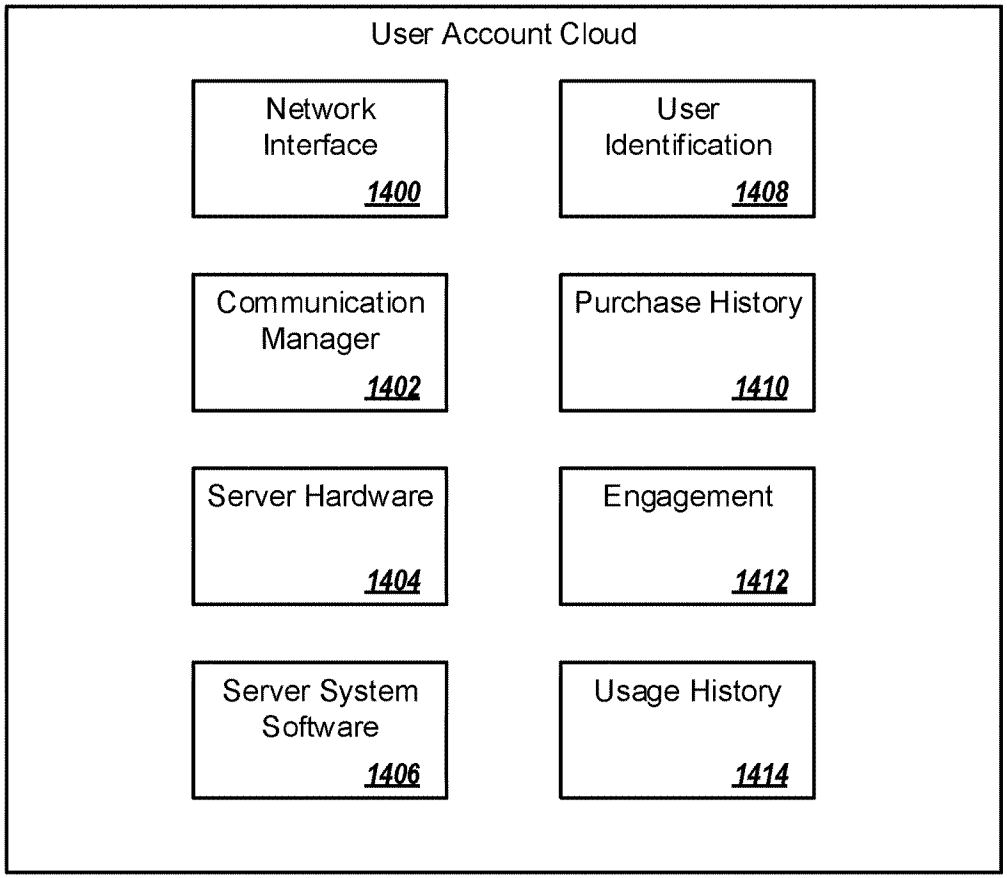

FIG. 14 is a block diagram of an example user account cloud service 410*c* that can be used in a data processing system that can be associated with a bed system, including those described above with respect to FIGS. 1-3. In this example, the user account cloud service 410*c* is configured to record a list of users and to identify other data related to those users.

The user account cloud service 410*c* is shown with a network interface 1400, a communication manager 1402, server hardware 1404, and server system software 1406. In addition, the user account cloud service 410*c* is shown with a user identification module 1408, a purchase history module 1410, an engagement module 1412, and an application usage history module 1414.

The user identification module 1408 can include, or reference, data related to users of beds with associated data processing systems. For example, the users can include customers, owners, or other users registered with the user account cloud service 410*a* or another service. Each user can have, for example, a unique identifier, and user credentials, demographic information, or any other technologically appropriate information.

The purchase history module 1410 can include, or reference, data related to purchases by users. For example, the purchase data can include a sale's contact information, billing information, and salesperson information. Additionally, an index or indexes stored by the user account cloud service 410*c* can identify users that are associated with a purchase.

The engagement 1412 can track user interactions with the manufacturer, vendor, and/or manager of the bed and or cloud services. This engagement data can include communications (e.g., emails, service calls), data from sales (e.g., sales receipts, configuration logs), and social network interactions.

The usage history module 1414 can contain data about user interactions with one or more applications and/or remote controls of a bed. For example, a monitoring and configuration application can be distributed to run on, for example, computing devices 412. This application can log and report user interactions for storage in the application usage history module 1414. Additionally, an index or indexes stored by the user account cloud service 410*c* can identify users that are associated with each log entry.

Figure 15:
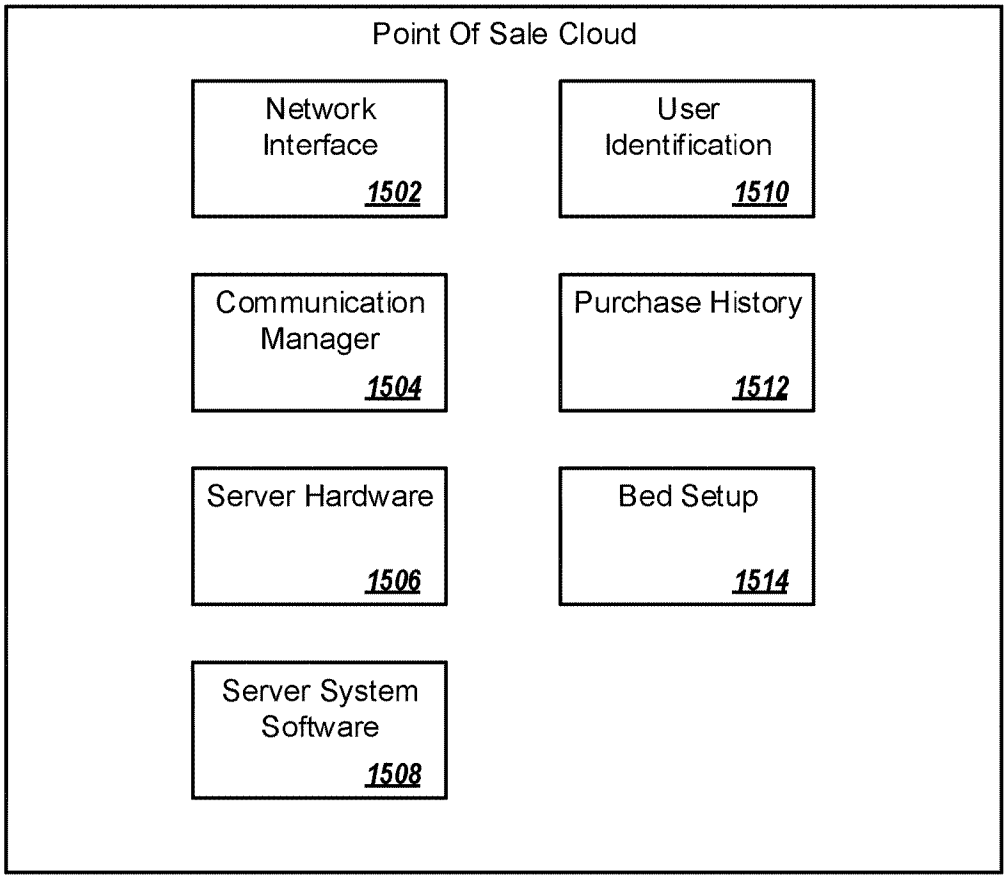

FIG. 15 is a block diagram of an example point of sale cloud service 1500 that can be used in a data processing system that can be associated with a bed system, including those described above with respect to FIGS. 1-3. In this example, the point of sale cloud service 1500 is configured to record data related to users' purchases.

The point of sale cloud service 1500 is shown with a network interface 1502, a communication manager 1504, server hardware 1506, and server system software 1508. In addition, the point of sale cloud service 1500 is shown with a user identification module 1510, a purchase history module 1512, and a setup module 1514.

The purchase history module 1512 can include, or reference, data related to purchases made by users identified in the user identification module 1510. The purchase information can include, for example, data of a sale, price, and location of sale, delivery address, and configuration options selected by the users at the time of sale. These configuration options can include selections made by the user about how they wish their newly purchased beds to be setup and can include, for example, expected sleep schedule, a listing of peripheral sensors and controllers that they have or will install, etc.

The bed setup module 1514 can include, or reference, data related to installations of beds that users' purchase. The bed setup data can include, for example, the date and address to which a bed is delivered, the person that accepts delivery, the configuration that is applied to the bed upon delivery, the name or names of the person or people who will sleep on the bed, which side of the bed each person will use, etc.

Data recorded in the point of sale cloud service 1500 can be referenced by a user's bed system at later dates to control functionality of the bed system and/or to send control signals to peripheral components according to data recorded in the point of sale cloud service 1500. This can allow a salesperson to collect information from the user at the point of sale that later facilitates automation of the bed system. In some examples, some or all aspects of the bed system can be automated with little or no user-entered data required after the point of sale. In other examples, data recorded in the point of sale cloud service 1500 can be used in connection with a variety of additional data gathered from user-entered data.

Figure 16:
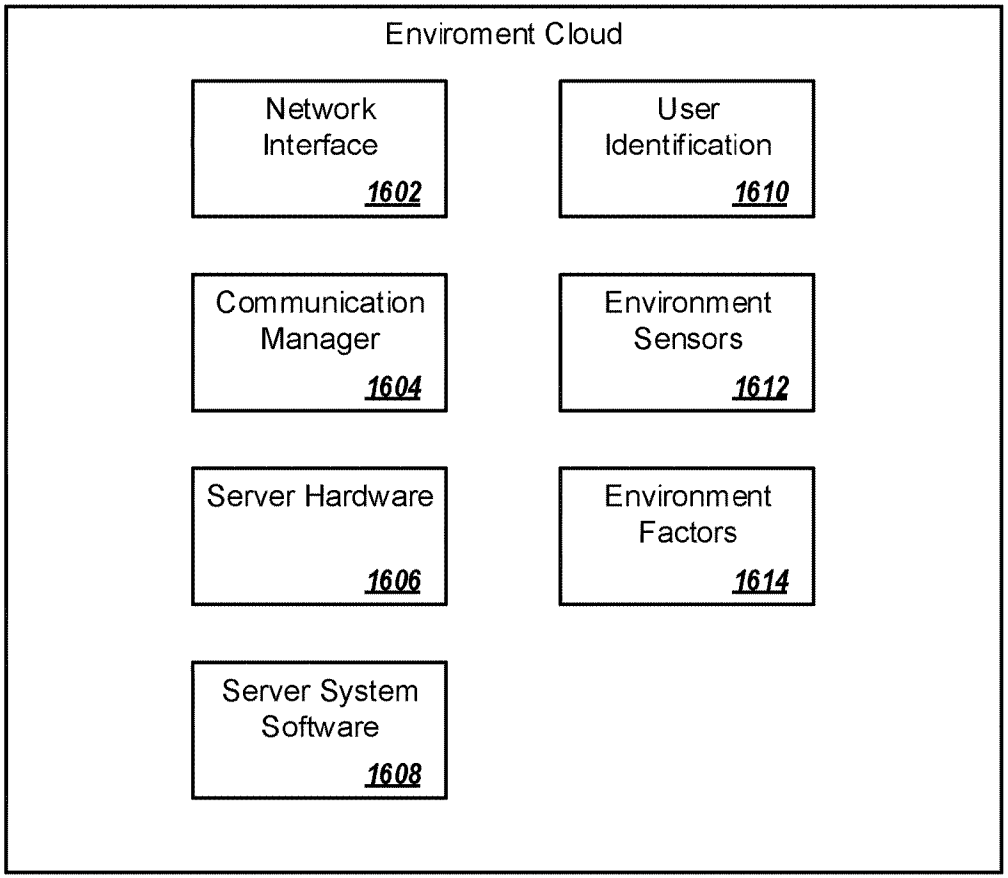

FIG. 16 is a block diagram of an example environment cloud service 1600 that can be used in a data processing system that can be associated with a bed system, including those described above with respect to FIGS. 1-3. In this example, the environment cloud service 1600 is configured to record data related to users' home environment.

The environment cloud service 1600 is shown with a network interface 1602, a communication manager 1604, server hardware 1606, and server system software 1608. In addition, the environment cloud service 1600 is shown with a user identification module 1610, an environmental sensor module 1612, and an environmental factors module 1614.

The environmental sensors module 1612 can include a listing of sensors that users' in the user identification module 1610 have installed in their bed. These sensors include any sensors that can detect environmental variables—light sensors, noise sensors, vibration sensors, thermostats, etc. Additionally, the environmental sensors module 1612 can store historical readings or reports from those sensors.

The environmental factors module 1614 can include reports generated based on data in the environmental sensors module 1612. For example, for a user with a light sensor with data in the environment sensors module 1612, the environmental factors module 1614 can hold a report indicating the frequency and duration of instances of increased lighting when the user is asleep.

In the examples discussed here, each cloud service 410 is shown with some of the same components. In various configurations, these same components can be partially or wholly shared between services, or they can be separate. In some configurations, each service can have separate copies of some or all of the components that are the same or different in some ways. Additionally, these components are only supplied as illustrative examples. In other examples each cloud service can have different number, types, and styles of components that are technically possible.

Figure 17:
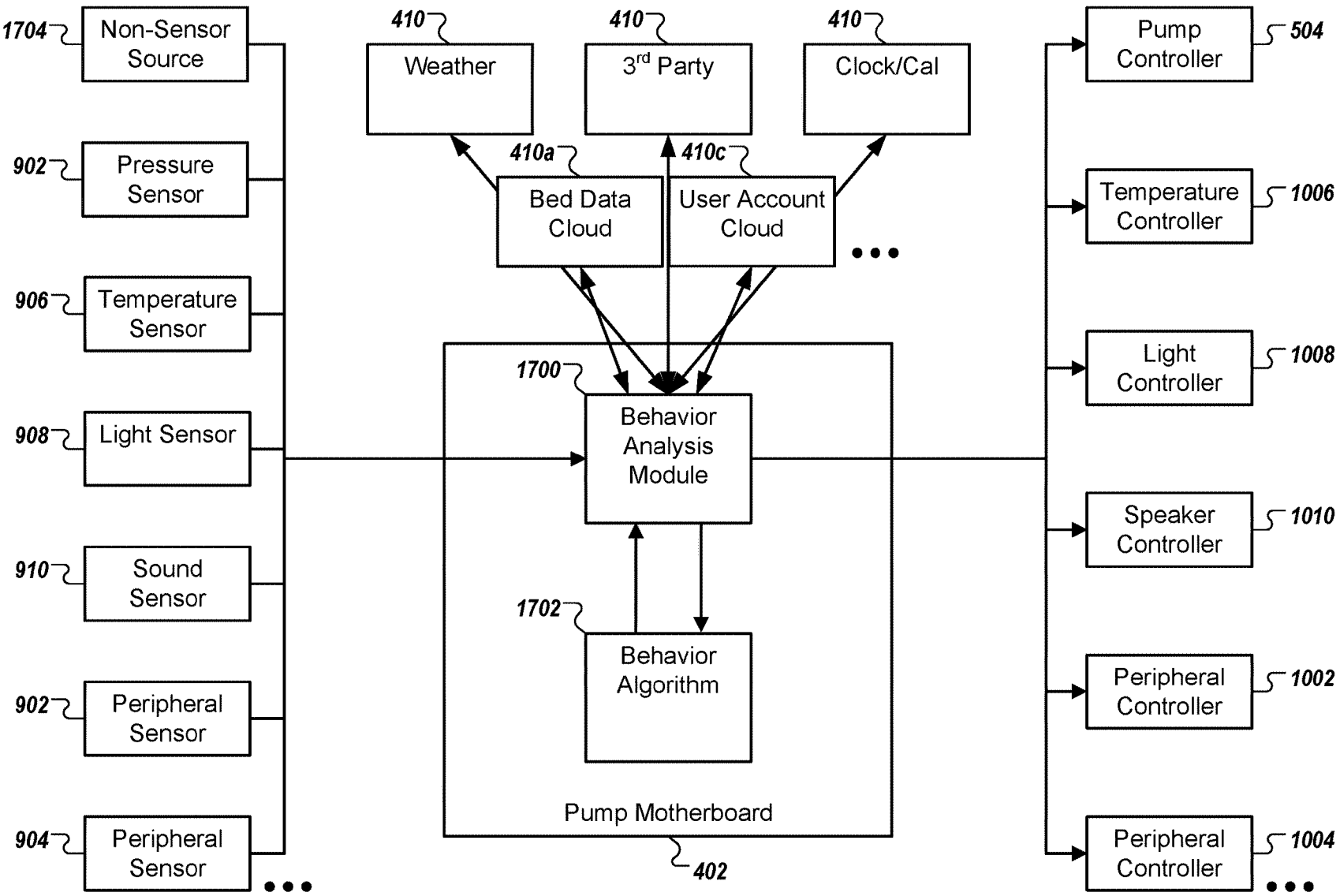
FIG. 17 is a block diagram of an example of using a data processing system that can be associated with a bed to automate peripherals around the bed.

FIG. 17 is a block diagram of an example of using a data processing system that can be associated with a bed (such as a bed of the bed systems described herein) to automate peripherals around the bed. Shown here is a behavior analysis module 1700 that runs on the pump motherboard 402. For example, the behavior analysis module 1700 can be one or more software components stored on the computer memory 512 and executed by the processor 502. In general, the behavior analysis module 1700 can collect data from a wide variety of sources (e.g., sensors, non-sensor local sources, cloud data services) and use a behavioral algorithm 1702 to generate one or more actions to be taken (e.g., commands to send to peripheral controllers, data to send to cloud services). This can be useful, for example, in tracking user behavior and automating devices in communication with the user's bed.

The behavior analysis module 1700 can collect data from any technologically appropriate source, for example, to gather data about features of a bed, the bed's environment, and/or the bed's users. Some such sources include any of the sensors of the sensor array 406. For example, this data can provide the behavior analysis module 1700 with information about the current state of the environment around the bed. For example, the behavior analysis module 1700 can access readings from the pressure sensor 902 to determine the pressure of an air chamber in the bed. From this reading, and potentially other data, user presence in the bed can be determined. In another example, the behavior analysis module can access a light sensor 908 to detect the amount of light in the bed's environment.

Similarly, the behavior analysis module 1700 can access data from cloud services. For example, the behavior analysis module 1700 can access the bed cloud service 410*a* to access historical sensor data 1212 and/or advanced sleep data 1214. Other cloud services 410, including those not previously described can be accessed by the behavior analysis module 1700. For example, the behavior analysis module 1700 can access a weather reporting service, a 3rd party data provider (e.g., traffic and news data, emergency broadcast data, user travel data), and/or a clock and calendar service.

Similarly, the behavior analysis module 1700 can access data from non-sensor sources 1704. For example, the behavior analysis module 1700 can access a local clock and calendar service (e.g., a component of the motherboard 402 or of the processor 502).

The behavior analysis module 1700 can aggregate and prepare this data for use by one or more behavioral algorithms 1702. The behavioral algorithms 1702 can be used to learn a user's behavior and/or to perform some action based on the state of the accessed data and/or the predicted user behavior. For example, the behavior algorithm 1702 can use available data (e.g., pressure sensor, non-sensor data, clock and calendar data) to create a model of when a user goes to bed every night. Later, the same or a different behavioral algorithm 1702 can be used to determine if an increase in air chamber pressure is likely to indicate a user going to bed and, if so, send some data to a third-party cloud service 410 and/or engage a peripheral controller 1002.

In the example shown, the behavioral analysis module 1700 and the behavioral algorithm 1702 are shown as components of the motherboard 402. However, other configurations are possible. For example, the same or a similar behavioral analysis module and/or behavior algorithm can be run in one or more cloud services, and the resulting output can be sent to the motherboard 402, a controller in the controller array 408, or to any other technologically appropriate recipient.

Figure 18:
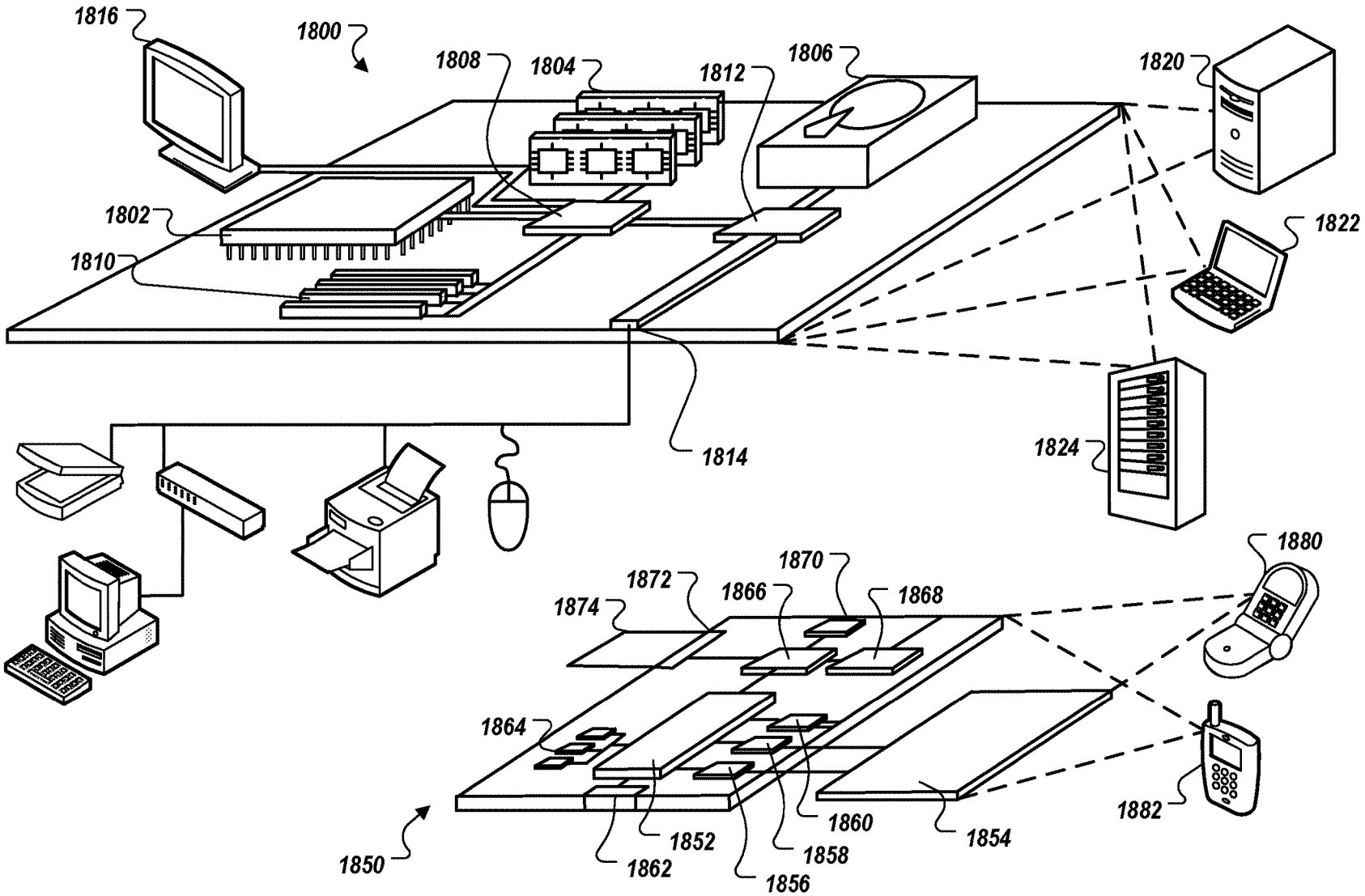
FIG. 18 is a schematic diagram that shows an example of a computing device and a mobile computing device.

FIG. 18 shows an example of a computing device 1800 and an example of a mobile computing device that can be used to implement the techniques described here. The computing device 1800 is intended to represent various forms of digital computers, such as laptops, desktops, workstations, personal digital assistants, servers, blade servers, mainframes, and other appropriate computers. The mobile computing device is intended to represent various forms of mobile devices, such as personal digital assistants, cellular telephones, smart-phones, and other similar computing devices. The components shown here, their connections and relationships, and their functions, are meant to be exemplary only, and are not meant to limit implementations of the inventions described and/or claimed in this document.

The computing device 1800 includes a processor 1802, a memory 1804, a storage device 1806, a high-speed interface 1808 connecting to the memory 1804 and multiple high-speed expansion ports 1810, and a low-speed interface 1812 connecting to a low-speed expansion port 1814 and the storage device 1806. Each of the processor 1802, the memory 1804, the storage device 1806, the high-speed interface 1808, the high-speed expansion ports 1810, and the low-speed interface 1812, are interconnected using various busses, and can be mounted on a common motherboard or in other manners as appropriate. The processor 1802 can process instructions for execution within the computing device 1800, including instructions stored in the memory 1804 or on the storage device 1806 to display graphical information for a GUI on an external input/output device, such as a display 1816 coupled to the high-speed interface 1808. In other implementations, multiple processors and/or multiple buses can be used, as appropriate, along with multiple memories and types of memory. Also, multiple computing devices can be connected, with each device providing portions of the necessary operations (e.g., as a server bank, a group of blade servers, or a multi-processor system).

The memory 1804 stores information within the computing device 1800. In some implementations, the memory 1804 is a volatile memory unit or units. In some implementations, the memory 1804 is a non-volatile memory unit or units. The memory 1804 can also be another form of computer-readable medium, such as a magnetic or optical disk.

The storage device 1806 is capable of providing mass storage for the computing device 1800. In some implementations, the storage device 1806 can be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product can also contain instructions that, when executed, perform one or more methods, such as those described above. The computer program product can also be tangibly embodied in a computer- or machine-readable medium, such as the memory 1804, the storage device 1806, or memory on the processor 1802.

The high-speed interface 1808 manages bandwidth-intensive operations for the computing device 1800, while the low-speed interface 1812 manages lower bandwidth-intensive operations. Such allocation of functions is exemplary only. In some implementations, the high-speed interface 1808 is coupled to the memory 1804, the display 1816 (e.g., through a graphics processor or accelerator), and to the high-speed expansion ports 1810, which can accept various expansion cards (not shown). In the implementation, the low-speed interface 1812 is coupled to the storage device 1806 and the low-speed expansion port 1814. The low-speed expansion port 1814, which can include various communication ports (e.g., USB, Bluetooth, Ethernet, wireless Ethernet) can be coupled to one or more input/output devices, such as a keyboard, a pointing device, a scanner, or a networking device such as a switch or router, e.g., through a network adapter.

The computing device 1800 can be implemented in a number of different forms, as shown in the figure. For example, it can be implemented as a standard server 1820, or multiple times in a group of such servers. In addition, it can be implemented in a personal computer such as a laptop computer 1822. It can also be implemented as part of a rack server system 1824. Alternatively, components from the computing device 1800 can be combined with other components in a mobile device (not shown), such as a mobile computing device 1850. Each of such devices can contain one or more of the computing device 1800 and the mobile computing device 1850, and an entire system can be made up of multiple computing devices communicating with each other.

The mobile computing device 1850 includes a processor 1852, a memory 1864, an input/output device such as a display 1854, a communication interface 1866, and a transceiver 1868, among other components. The mobile computing device 1850 can also be provided with a storage device, such as a micro-drive or other device, to provide additional storage. Each of the processor 1852, the memory 1864, the display 1854, the communication interface 1866, and the transceiver 1868, are interconnected using various buses, and several of the components can be mounted on a common motherboard or in other manners as appropriate.

The processor 1852 can execute instructions within the mobile computing device 1850, including instructions stored in the memory 1864. The processor 1852 can be implemented as a chipset of chips that include separate and multiple analog and digital processors. The processor 1852 can provide, for example, for coordination of the other components of the mobile computing device 1850, such as control of user interfaces, applications run by the mobile computing device 1850, and wireless communication by the mobile computing device 1850.

The processor 1852 can communicate with a user through a control interface 1858 and a display interface 1856 coupled to the display 1854. The display 1854 can be, for example, a TFT (Thin-Film-Transistor Liquid Crystal Display) display or an OLED (Organic Light Emitting Diode) display, or other appropriate display technology. The display interface 1856 can comprise appropriate circuitry for driving the display 1854 to present graphical and other information to a user. The control interface 1858 can receive commands from a user and convert them for submission to the processor 1852. In addition, an external interface 1862 can provide communication with the processor 1852, so as to enable near area communication of the mobile computing device 1850 with other devices. The external interface 1862 can provide, for example, for wired communication in some implementations, or for wireless communication in other implementations, and multiple interfaces can also be used.

The memory 1864 stores information within the mobile computing device 1850. The memory 1864 can be implemented as one or more of a computer-readable medium or media, a volatile memory unit or units, or a non-volatile memory unit or units. An expansion memory 1874 can also be provided and connected to the mobile computing device 1850 through an expansion interface 1872, which can include, for example, a SIMM (Single In Line Memory Module) card interface. The expansion memory 1874 can provide extra storage space for the mobile computing device 1850, or can also store applications or other information for the mobile computing device 1850. Specifically, the expansion memory 1874 can include instructions to carry out or supplement the processes described above, and can include secure information also. Thus, for example, the expansion memory 1874 can be provide as a security module for the mobile computing device 1850, and can be programmed with instructions that permit secure use of the mobile computing device 1850. In addition, secure applications can be provided via the SIMM cards, along with additional information, such as placing identifying information on the SIMM card in a non-hackable manner.

The memory can include, for example, flash memory and/or NVRAM memory (non-volatile random access memory), as discussed below. In some implementations, a computer program product is tangibly embodied in an information carrier. The computer program product contains instructions that, when executed, perform one or more methods, such as those described above. The computer program product can be a computer- or machine-readable medium, such as the memory 1864, the expansion memory 1874, or memory on the processor 1852. In some implementations, the computer program product can be received in a propagated signal, for example, over the transceiver 1868 or the external interface 1862.

The mobile computing device 1850 can communicate wirelessly through the communication interface 1866, which can include digital signal processing circuitry where necessary. The communication interface 1866 can provide for communications under various modes or protocols, such as GSM voice calls (Global System for Mobile communications), SMS (Short Message Service), EMS (Enhanced Messaging Service), or MMS messaging (Multimedia Messaging Service), CDMA (code division multiple access), TDMA (time division multiple access), PDC (Personal Digital Cellular), WCDMA (Wideband Code Division Multiple Access), CDMA2000, or GPRS (General Packet Radio Service), among others. Such communication can occur, for example, through the transceiver 1868 using a radio-frequency. In addition, short-range communication can occur, such as using a Bluetooth, WiFi, or other such transceiver (not shown). In addition, a GPS (Global Positioning System) receiver module 1870 can provide additional navigation- and location-related wireless data to the mobile computing device 1850, which can be used as appropriate by applications running on the mobile computing device 1850.

The mobile computing device 1850 can also communicate audibly using an audio codec 1860, which can receive spoken information from a user and convert it to usable digital information. The audio codec 1860 can likewise generate audible sound for a user, such as through a speaker, e.g., in a handset of the mobile computing device 1850. Such sound can include sound from voice telephone calls, can include recorded sound (e.g., voice messages, music files, etc.) and can also include sound generated by applications operating on the mobile computing device 1850.

The mobile computing device 1850 can be implemented in a number of different forms, as shown in the figure. For example, it can be implemented as a cellular telephone 1880. It can also be implemented as part of a smart-phone 1882, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term machine-readable signal refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network (LAN), a wide area network (WAN), and the Internet.

The computing system can include clients and servers. A client and server are generally remote from each other and typically interact through a communication network. The relationship of client and server arises by virtue of computer programs running on the respective computers and having a client-server relationship to each other.

Figure 19:
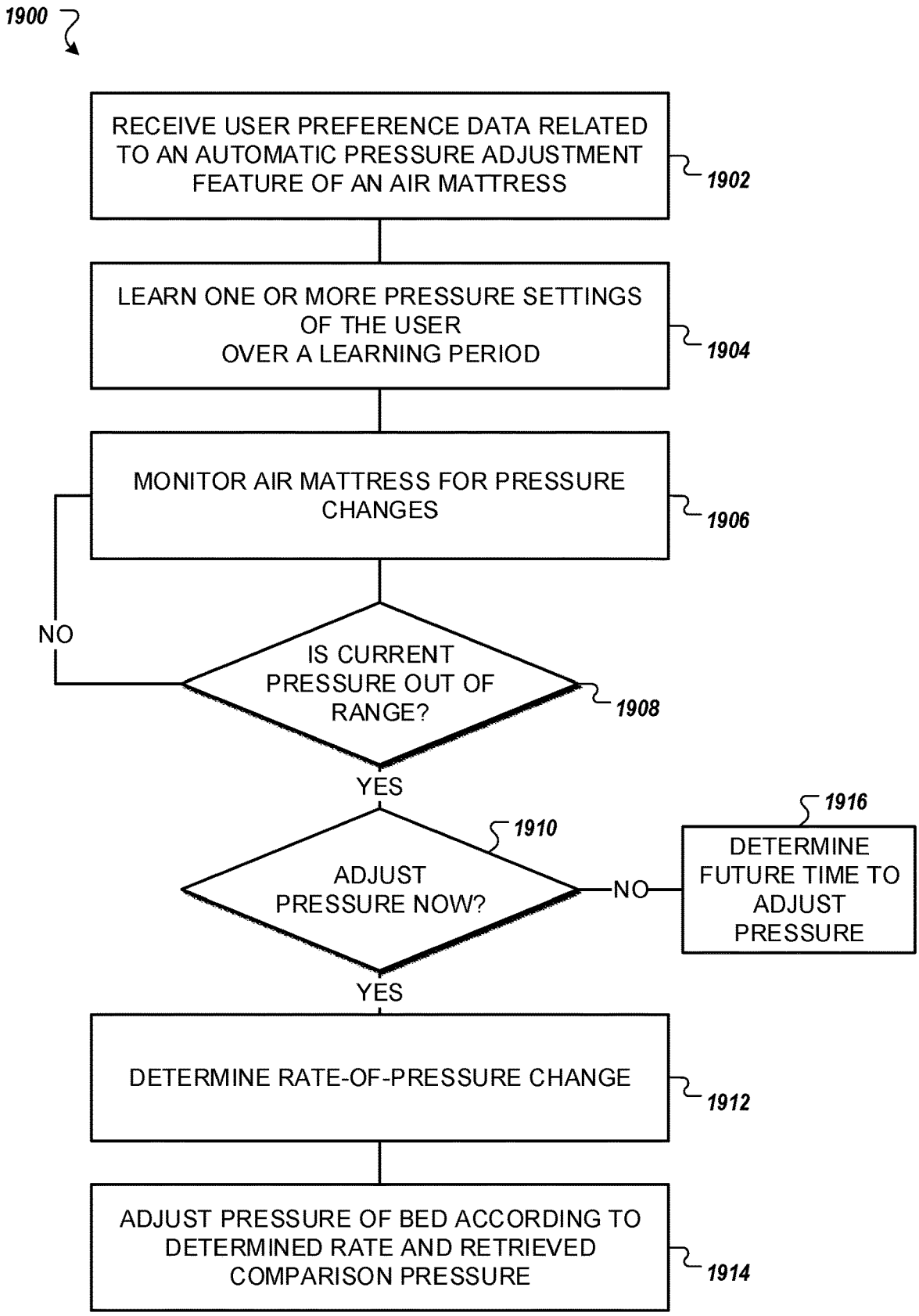
FIG. 19 is a flowchart of methods to adjust the pressure of an air mattress, according to various examples.

FIG. 19 is a flowchart of method 1900 to monitor and adjust pressure of an air mattress, according to various examples. For labeling purposes, and not by way of limitation, method 1900 is referred to herein as an "auto-adjust" method or feature. While many of the operations of method 1900 are described as being performed on data processing system 400, other components may be used. For example, the control box 124 can store the preferences and determine if the auto-adjust feature should be engaged as further described below. In various examples, data processing system 400 can act as a relay of the preferences as described previously.

At block 1902, in various examples, user preferences related to the auto-adjust method are received at data processing system 400. The preferences may be received from one or more of remotes 122, the computing device 414, or a cloud service 410. For example, using an application running on the computing device 414, a user interface (UI) may be presented to the user. The UI may include input indicia (check boxes, radio buttons, input forms, etc.) for the preferences related to the auto-adjust method. A user may interact (e.g., click, activate) with the input indicia to set the preferences. The preferences may be stored in a storage device of the computing device 414 and/or be transmitted to the pump motherboard 402 for storage, such as within a memory 512. In various examples, the preferences may be stored in a database (relational, non-relational, flat file, etc.) or in a structured file (e.g., XML), for example in a cloud service 410 such as the device manager 1210 of the bed data cloud 410*a*. The preferences may also have default, pre-set values if the user does not input a value. In various examples, not all of the preferences are shown to a user.

In various examples, there may be a global enablement preference for the auto-adjust feature. In an example, the enabling preference is a Boolean representing the user's preference to use the auto-adjust feature in any context. For example, if the preference is not set, the air mattress system may forego adjusting the pressure except when manually adjusted by a user control. The global enablement preference may also allow the user to select between an option that utilizes pre-set user preferences for pressure adjustment and an option that utilizes a "learning" procedure as described in further detail below.

In various examples, in addition to a global enablement preference, there may be sub-preferences of when automatic adjustments may occur. These may include, but are not limited to, a presence preference, a sleep cycle preference, a sleep position preference, and a time preference.

While multiple preferences are described, various examples may use less than all the preferences. For example, only the enabling preference may be used. If the enabling preference indicates that the user does not want to use the auto-adjust feature, one or more of the remaining preferences may not be shown or not be set (e.g., shown as dimmed options) by the user.

In some examples, the presence preference indicates when automatic pressure adjustments may be made with respect to the presence of a person on the air mattress. For example, there may be an on-bed adjustment preference and an off-bed adjustment preference that when set indicate whether pressure adjustments may be made to the air mattress when someone is on and off the bed, respectively.

In some examples, the sleep cycle preference indicates when automatic pressure adjustments may be made with respect to the current sleep state of a user. For example, a preference may be set that indicates that changes may be made when the user is on the bed, but not currently asleep. Other preferences may include only changing the pressure when the user is in a certain sleep state (e.g. REM or deep sleep), or in a certain sleep position. A preference may be displayed for each stage of sleep and non-sleep to allow the user greater flexibility of when pressure adjustments may occur.

In some examples, the time preference may be set by a user to indicate one or more time periods of day (e.g. predefined time) when the auto-adjust feature can or cannot be engaged. For example, the user may indicate that from 9:00 AM to 5:00 PM the auto-adjust feature may be used. Thus, if during the set time period other auto-adjust conditions are met (further discussed below), then the auto-adjust feature may be engaged. If the conditions are otherwise met, but the current time of day is not within the user's defined period, auto-adjustment may not occur.

In various examples, one or more pressure settings of the air mattress can be pre-set by the user and stored in memory, including, but not limited to, the user's preferred pressure setting for each of one or more sleeping positions, such as when the user is lying on his or her back, side, or stomach. For example, a user may indicate, with a numerical value, a desired firmness setting to be implemented when the user sleeps on his or her back, a second desired firmness setting to be implemented when the user sleeps on his or her side, and a third desired firmness setting to be implemented when the user sleeps on his or her stomach. Instead of using default, pre-set values or user-defined preferences.

In various examples, the system can be configured to automatically determine what sleeping position a user is in based on measurements from one or more of the pressure sensor, the motion sensor, or the temperature sensor. As noted above, a pressure sensor (e.g., pressure sensor 602) can be sufficiently sensitive so that the data processing system 400 can determine motion by the user. The pressure sensor and the data processing system 400 can also be configured to determine which position the user is in. For example, in general, when a user changes from lying on his or her back to lying on his or her side, there is a pressure change in the air chambers associated with that, typically an increase in pressure because the user's shoulder tends to push down with more force into the bed when the user is lying on his or her side. The determination of whether a user is lying on his or her back, side, or front can be determined based on historical data (e.g., a database compiled by the system manufacturer), or a user can "teach" the system when he or she is lying in each position. For example, the system can be configured to go into a specific learning mode that instructs the user to lie on his or her back for a specified period while the system measures the pressure associated with the user on his or her back, then shift to his or her side (or front) for another period of time while the system measures the pressure associated with the user on his or her side, and then shift to his or her front and measure the pressure associated with the user on his or her front. The historical data base or the user-specific data regarding sleep positions, or both, can be stored in a memory of the system for later access.

The system can also utilize a "learning" process to automatically specify various pressure settings of the air mattress when the user sleeps on his or her back, side, or stomach, respectively. See, for example, FIG. 17. The automatic pressure settings can be set in order for the user to more easily achieve a particular sleep state (e.g., REM sleep or deep sleep) at a particular time or range of times. For example, as described above, the data processing system 400 can determine if a user is sleeping on his or her front, side, or back, and then can modify the pressure in the air chamber or chambers over time and record the effect on the user's sleep state (e.g., if the pressure setting improves the user's sleep, such as by allowing the user to reach REM sleep more easily). The system can be configured to relatively continuously experiment with pressure settings over time (if allowed by the user) in order to learn the most effective setting for each sleep position to achieve a desired sleep state for the user (e.g., REM sleep or deep sleep). The system can repeat this learning experimentation for each sleep position.

In yet another example, the data processing system 400 can be configured to continually monitor the user's sleep state (e.g., by measuring and analyzing heart rate, respiration rate, and motion, as described above), and continuously or semi-continuously modifying the pressure setting within the air chamber or chambers based on the monitored sleep state, e.g., as a feedback loop.

The sleep state that the system will attempt to achieve for the user can depend on specific parameters provided by the user, such as the time of night. The user can set a time range for which one or more sleep states are desired, and the system can adjust the pressure setting to achieve that sleep state. For example, the user can indicate that from 10:00 PM to 5:00 AM, an REM sleep state is preferred and the system can adjust the pressure in the air chamber (or the temperature experienced by the user) to optimize the user's ability to achieve REM sleep (e.g., based on one or more of the user's sleeping position, the user's entered preferences, the learned settings, and a feedback based adjustment). In another example, the user can select a particular wake-up time, or range of wake-up times, and the system can adjust the pressure or temperature, or both, to gradually wake the user up at the desired time. The system can also be configured to determine, based on the user's heart rate, respiration rate, and movement, when the user is at an optimized point in his or her sleep cycle for waking up (within the user's selected wake-up time range) and attempt to wake the user up at that time. The system can also be in communication with another device, such as an alarm or a mobile device, to initiate an alarm (such as an alarm sound) when the user is at the optimized wake-up point.

Similar configuration of the system can be made for adjusting temperature, including the user providing a preferred temperature for certain types of sleep or certain times and the system learning what temperature settings can provide for a particular sleep state (e.g., at a particular time).

In various examples, one or more pressure settings of the air mattress can be learned for the user (1904). The learned pressures may be used to determine if adjustments should be made to the pressure level in the air mattress system customized for the user's behavior, environment, sleeping position (e.g., back or side), or other sleeping preferences. For example, a user may initially indicate, with a numerical value, a desired firmness setting. At this time, the air mattress system may store the actual PSI level of the air mattress as a base pressure level. Over a period of time(s) the pressure in the air mattress may be monitored (e.g., via the transducer of the air mattress) to determine changes to the base pressure level.

The learned pressure levels may be collected and organized in a variety of matters. For example, the learned pressure levels may be correlated with a time of the day, presence of a person on the air mattress, position of the person, sleep state, quality or length of sleep state, or combinations thereof. The learned pressure levels may be taken over a learning period of a number of days or other period (e.g., one or more weeks) to obtain average pressure levels based on the above organizations. A table, file, or other data structure may be stored that correlates the time with a pressure level.

In some examples, a series of pressure levels may be taken over pre-set times during the day. For example, a pressure setting may be taken every 6 hours (e.g., midnight, 6:00 AM, noon, 6:00 PM). The taken pressure settings can be stored in a table or other data structure and correlated with the time. Thus, after three full days of monitoring at six-hour intervals, there would be 12 total pressure readings. For each of the pre-set times, the pressure readings at that time can be averaged to determine an average learned pressure for that pre-set time.

Other variations of averaging may also be used. For example, there may be different pressure levels based on if someone is on the bed or not. Thus, a pressure reading at noon one day may be different than a reading taken at noon on the second day. To account for such variations, pressure readings taken at the pre-set times may be clustered or bucketed into groups which may serve as a proxy for presence in the bed. For example, the pressure readings may be grouped into two groups. As a basis of determining which group a pressure reading is placed in, the pressure reading may be compared to the base pressure reading. Accordingly, if a taken pressure reading is within a threshold (e.g., 1 PSI), the pressure reading may be grouped with the base pressure reading. If the pressure reading is outside of the threshold it may be placed into a second group. Consequently, at the end of the learning period, for each pre-set time there may be two averaged pressure readings. More than two groups of pressure readings may also be used without departing the scope of this disclosure.

In some examples, the pressure readings can be grouped according to the presence of a person in the bed. For example, during the learning period at each of the pre-set times, data processing system 400 may receive an indication that nobody is on an air mattress. The indication may be received from a variety of sources. For example, pressure sensor 602 may monitor the pressure of the air mattress and if a pressure change exceeds a threshold, pump controller 504 may classify the change as an "empty bed" event—the label "empty bed" is used for illustration purposes only and other terms may be used without departing from the scope of this disclosure. In various examples, data processing system 400 may receive an indication from a cloud service 410, sensor of the sensor array 406, or computing device 414 that an "empty bed" has been detected. For example, the pressure readings from transducer 146 may be used to determine the presence of one or more people on the air mattress. Similarly, the pressure data may be transmitted to a cloud service 410. Based on the processing the cloud service 410 may transmit data back to data processing system 400 indicating whether or not a person is believed to be on the air mattress.

In an example, data processing system 400 may detect user presence via gross pressure changes. For example, the pressure sensor 602 and/or pressure transducer 146 may be used to monitor the air pressure in the air mattress of a bed. If the user sits or lies down on the air mattress, the air pressure in the air mattress changes, e.g., increases, due to the additional weight of the user, which results in a gross pressure change. Data processing system 400 may determine whether the user is now on the bed based on the gross pressure change, e.g., over some time period. For example, by determining a rate of change of pressure, e.g., over one to ten minutes, and comparing the determined rate of change to a threshold value, data processing system 400 may determine whether the user is now on the bed.

In an example implementation, data processing system 400 may detect user presence using one or more temperature changes detected in the air mattress, on a surface of the mattress, or a combination of the two. The one or more temperature changes can be detected using one or more temperature sensors 906 positioned in, on, or nearby the mattress. The one or more temperature sensors 906 and the data processing system 400 may detect a rise in temperature, e.g., over a specified period of time, and determine that a user is present in the bed. For example, if data processing system 400 detects a rise in temperature and then determines that the detected rise in temperature was not caused by the system's temperature controller 1006, data processing system 400 may determine that the user is present. Any suitable temperature sensor can be used, as well as infrared camera technology configured to detect temperature variations at a particular point in time or over a specified period of time.

In an example implementation, data processing system 400 may detect user presence using motion detected in or on the mattress. Motion can be detected, for example, using one or more motion sensors (see, e.g., peripheral sensors 902 and 904) positioned in, on, or nearby the mattress. The motion sensors and the data processing system 400 may detect motion or a change in motion, e.g., over a specified period of time, and determine that a user is present in the bed. For example, if data processing system 400 detects motion or a change in motion attributable to a user and determines that the detected motion was not caused by the data processing system 400 (e.g., a peripheral controller 1002 engaging a vibration device, the pump controller 504 engaging), data processing system 400 may determine that the user is present. In various examples, motion can be detected using motion sensors in combination with one or more additional sensors, such as temperature sensors and pressure sensors. Alternatively, motion can be detected without the use of motion sensors and based solely on other sensed parameters, such as temperature, pressure, or a combination of sensed temperature and pressure.

The data processing system 400 can be configured to determine when a user is in a particular sleep state (such as rapid eye movement (REM) sleep, deep sleep, or restlessness). For example, as described above, the data processing system 400 can be configured to analyze readings from one or more sensors, such as a pressure sensor (e.g., pressure transducer) to determine a user's heart rate and respiration rate. The data processing system 400 can also analyze data from the pressure sensor, either alone or in combination with data from other sensors such as a motion sensor, to detect and analyze motion of the user on the bed. The data processing system 400 can be configured to recognize a particular sleep state based on one or more of the determined heart rate, respiration rate, and motion of the user. For example, when a user is in REM sleep, the heart rate and respiration rate are both substantially reduced compared to most other sleep states, including deep sleep that is not REM sleep. Users also tend to have no large muscle movement at all (other than the eyes). Thus, the data processing system 400 can be configured to recognize REM sleep by a heart rate below a REM heart rate threshold alone or in combination with a respiration rate below a REM respiration threshold, and/or in combination with a general lack of movement by the user. Techniques for monitoring a user's sleep using heart rate information, respiration rate information, and other user information are disclosed in U.S. Patent Application Publication No. 2010/0170043 to Steven J. Young et al., titled "APPARATUS FOR MONITORING VITAL SIGNS," the entire content of which is incorporated herein by reference.

In an example implementation, the data processing system 400 can execute instructions that cause a pressure sensor, such as the pressure transducer 146 or pressure sensor 602, to measure air pressure values at a predefined sample rate. The data processing system 400 can store the pressure signals in a memory device. Processing of the pressure signals can be performed by the data processing system 400, or at a location remote from the bed, e.g., at a cloud service 410 or elsewhere. Analyzing the pressure signals, as indicated above, the data processing system 400 can determine a user's sleep state, e.g., rapid eye movement ("REM") or non-rapid eye movement ("NREM"), by using one or more of the biometric parameters.

In some examples, a series of pressure levels can be taken during various sleep states of the user (e.g. REM, deep sleep, or restlessness). For example, a pressure setting may be taken when the user is determined to be in REM sleep or in REM sleep for a certain amount of time. The taken pressure settings may be stored in a table or other data structure and correlated with the sleep state. Thus, after a learning period, such as three full days of monitoring, there will be numerous pressure readings related to when the user was in REM sleep. The pressure readings at that time can be averaged to determine an average learned pressure for that sleep state in order to make pressure levels recommendations to the user.

As discussed above, preferences may be set so that the data processing system 400 will only allow pressure adjustments when the user is in a certain sleep state (e.g. REM or deep sleep). Similarly, preferences may be displayed for each stage of sleep and non-sleep to allow the user greater flexibility as to when pressure adjustments may occur. As also discussed above, pressure, temperature or motion detection can be used to determine whether a user is on or off of the bed, in addition to a position of the user on the bed. However, in various examples, temperature detection may additionally or alternatively be used to determine sleep state of one or more users. Particularly, body temperature changes can be correlated to the sleep state of users. In an example, when a user first lies down on the bed and his or her presence is detected via any suitable presence detection means (e.g., pressure, motion, or temperature), an initial body temperature measurement can be taken. As the user is lying on the bed, one or more temperature sensors can continuously or periodically monitor the temperature of the user (or the underlying mattress), and subsequently compare the temperature readings to a table or other data structure stored in memory that correlates user temperature with sleep state. When the system determines that the user is in a certain sleep state, based on the sensed temperature, then pressure adjustments can be made according to the preferences previously set by the user. A similar process can be used for a single user or multiple users of air bed system 10.

In an example, the average temperature of one or more users can be learned over time to increase the accuracy of the sleep state determination. Similar to the learned pressure measurements, the learned temperature measurements may be taken over a learning period of a number of days or other period (e.g., one or more weeks) to obtain average temperatures for the users, which can then be used as baselines for future sleep state determinations.

Based on one or more of the above methods of presence detection, a pressure reading at a pre-set time may be grouped into either a presence pressure reading or non-presence pressure reading. Accordingly, at the end of the learning period, the pressure readings may be averaged to come up with an "on-bed" average pressure reading and an "empty bed" pressure reading. More complex groupings may also be used. For example, for each pre-set time period there may be an "on-bed" average pressure reading and an "empty bed" pressure reading. Additional granularity may also be used with respect to the "on-bed" pressure readings. For example, different positions of a user may influence the pressure readings. Accordingly, data processing system 400 may receive an indication as to the position of a user (e.g., on back, on side) and determine average pressure readings for those positions. The position of the user can be determined by monitoring pressure, temperature, or motion of the user at one or more times and correlating the collected data with a series of user positions on the air mattress. In one exemplary system, the position of the user can be determined by monitoring temperature with a plurality of temperature sensors and analyzing the user's temperature profile on the air mattress.

In various examples, the pressure level of the air mattress can be monitored (1906). For example, after the learning period is over, pressure readings can be taken at the same times used during the learning period or at different times. In an example, the pressure is not monitored every day, but instead can be monitored every week, for some other period, or at other regular or irregular intervals. Each time a pressure reading is taken, it can be compared to the pressure levels taken during the learning period. As discussed above, the pressure readings can be correlated with different factors. Thus, the monitored pressure readings can be compared based on those same factors.

In some examples, when the pressure readings during the learning period are based on times of the day, the following process may be used. At one or more times of the day where there is a learned pressure reading, the current pressure reading may be retrieved. For example, at one of the pre-set times (e.g., noon), a pressure reading may be taken. The table or other data structure storing the learned pressure readings may be accessed to retrieve a comparison pressure reading from one or more stored learned pressure readings for the same pre-set time. A comparison may then be made between the current pressure reading and the comparison pressure reading. As discussed above, each time period may have more than one pressure reading. In such situations, the comparison pressure reading may be the stored pressure reading that is closest to the current pressure reading. In some examples, when the pressure readings during the learning period are based on presence of someone in the bed the following process may be used. At one or more times of the day where there is a learned pressure reading, the current pressure reading may be retrieved. In addition to the pressure, the presence of a person in the bed may be determined as discussed above. Additionally or alternatively, the position of the person may be determined as also discussed above. The table or other data structure storing the learned pressure readings may be accessed to retrieve a comparison pressure reading based on the one or more stored learned pressure readings for the same pre-set time and with the same presence or sleep position. A comparison may then be made between the current pressure reading and the comparison pressure reading.

In various embodiments, instead of taking pressure readings at the same times as the learning period, the pressure may be monitored at different times. In such scenarios, the current taken pressure reading may be compared to an average of the pressures during the learning period. For example, the stored pressure readings for all "empty bed" pressure readings may be averaged to determine an average "empty bed" pressure and similarly an "on-bed" average may be calculated. Additionally, as discussed above more granular pressure readings may be taken with respect to sleep cycle and sleep position. In such situations the comparison pressure reading may be based on the time and sleep cycle or sleep position as necessary.

After the current pressure reading has been taken, a determination may be made if the current pressure reading is out-of-range of an allowed pressure range (1908) or user pre-set pressure or firmness setting as discussed above. For example, a threshold may be stored on a storage device (e.g., computer memory 512). If the current pressure reading is farther away from the retrieved comparison pressure+/−the threshold (e.g., either too much or too little pressure) than the current pressure reading may be considered out-of-range. A similar comparison can be performed when using pre-set pressure or firmness settings. When it is has been determined that the current pressure reading is within range, flow may continue back to 1906 until the next pressure reading.

In addition to monitoring the pressure of the air mattress, the sleep position or the sleep state of the user, or both, can be monitored. The sleep position or the sleep state of the user can help to determine whether the pressure of the air mattress should be adjusted and the amount by which the pressure should be adjusted.

When it is has been determined that the current pressure is out-of-range, a determination may be made as to if an adjustment to the air mattress pressure should currently be made (1910). The decision may be based on one or more factors including, but not limited to, presence of someone on the air mattress, sleep cycle of a person, position of a person, and time of the day. For example, user preferences for the auto-adjust feature may be retrieved to determine the global enablement preference, presence preference, sleep cycle preference, sleep position preference, and time preference of the user. These preferences may be compared to the current time, presence status, sleep cycle, sleep position, and time as appropriate to determine if the user's preference indicates an adjustment may be made. In addition to the user's preferences, system preferences for the auto-adjust feature may also be retrieved (e.g., stored in computer memory 512) to determine if an adjustment should be made. In some instances, the system preferences may also indicate that pressure may only be decreased and not increased (or vice-versa) at certain times, sleep states, etc. When a user preference conflicts with a system preference, the user preference may take precedence. For example, if a system preference allows an adjustment at 9:00 AM, but the user preference indicates no adjustments should be made before 10:00 AM, no adjustment should be made.

In various examples, the determination whether an adjustment to the air mattress pressure should currently be made may be subject to pre-set conditions. The pre-set conditions can dictate, for example, that pressure changes can only be made when the user is in a certain state of sleep (i.e., deep sleep), in a certain sleep position, or after a certain period of time. By utilizing pre-set conditions, it can be possible to avoid making pressure changes due to potential user restlessness or quick changes in sleep position, such as from a back position to a side position and then again to the back position. In an example, the data processing system 400 or another suitable component can operate a time-out or delay feature to ensure that the user stays in the new sleep position for a certain period of time, thereby justifying a pressure change in the air mattress. Numerous pre-set conditions can be monitored and stored in memory, and the determination whether an adjustment to the air mattress pressure should be made may be subject to one or a combination of the pre-set conditions. In various examples, the pressure adjustment determination can be based solely on sleep state, solely on a time delay, or on both sleep state and a time delay. Under one exemplary scenario, the air mattress pressure can only be adjusted if the user moves from a first sleep position to a second sleep position and either remains in the second sleep position for a specified period of time or is detected to have fallen back into a certain sleep state, such as deep sleep.

In various examples, once it is determined that the system and user preferences allow an adjustment to be made, a rate-of-change (e.g., PSI/minute) may be determined to adjust the air mattress (1912) back to the retrieved comparison pressure. For example, when it has been determined that a person is sleeping the rate-of-change may be lower than if no one is on the bed. A table or other data structure may store the rate-of-change for the various permutations of time of day, presence of a person, sleep cycle of a person, and position of a person. The rate-of-change may also be a series of changes rather than a continuous change. For example, if a person is sleeping, small adjustments may be made over the course of two hours. In contrast, if the time is noon and no one is on the bed, the pump may increase the pressure back to the comparison pressure at the maximum rate available. In various examples, the pressure of the air mattress is adjusted at the determined rate-of-change (1914) to the retrieved comparison pressure.

In accordance with the present disclosure, when making automatic adjustments that correspond to a change in the sleep position of the user (i.e., a change compared to an initial or prior determined sleep position), the adjustment can be made based upon either user pre-set pressure values, learned pressure settings, or default, pre-set pressure values. For example, the default, pre-set pressure values may indicate a slight reduction in the pressure of the air mattress when it has been detected that the user has rolled from a back position or a stomach position to a side position. In accordance with the present disclosure, when making automatic adjustments that correspond to a change in the sleep position of the user, the adjustment can also be made based upon either user pre-set pressure values, learned pressure settings, or default, pre-set pressure values that correspond to the various sleep positions.

In various examples, when it is determined an adjustment may not be currently made, a future time may be determined to make an adjustment (1916). For example, if it is determined that the air mattress has too high of a pressure while a person is sleeping, and the user indicates no adjustments may be made while he or she is asleep, data processing system 400 may examine the user and system preferences to determine the next time an adjustment is allowed and schedule a pressure change at that time. For example, while the user is sleeping on the bed, the data processing system 400 may determine how much of a pressure change will be necessary when the user preferences allow for the pressure adjustment. Thus, when the user wakes up and is off of the bed, the adjustment can be viewed as time and flow based rather than pressure based. For example, if the data processing system 400 determines that the pressure should be increased by 2 PSI but the user preferences indicate that no adjustments may be made while asleep, then the system could wait until the user is no longer detected as present on the bed and the pump 20 could be turned on for a period of time equal to the amount of time it would have taken to increase the pressure by 2 PSI while the user was present on the bed.

In various examples, variations of the above method may be employed using a set schedule. For example, scheduled pressure changes may be made every Monday at 10:00 AM to adjust the air mattress back to an average pressure determined during the learning period. Then, during the night small adjustments may be made to lower the air pressure of the air mattress as the mattress increases temperature and thus pressure. By making at least one change weekly, the pressure of the air mattress may not get too far away from the pressure the user of the air mattress is accustomed to even if there is a mechanical failure in the air mattress.

Rather than making a change or adjustment to the pressure of the air mattress at a set time interval, such as once a week, the pressure of the air mattress can be constantly monitored and adjusted to maintain the desired pressure setting. As mentioned above, external factors such as body heat, room temperature, barometric pressure changes and the like may cause the actual pressure of the air mattress to vary from the desired pressure. In an example, the data processing system 400 or another suitable component can sample one or more pressure sensors on a periodic or constant basis to determine whether the current, actual pressure is substantially equivalent to the desired pressure at that time. When the system detects that the current, actual pressure varies from the desired pressure by at least a threshold amount, then the data processing system 400 may instruct the pump controller 504 to adjust the pressure of the air mattress back to the correct pressure, or within an acceptable range of the correct pressure.

As discussed above, the data processing system 400 can include a temperature controller 1006. In various examples, in addition to adjusting pressure of the air mattress in accordance with the previous examples, the temperature controller 1006 or another suitable component can be programmed to increase, decrease, or maintain the temperature of a user or the air mattress. Temperature can be sensed using any suitable temperature sensing means as discussed above. Further, temperature changes can be implemented via a pad placed on top of the mattress or incorporated into the mattress itself. In various examples, air may be pushed through the pad and vented to cool off a user of the bed, and the pad may include a heating element that may be used to keep the user warm. The temperature controller 1006 can receive temperature readings from the pad continuously or at select intervals.

In one example, the user can pre-select the desired temperature at one or more times during the night (or day). Thus, based on the user's input, a desired temperature profile can be pre-set such that the user will experience the desired temperature throughout a pre-defined sleep period. In another example, the user's sleep schedule can be "learned" using a process similar to that described above in the various pressure adjustment examples. A real time clock ("RTC") located, for example, in the motherboard 402 can be used during the learning process and to track the current time to determine when temperature adjustments should be made.

In an example, the system could learn over a period of time that the user typically goes to bed at 9:00 pm. Alternatively, the user could pre-set a bed time using preferences accessible via a menu. With a learned or pre-set bed time of 9:00 pm, the temperature controller 1006 can initiate adjustment of the air mattress to the desired temperature selected by the user prior to 9:00 pm, such as at about 8:30 pm. Thus, by the time the user enters the bed at about 9:00 pm, the bed will be at the desired sleep temperature. Throughout the night the temperature controller 1006 can initiate changes in temperature based on the pre-selected user input. Alternatively, upon learning the user's sleep schedule, the temperature can be automatically adjusted at specified times through the night. Sleep state can also be detected, as discussed above, and the temperature can be adjusted based upon the user's sleep state throughout the night. In an example, one hour before the scheduled or learned wake-up time of the user, the temperature controller 1006 can adjust the bed to a cooler temperature to help the user wake-up. Once the user gets out of bed, the temperature controller 1006 can turn off the pump, thermoelectric engine, or other temperature adjustment means to allow the bed to return to a natural temperature. In an example, any of the means referenced above for determining presence of an individual can be used to determine when the user gets out of bed.

Figure 20:
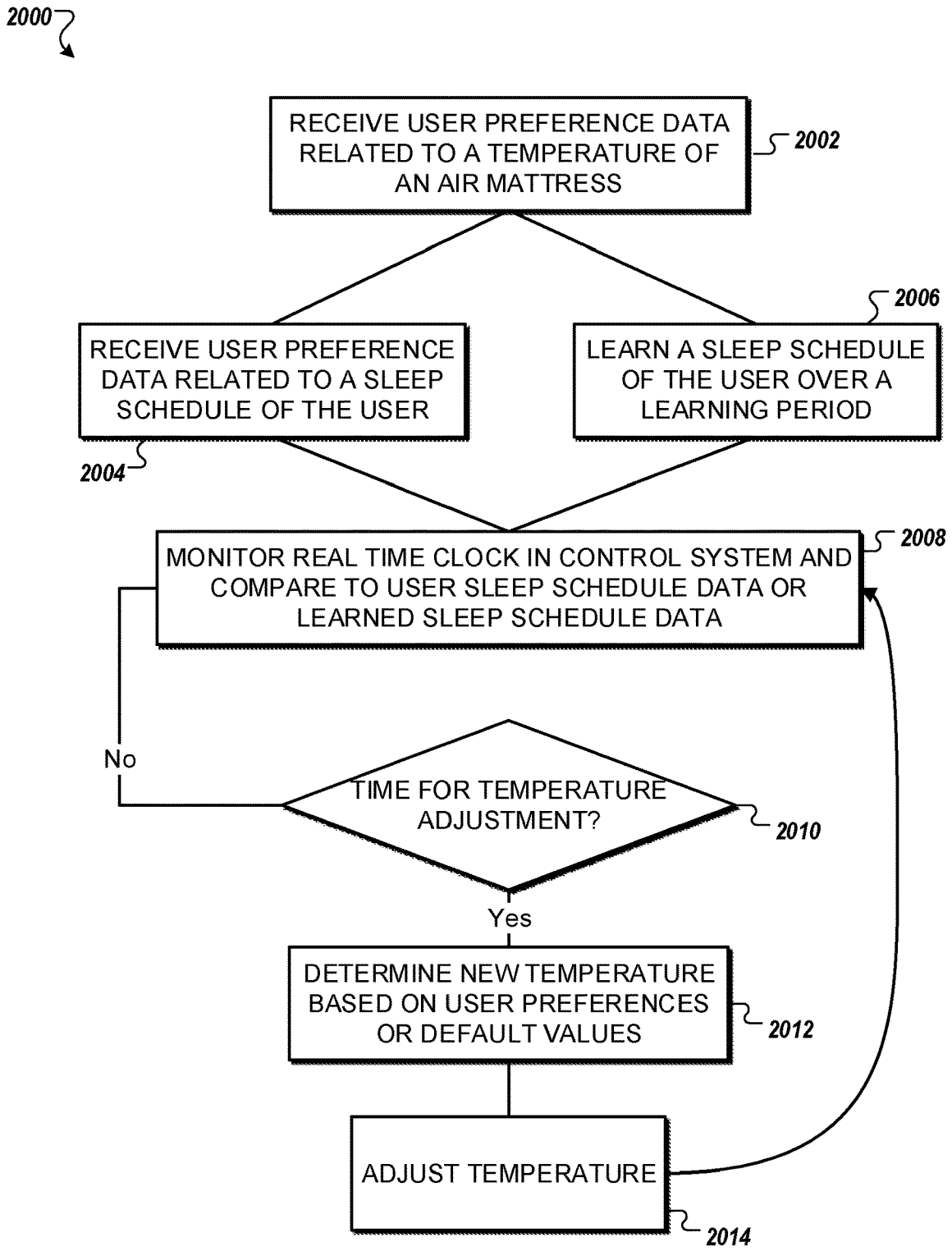
FIG. 20 is a flowchart of methods to adjust the temperature of an air mattress, according to various examples.

FIG. 20 is a flowchart of method 2000 to monitor and adjust temperature of an air mattress, according to various examples. For labeling purposes, and not by way of limitation, method 2000 is referred to herein as the "temperature-adjust" method or feature. While many of the operations of method 2000 are described as being performed on data processing system 400, other components may be used. For example, pump controller 504 may store the preferences and determine if the temperature-adjust feature should be engaged as further described below. In various examples, data processing system 400 acts as a relay of the preferences.

At block 2002, in various examples, user preferences related to the temperature-adjust method are received at data processing system 400. The preferences may be received from one or more of remotes 122, the computing device 414, or a cloud service 410. For example, using an application running on the computing device 414, a UI may be presented to the user. This may be the same UI as discussed above with respect to the auto-adjust feature or a different UI. The UI may include input indicia (check boxes, radio buttons, input forms, etc.) for the preferences related to the temperature-adjust method. A user may interact (e.g., click, activate) with the input indicia to set the preferences. Similar to the preferences discussed above with respect to the auto-adjust feature, the preferences associated with the temperature-adjust feature may be stored in a storage device of the data processing system 400 and/or be transmitted to the pump motherboard 402 for storage. In various examples, the preferences may be stored in a database (relational, non-relational, flat file, etc.) or in a structured file (e.g., XML), for example in a cloud service 410 such as the device manager 1210 of the bed data cloud 410*a*. The preferences may also have default, pre-set values if the user does not input a value.

Numerous options may be selected by the user to create an optimal temperature environment prior to falling asleep, while sleeping, and after waking up. For example, the user can select a temperature of the air mattress prior to going to bed such that, upon entry into the bed, the temperature will be at a desired level. The user can further select to adjust the temperature of the air mattress one or more times throughout the period of sleep (i.e., night) to optimize sleep quality. In an example, at a designated time prior to a scheduled wake-up, the user can select to adjust the temperature to a desired wake-up temperature. The wake-up temperature may be cooler than the sleeping temperature or temperatures.

One of the preferences or options that may be selected is whether to utilize user input data related to the sleep schedule of the user or a "learning" process similar to that described above with respect to the auto-adjust feature to learn the sleep schedule of the user over a learning period.

If the user elects to input data related to the typical or desired sleep schedule of the user, the method continues at block 2004 where the user can enter, for example, a typical sleep schedule for the user including at least a "go to bed" time and a "wake-up" time. Furthermore, different sleep schedules can be selected for different days of the week.

If the user elects to utilize the sleep schedule learning feature, the method continues at block 2006 where the user's sleep schedule is learned over a period of time, such as several days or weeks.

Regardless of whether the user elects to create a manual, customized sleep schedule or utilize the learning feature, the method continues at block 2008 where the RTC of the control system is monitored and compared to the manual user sleep schedule data or the learned sleep schedule data to determine, at block 2010, when it is time for a temperature adjustment. If it is determined that a temperature adjustment is not currently necessary based on the time comparison, then the method loops back to block 2008 where the time monitoring step continues. However, if at block 2010 it is determined that a temperature adjustment should be made, the method continues at block 2012 where the new temperature is determined based on user preferences or default values (in the case where the user has not specified a particular temperature). Finally, the method continues at block 2014 where the temperature of the air mattress is adjusted to the desired temperature.

Once the temperature has been adjusted to the desired temperature at block 2014, the method can return to block 2008 to monitor for further temperature adjustments.

What is claimed is:

1. A system comprising:

a bed having a mattress that is adjustable and configured to support a user during a sleep session;

a pressure sensor configured to sense user pressure on the mattress and to generate pressure readings;

a controller comprising one or more processors and memory, the controller configured to:

receive the pressure readings from the pressure sensor;

determine, from the pressure readings, an orientation of the user;

determine, from the pressure readings, a current sleep-state of the user occupying the bed;

determine that a desired sleep-state of the user is different than the current sleep-state;

access data defining a plurality of adjustment-allowed sleep-states that each define a sleep-state in which the user is occupying the bed and in which it has been identified that the mattress is permitted to be adjusted for the user;

responsive to a determination that the current sleep-state is one of the adjustment-allowed sleep-states while the user is occupying the bed:

select an adjustment to the mattress based on the determined orientation; and adjust the mattress according to the selected adjustment, having an effect of encouraging the user to transition to the desired sleep-state; and responsive to a determination that the sleep-state is not one of the adjustment-allowed sleep-states while the user is occupying the bed, not adjusting the mattress.

2. The system of claim 1, wherein to adjust the mattress according to the selected adjustment, the controller is further configured to:

issue a command to a pump that is in fluid communication with the mattress and that is configured to change air-pressure of the mattress.

3. The system of claim 1, wherein possible sleep-states include at least one of the group consisting of awake, Rapid Eye Movement (REM), deep sleep, light sleep, and restless.

4. The system of claim 1, wherein the determined orientation of the user is one of the group consisting of on-back, on-side, and on-stomach.

5. The system of claim 1, wherein the current sleep-state of the user occupying the bed is of the group consisting of rapid eye movement ("REM") and non-rapid eye movement ("NREM").

6. A controller comprising one or more processors and memory, the controller configured to:

receive pressure readings from a pressure sensor configured to sense user pressure on a mattress of a bed and to generate pressure readings, wherein the mattress is adjustable and configured to support a user during a sleep session;

determine, from the pressure readings, an orientation of the user;

determine, from the pressure readings, a current sleep-state of the user occupying the bed;

determine that a desired sleep-state of the user is different than the current sleep-state;

access data defining a plurality of adjustment-allowed sleep-states that each define a sleep-state in which the user is occupying the bed and in which it has been identified that the mattress is permitted to be adjusted for the user;

responsive to a determination that the current sleep-state is one of the adjustment-allowed sleep-states while the user is occupying the bed:

select an adjustment to the mattress based on the determined orientation; and adjust the mattress according to the selected adjustment, having an effect of encouraging the user to transition to the desired sleep-state; and responsive to a determination that the sleep-state is not one of the adjustment-allowed sleep-states while the user is occupying the bed, not adjusting the mattress.

7. The controller of claim 6, wherein to adjusting the mattress according to the selected adjustment, the controller is further configured to:

issue a command to a pump that is in fluid communication with the mattress and that is configured to change air-pressure of the mattress.

8. The controller of claim 6, wherein possible sleep-states include at least one of the group consisting of awake, Rapid Eye Movement (REM), deep sleep, light sleep, and restless.

9. The controller of claim 6, wherein the determined orientation of the user is one of the group consisting of on-back, on-side, and on-stomach.

* * * * *